US012584400B2

(12) United States Patent
Xu et al.

(10) Patent No.: US 12,584,400 B2
(45) Date of Patent: Mar. 24, 2026

(54) GEOSTEERING CONTROL FRAMEWORK

(71) Applicant: Schlumberger Technology Corporation, Sugar Land, TX (US)

(72) Inventors: Ziyuan Xu, Beijing (CN); Lu Jiang, Beijing (CN); Yansong Huang, Beijing (CN); Zhiyi Zhang, Beijing (CN); Farid Toghi, Clamart (FR); Samba Ba, Houston, TX (US); Jing Wang, Beijing (CN); Pierre Bonningue, Lysaker (NO); Firas Alshaikh Hasan, Sugar Land, TX (US); Jinsoo Kim, Houston, TX (US); Kent Harms, Sugar Land, TX (US); Loic Hoarau, Sugar Land, TX (US); Ruixia Liu, Beijing (CN); Hui Wang, Beijing (CN); Dean M. Homan, Sugar Land, TX (US); Joseph Gremillion, Sugar Land, TX (US); Michael Bower, Sugar Land, TX (US); Khaled El-Derini, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/240,964

(22) Filed: Jun. 17, 2025

(65) Prior Publication Data

US 2025/0382867 A1 Dec. 18, 2025

Related U.S. Application Data

(60) Provisional application No. 63/660,657, filed on Jun. 17, 2024.

(51) Int. Cl.
*E21B 44/00* (2006.01)
*E21B 7/04* (2006.01)
(Continued)

(52) U.S. Cl.
CPC ..... *E21B 44/00* (2013.01); *E21B 7/04* (2013.01); *E21B 7/06* (2013.01); *E21B 47/022* (2013.01);
(Continued)

(58) Field of Classification Search
CPC ..... E21B 44/00; E21B 7/04; E21B 2200/22
See application file for complete search history.

(56) References Cited

U.S. PATENT DOCUMENTS

| | | | |
|---|---|---|---|
| 12,163,413 | B1 | 12/2024 | Rasmus |
| 2010/0089645 | A1 | 4/2010 | Trinh |

(Continued)

FOREIGN PATENT DOCUMENTS

| | | | |
|---|---|---|---|
| GB | 2598186 | A | 2/2022 |
| WO | 2020163242 | A1 | 8/2020 |
| WO | 2025209995 | A1 | 10/2025 |

*Primary Examiner* — Shane Bomar
(74) *Attorney, Agent, or Firm* — Dayo Aladeniyi

(57) ABSTRACT

A method can include acquiring resistivity measurements using a downhole tool of a drillstring disposed in a borehole in a subsurface environment; performing a resistivity measurement-based inversion to generate a structural representation of a portion of the subsurface environment that includes an end of the borehole; generating a control instruction using an artificial intelligence framework and the structural representation, where the control instruction is for lengthening the borehole along a current borehole trajectory or a different borehole trajectory; and controlling the drillstring to lengthen the borehole based on the control instruction.

20 Claims, 21 Drawing Sheets

(51) Int. Cl.
*E21B 7/06* (2006.01)
*E21B 47/022* (2012.01)
*E21B 47/12* (2012.01)

(52) U.S. Cl.
CPC ..... *E21B 47/12* (2013.01); *E21B 2200/20* (2020.05); *E21B 2200/22* (2020.05)

(56) References Cited

U.S. PATENT DOCUMENTS

| | | | | |
|---|---|---|---|---|
| 2012/0188091 | A1 | 7/2012 | Calleja | |
| 2013/0019671 | A1* | 1/2013 | Stibbe | E21B 49/08 73/152.24 |
| 2016/0230533 | A1* | 8/2016 | Steele | E21B 21/08 |
| 2017/0235007 | A1 | 8/2017 | Holtz | |
| 2018/0058211 | A1* | 3/2018 | Liang | E21B 44/00 |
| 2019/0345809 | A1 | 11/2019 | Jain | |
| 2020/0248547 | A1 | 8/2020 | Fitzgerald | |
| 2021/0189872 | A1* | 6/2021 | Miller | E21B 47/12 |
| 2021/0230993 | A1* | 7/2021 | Zalluhoglu | E21B 7/046 |
| 2021/0293136 | A1 | 9/2021 | Newhouse | |
| 2021/0381365 | A1 | 12/2021 | Clegg | |
| 2022/0178248 | A1 | 6/2022 | Chambon | |
| 2023/0313663 | A1 | 10/2023 | Wessling | |
| 2023/0340845 | A1* | 10/2023 | Van Haecke | E21B 47/12 |
| 2024/0069239 | A1 | 2/2024 | Bennett | |
| 2024/0247578 | A1 | 7/2024 | Ba | |
| 2025/0154861 | A1* | 5/2025 | Zainalabedin | E21B 44/00 |
| 2025/0215774 | A1 | 7/2025 | Zeng | |
| 2025/0215775 | A1* | 7/2025 | Gutierrez Gonzalez | E21B 44/00 |
| 2025/0250891 | A1 | 8/2025 | Li | |
| 2025/0382845 | A1 | 12/2025 | Xu | |
| 2025/0382866 | A1 | 12/2025 | Xu | |

* cited by examiner

1800

1900

GEOSTEERING CONTROL FRAMEWORK

RELATED APPLICATION

This application claims priority to and the benefit of a U.S. Provisional Application having Ser. No. 63/660,657, filed 17 Jun. 2024, which is incorporated by reference herein in its entirety.

BACKGROUND

Geosteering may provide for directional control of a drill bit of a drillstring using downhole geological logging measurements, for example, to keep a directional wellbore within a pay zone. In various scenarios, geosteering may be used to keep a wellbore in a particular section of a reservoir to minimize gas or water breakthrough and maximize hydrocarbon production. In various scenarios, geosteering may be utilized in drilling of a borehole for one or more purposes, which may include one or more purposes other than hydrocarbon production (e.g., injection, carbon sequestration, geothermal, etc.).

SUMMARY

A method can include acquiring resistivity measurements using a downhole tool of a drillstring disposed in a borehole in a subsurface environment; performing a resistivity measurement-based inversion to generate a structural representation of a portion of the subsurface environment that includes an end of the borehole; generating a control instruction using an artificial intelligence framework and the structural representation, where the control instruction is for lengthening the borehole along a current borehole trajectory or a different borehole trajectory; and controlling the drillstring to lengthen the borehole based on the control instruction. A system can include a processor; memory accessible to the processor; and processor-executable instructions stored in the memory and executable by the processor to instruct the system to: acquire resistivity measurements using a downhole tool of a drillstring disposed in a borehole in a subsurface environment; perform a resistivity measurement-based inversion to generate a structural representation of a portion of the subsurface environment that includes an end of the borehole; generate a control instruction using an artificial intelligence framework and the structural representation, where the control instruction is for lengthening the borehole along a current borehole trajectory or a different borehole trajectory; and control the drillstring to lengthen the borehole based on the control instruction. One or more non-transitory computer-readable storage media can include processor-executable instructions executable to instruct a processor to: acquire resistivity measurements using a downhole tool of a drillstring disposed in a borehole in a subsurface environment; perform a resistivity measurement-based inversion to generate a structural representation of a portion of the subsurface environment that includes an end of the borehole; generate a control instruction using an artificial intelligence framework and the structural representation, where the control instruction is for lengthening the borehole along a current borehole trajectory or a different borehole trajectory; and control the drillstring to lengthen the borehole based on the control instruction. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations may be more readily understood by reference to the following description taken in conjunction with the accompanying drawings.

DETAILED DESCRIPTION

The following description includes embodiments of the best mode presently contemplated for practicing the described implementations. This description is not to be taken in a limiting sense, but rather is made merely for the purpose of describing the general principles of the implementations. The scope of the described implementations should be ascertained with reference to the issued claims.

As mentioned, geosteering may provide for directional control of a drill bit of a drillstring using downhole geological logging measurements, for example, to keep a directional wellbore within a pay zone where, in various scenarios, geosteering may be used to keep a wellbore in a particular section of a reservoir to minimize gas or water breakthrough and maximize hydrocarbon production.

A borehole may be referred to as a wellbore and may include an openhole portion or an uncased portion and/or may include a cased portion. A borehole may be defined by a bore wall that is composed of rock that bounds the borehole. As to a well or a borehole, whether for one or more of exploration, sensing, production, injection or other operation(s), it may be planned. Such a process may be referred to generally as well planning, a process by which a path may be mapped in a geologic environment. Such a path may be referred to as a trajectory, which may include coordinates in a three-dimensional coordinate system where a measure along the trajectory may be a measured depth (MD), a total vertical depth (TVD) or another type of measure.

As an example, drilling may include using one or more logging tools that may perform one or more logging operations while drilling or otherwise with a drillstring (e.g., while stationary, while tripping in, tripping out, etc.). As an example, drilling or one or more other operations may occur responsive to measurements. For example, a logging while drilling operation may acquire measurements and adjust drilling based at least in part on such measurements. In such an example, adjustments may be made by actuating one or more geosteering actuators that may provide for orienting a drill bit of a drillstring.

Figure 1:
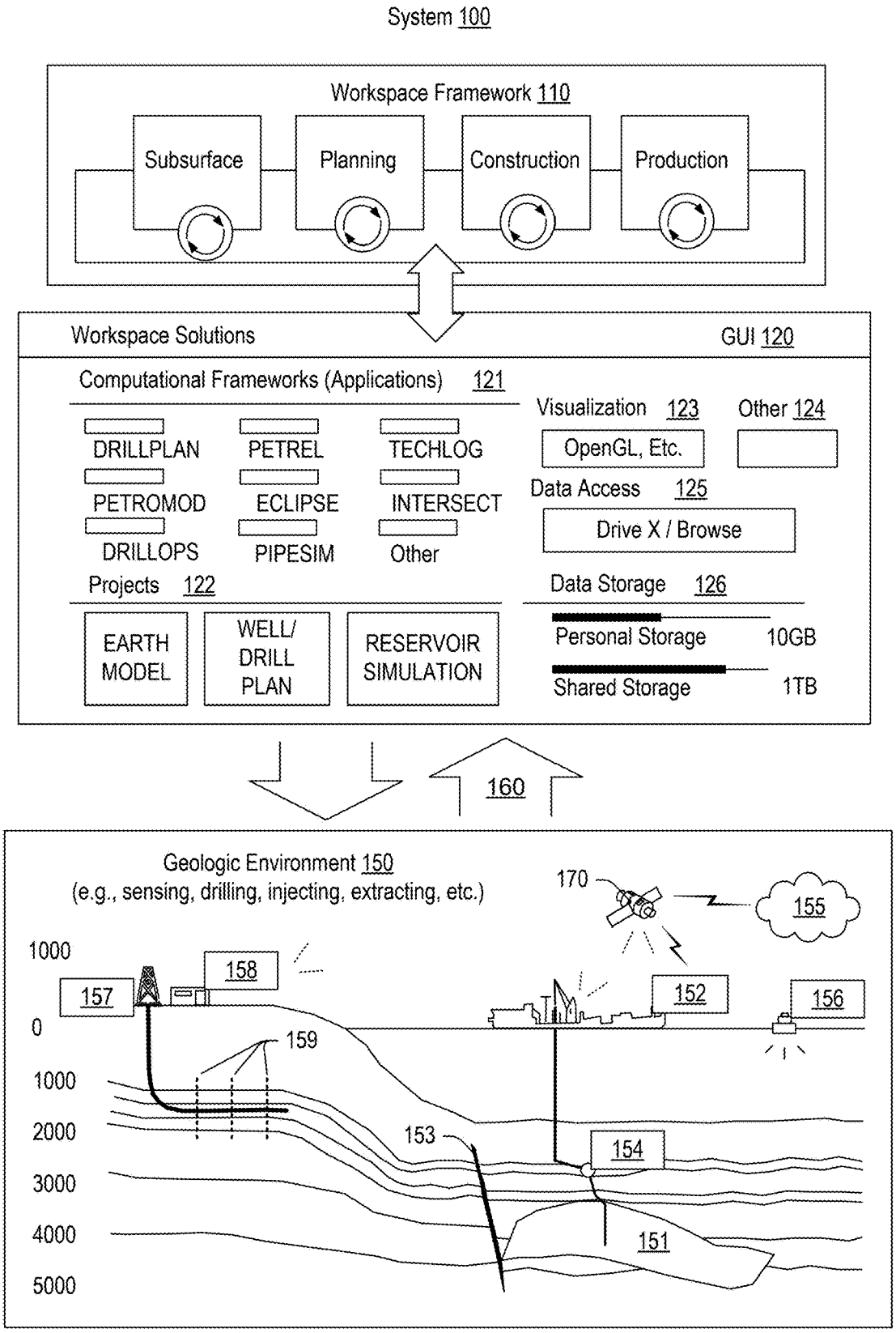
FIG. 1 illustrates an example of a system and examples of equipment in a geologic environment.

FIG. 1 shows an example of a system 100 that includes a workspace framework 110 that may provide for instantiation of, rendering of, interactions with, etc., a graphical user interface (GUI) 120. In the example of FIG. 1, the GUI 120 may include graphical controls for computational frameworks (e.g., applications, etc.) 121, projects 122, visualization features 123, one or more other features 124, data access 125, and data storage 126.

In the example of FIG. 1, the workspace framework 110 may be tailored to a particular geologic environment such as an example geologic environment 150. For example, the geologic environment 150 may include layers (e.g., stratification) that include a reservoir 151 and that may be intersected by a fault 153. As an example, the geologic environment 150 may be outfitted with a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a wellsite and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite 170 in communication with the network 155 that may be configured for communications, noting that the satellite may additionally or alternatively include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

In the example of FIG. 1, the GUI 120 shows some examples of computational frameworks, including the DRILLPLAN, DRILLOPS, PETREL, TECHLOG, PETROMOD, ECLIPSE, PIPESIM, and INTERSECT frameworks (SLB, Houston, Texas).

The DRILLPLAN framework provides for digital well construction planning and includes features for automation of repetitive tasks and validation workflows, enabling improved quality drilling programs (e.g., digital drilling plans, etc.) to be produced quickly with assured coherency.

The DRILLOPS framework may execute a digital drilling plan and ensures plan adherence, while delivering goal-based automation. The DRILLOPS framework may generate activity plans automatically individual operations, whether they are monitored and/or controlled on the rig or in town. Automation may utilize data analysis and learning systems to assist and optimize tasks, such as, for example, setting ROP to drilling a stand. A preset menu of automatable drilling tasks may be rendered, and, using data analysis and models, a plan may be executed in a manner to achieve a specified goal, where, for example, measurements may be utilized for calibration. The DRILLOPS framework provides flexibility to modify and replan activities dynamically, for example, based on a live appraisal of various factors (e.g., equipment, personnel, and supplies). Well construction activities (e.g., tripping, drilling, cementing, etc.) may be continually monitored and dynamically updated using feedback from operational activities. The DRILLOPS framework may provide for various levels of automation based on planning and/or re-planning (e.g., via the DRILLPLAN framework), feedback, etc.

The PETREL framework may be part of the DELFI environment for utilization in geosciences and geoengineering, for example, to analyze subsurface data from exploration to production of fluid from a reservoir. The DELFI cognitive exploration and production (E&P) environment (SLB, Houston, Texas), referred to herein as the DELFI environment or DELFI framework, is a secure, cognitive, cloud-based collaborative environment that integrates data and workflows with digital technologies, such as artificial intelligence and machine learning.

The PETREL framework provides components that allow for optimization of various exploration, development and production operations. The PETREL framework includes seismic to simulation software components that may output information for use in increasing reservoir performance, for example, by improving asset team productivity. Through use of such a framework, various professionals (e.g., geophysicists, geologists, and reservoir engineers) may develop collaborative workflows and integrate operations to streamline processes (e.g., with respect to one or more geologic environments, etc.). Such a framework may be considered an application (e.g., executable using one or more devices) and may be considered a data-driven application (e.g., where data is input for purposes of modeling, simulating, etc.).

The TECHLOG framework may handle and process field and laboratory data for a variety of geologic environments (e.g., deepwater exploration, shale, etc.). The TECHLOG framework may structure wellbore data for analyses, planning, etc.

The PETROMOD framework provides petroleum systems modeling capabilities that may combine one or more of seismic, well, and geological information to model the evolution of a sedimentary basin. The PETROMOD framework may predict if, and how, a reservoir has been charged with hydrocarbons, including the source and timing of hydrocarbon generation, migration routes, quantities, and hydrocarbon type in the subsurface or at surface conditions.

The ECLIPSE framework provides a reservoir simulator (e.g., as a computational framework) with numerical solutions for fast and accurate prediction of dynamic behavior for various types of reservoirs and development schemes.

The INTERSECT framework provides a high-resolution reservoir simulator for simulation of detailed geological features and quantification of uncertainties, for example, by creating accurate production scenarios and, with the integration of precise models of the surface facilities and field operations, the INTERSECT framework may produce reliable results, which may be continuously updated by real-time data exchanges (e.g., from one or more types of data acquisition equipment in the field that may acquire data during one or more types of field operations, etc.). The INTERSECT framework may provide completion configurations for complex wells where such configurations may be built in the field, may provide detailed enhanced-oil-recovery (EOR) formulations where such formulations may be implemented in the field, may analyze application of steam injection and other thermal EOR techniques for implementation in the field, advanced production controls in terms of reservoir coupling and flexible field management, and flexibility to script customized solutions for improved modeling and field management control. The INTERSECT framework, as with the other example frameworks, may be utilized as part of the DELFI environment, for example, for rapid simulation of multiple concurrent cases. For example, a workflow may utilize one or more of the DELFI environment on demand reservoir simulation features.

The aforementioned DELFI environment provides various features for workflows as to subsurface analysis, planning, construction and production, for example, as illustrated in the workspace framework 110. As shown in FIG. 1, outputs from the workspace framework 110 may be utilized for directing, controlling, etc., one or more processes in the geologic environment 150 and, feedback 160, may be received via one or more interfaces in one or more forms (e.g., acquired data as to operational conditions, equipment conditions, environment conditions, etc.).

As an example, a workflow may progress to a geology and geophysics ("G&G") service provider, which may generate a well trajectory, which may involve execution of one or more G&G frameworks (e.g., consider the PETREL framework, etc.).

In the example of FIG. 1, the visualization features 123 may be implemented via the workspace framework 110, for example, to perform tasks as associated with one or more of subsurface regions, planning operations, constructing wells and/or surface fluid networks, and producing from a reservoir.

As an example, a visualization process may implement one or more of various features that may be suitable for one or more web applications. For example, a template may involve use of the JAVASCRIPT object notation format (JSON) and/or one or more other languages/formats. As an example, a framework may include one or more converters. For example, consider a JSON to PYTHON converter and/or a PYTHON to JSON converter. Such an approach may provide for compatibility of devices, frameworks, etc., with respect to one or more sets of instructions.

As an example, visualization features may provide for visualization of various earth models, properties, etc., in one or more dimensions. As an example, visualization features may provide for rendering of information in multiple dimensions, which may optionally include multiple resolution rendering. In such an example, information being rendered may be associated with one or more frameworks and/or one or more data stores. As an example, visualization features may include one or more control features for control of equipment, which may include, for example, field equipment that may perform one or more field operations. As an example, a workflow may utilize one or more frameworks to generate information that may be utilized to control one or more types of field equipment (e.g., drilling equipment, wireline equipment, fracturing equipment, etc.).

As to a reservoir model that may be suitable for utilization by a simulator, consider acquisition of seismic data as acquired via reflection seismology, which finds use in geophysics, for example, to estimate properties of subsurface formations. As an example, reflection seismology may provide seismic data representing waves of elastic energy (e.g., as transmitted by P-waves and S-waves, in a frequency range of approximately 1 Hz to approximately 100 Hz). Seismic data may be processed and interpreted, for example, to understand better composition, fluid content, extent and geometry of subsurface rocks. Such interpretation results may be utilized to plan, simulate, perform, etc., one or more operations for production of fluid from a reservoir (e.g., reservoir rock, etc.).

As an example, a model may be a simulated version of a geologic environment. As an example, a simulator may include features for simulating physical phenomena in a geologic environment based at least in part on a model or models. A simulator, such as a reservoir simulator, may simulate fluid flow in a geologic environment based at least in part on a model that may be generated via a framework that receives seismic data. A simulator may be a computerized system (e.g., a computing system) that may execute instructions using one or more processors to solve a system of equations that describe physical phenomena subject to various constraints. In such an example, the system of equations may be spatially defined (e.g., numerically discretized) according to a spatial model that that includes layers of rock, geobodies, etc., that have corresponding positions that may be based on interpretation of seismic and/or other data. A spatial model may be a cell-based model where cells are defined by a grid (e.g., a mesh). A cell in a cell-based model may represent a physical area or volume in a geologic environment where the cell may be assigned physical properties (e.g., permeability, fluid properties, etc.) that may be germane to one or more physical phenomena (e.g., fluid volume, fluid flow, pressure, etc.). A reservoir simulation model may be a spatial model that may be cell-based.

While several simulators are illustrated in the example of FIG. 1, one or more other simulators may be utilized, additionally or alternatively. For example, consider the VISAGE geomechanics simulator (SLB, Houston Texas) or the PIPESIM network simulator (SLB, Houston Texas), etc.

As an example, a workflow may utilize one or more types of data for one or more processes (e.g., stratigraphic modeling, basin modeling, completion designs, drilling, production, injection, etc.). As an example, one or more tools may provide data that may be used in a workflow or workflows that may implement one or more frameworks (e.g., PETREL, TECHLOG, PETROMOD, ECLIPSE, etc.).

In the example of FIG. 1, drilling may be performed in the geologic environment 150, for example, to access the reservoir 151, which may be accessed from land or offshore. In FIG. 1, the downhole equipment 154 may be, for example, part of a bottom hole assembly (BHA). The BHA may be used to drill a well. The downhole equipment 154 may communicate information to equipment at the surface, and may receive instructions and information from the equipment at the surface. During a well construction process, a variety of operations (such as cementing, wireline evaluation, testing, etc.) may be conducted. In such embodiments, data collected by tools and sensors and used for reasons such as reservoir characterization may be collected and transmitted.

A well may include a substantially horizontal portion (e.g., lateral portion) that may intersect with one or more fractures. For example, a well in a shale formation may pass through natural fractures, artificial fractures (e.g., hydraulic fractures), or a combination thereof. Such a well may be constructed using directional drilling techniques as described herein. However, these same techniques may be used in connection with other types of directional wells (such as slant wells, S-shaped wells, deep inclined wells, and others) and are not limited to horizontal wells.

As an example, a platform, such as, for example, the LUMI platform (SLB, Houston, Texas) may be utilized. The LUMI platform includes features that provide for artificial intelligence solutions as may be integrated with data management capabilities. The LUMI platform provides for flexible deployment options and an open, secure, and modular architecture, for example, to empower data-driven decision-making. The LUMI platform is operable with the DELFI environment and, hence, one or more of various frameworks. While various platforms, environments, frameworks, libraries, etc., are mentioned, a framework may be operable in an agnostic manner, for example, to be compatible with one or more other platforms, environments, frameworks, libraries, technologies, etc.

Figure 2:
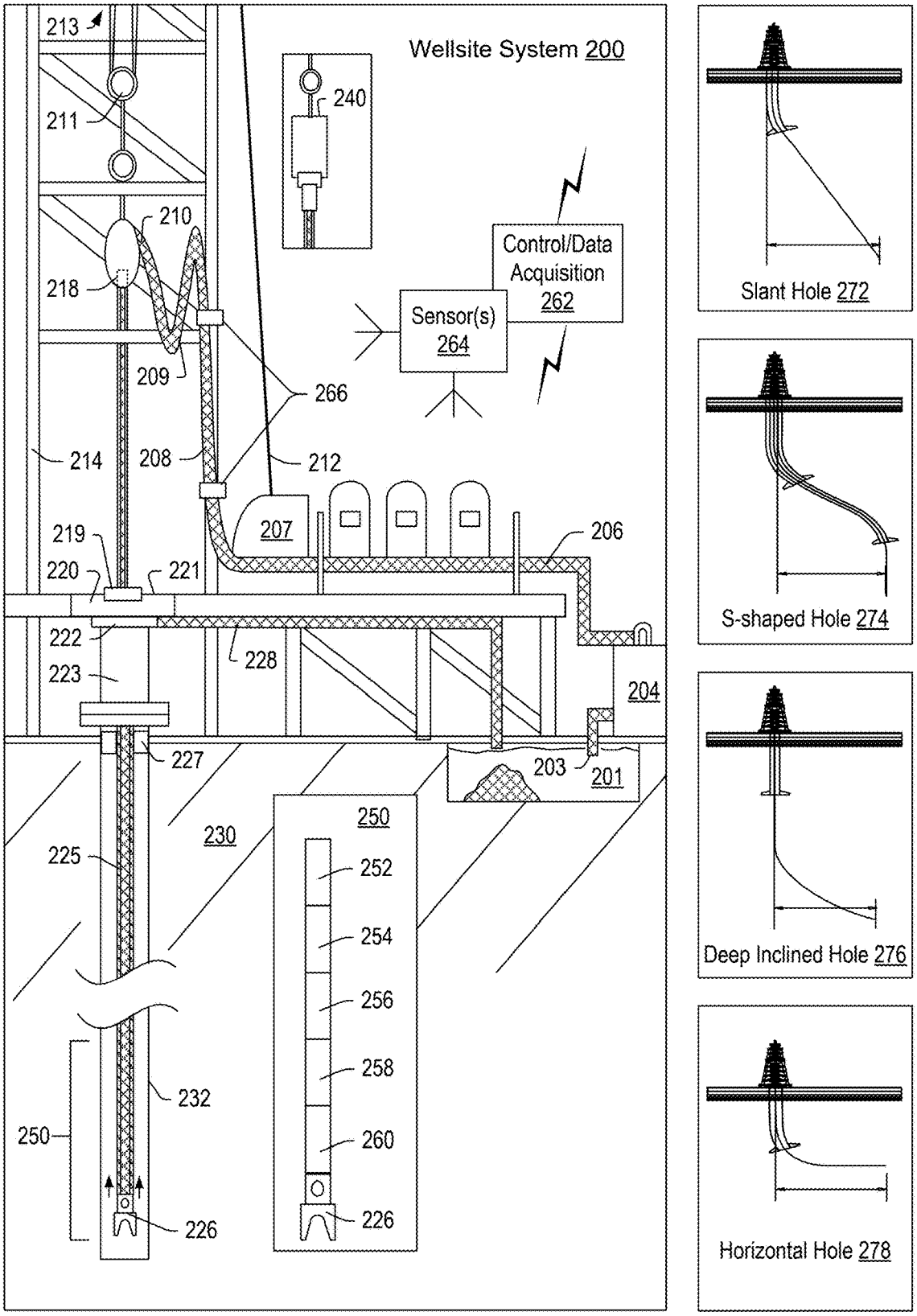
FIG. 2 illustrates an example of a system and examples of types of holes.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid that may help to transport cuttings, etc.), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212 (see, e.g., the crown block 173 of FIG. 1), a derrick 214 (see, e.g., the derrick 172 of FIG. 1), a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use directional drilling or one or more other types of drilling.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the platform 215 and the derrick 214 positioned over the borehole 232. As mentioned, the wellsite system 200 may include the rotary table 220 where the drillstring 225 passes through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225.

During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more components of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring may include a plurality of tools.

As to an RSS, it involves technology utilized for direction drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; noting that a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit during directional drilling. A PDM operates as drilling fluid is pumped through it where the PDM converts hydraulic power of the drilling fluid into mechanical power to cause the bit to rotate. A PDM may operate in a so-called sliding mode, when the drillstring is not rotated from the surface.

An RSS may drill directionally where there is continuous rotation from surface equipment, which may alleviate the sliding of a steerable motor (e.g., a PDM). An RSS may be deployed when drilling directionally (e.g., deviated, horizontal, or extended-reach wells). An RSS may aim to minimize interaction with a borehole wall, which may help to preserve borehole quality. An RSS may aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and may contain one or a plurality of selected types of logging tools (e.g., NMR unit or units, etc.). It will also be understood that one or more LWD and/or MWD modules may be employed at one or more positions. An LWD module may include capabilities for measuring, processing, and storing information, as well as for communicating with the surface equipment. In the illustrated example, the LWD module 254 may include a seismic measuring device (e.g., sonic, etc.), an NMR measuring device, a resistivity measuring device, etc.

The MWD module 256 may be housed in a suitable type of drill collar and may contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller may generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

As an example, one or more measuring devices may be included in a drillstring (e.g., a BHA, etc.) where, for example, measurements may support one or more of geosteering, geostopping, trajectory optimization, etc.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees. As an example, a trajectory and/or a drillstring may be characterized in part by a dogleg severity (DLS), which may be a two-dimensional parameter specified in degrees per 30 meters (e.g., or degrees per 100 feet).

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, consider a drillstring that may include a positive displacement motor (PDM).

As an example, a system may be a steerable system and include equipment to perform a method such as geosteering. As mentioned, a steerable system may be or include an RSS. As an example, a steerable system may include a PDM and/or a turbine on a lower part of a drillstring which, just above a drill bit, a bent sub may be mounted. Geosteering equipment of a drillstring may include one or more geosteering actuators that may provide for orienting a drill bit of the drillstring. For example, an actuator that may include a piston that moves a pad for providing a force that may be exerted against a borehole wall thus steering a bottom hole assembly (e.g., orienting a drill bit of the bottom hole assembly). As an example, an actuator may be a bent downhole motor, which may be actuated via one or more processes. As an example, a bent drilling motor may be used with a fixed bend that cannot be varied during normal operation or with a variable bend that, for example, may be varied based on a geosteering command. As an example, for a variable bend drilling motor, one or more actuators may be included that may be configured to create or vary a bend, thereby affecting the steering behavior of the steering system. As an example, an actuator may be a downhole actuator that may adjust orientation downhole and/or an actuator may be a surface actuator that may perform an action uphole (e.g., at surface) to adjust orientation downhole.

As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send to the surface various types of data of interest, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include one or more of an azimuthal density neutron (ADN) tool for measuring density and porosity; a MWD tool for measuring inclination, azimuth and shocks; a compensated dual resistivity (CDR) tool for measuring resistivity and gamma ray related phenomena; a combinable magnetic resonance (CMR) tool for measuring properties (e.g., relaxation properties, etc.); one or more variable gauge stabilizers; one or more bend joints; and a geosteering tool, which may include a motor and optionally equipment for measuring and/or responding to one or more of inclination, resistivity and gamma ray related phenomena.

As an example, a tool such as the ECOSCOPE tool (SLB, Houston, Texas) may be utilized to acquire measurements. Such a tool may include one or more PNGs and associated detectors. Such a tool may include features for one or more of resistivity, neutron porosity, azimuthal gamma ray, density, elemental capture spectroscopy and sigma measurements. For example, consider features for one or more of 2 MHz and 400 kHz propagation resistivity, elemental capture spectroscopy, neutron-gamma density, capture cross section (sigma), azimuthal bulk density, azimuthal photoelectric factor, azimuthal natural gamma ray, density caliper, ultrasonic caliper, annular pressure and temperature while drilling, triaxial shocks and vibration, and near-bit borehole inclination. Such a tool may be operatively coupled to one or more telemetry systems that may provide for real-time acquisition and, for example, real-time decision making, rendering of graphics, etc. As an example, such a tool may be operatively coupled to one or more types of circuitries, which may, for example, perform computations downhole using measurements acquired downhole.

As an example, a tool such as the PERISCOPE tool (SLB, Houston, Texas) may be utilized to acquire measurements. For example, consider measurements such as resistivity, which may be acquired using one or more types of receivers. As an example, a receiver may be or include an antenna. For example, the PERISCOPE tool may include tilted, axial, and transverse antenna. As an example, data acquired from such a tool may provide for identification of layers, number of layers, position of a layer or layers, within a distance of 1 meter or more (e.g., up to or more than 8 meters).

As to sigma measurements (e.g., sigma data), sigma is the macroscopic cross section for the absorption of thermal neutrons, or capture cross section, of a volume of matter, measured in capture units (c.u.). A sigma log is the principal output of a pulsed neutron capture log, which may be used for one or more purposes.

As an example, one or more types of nuclear measurements may be acquired by one or more tools where such nuclear measurements may include one or more of electron density ($\rho_e$), hydrogen index (HI), and thermal neutron capture cross section (sigma or $\Sigma$).

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266 (e.g., consider mud-pulse telemetry). In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

Analysis of formation information acquired by one or more tools may reveal features such as, for example, vugs, dissolution planes (e.g., dissolution along bedding planes), stress-related features, dip events, etc. As an example, a tool may acquire information that may help to characterize a reservoir, optionally a fractured reservoir where fractures may be natural and/or artificial (e.g., hydraulic fractures). A reservoir may be a porous formation where fluid may be within various pores of the porous formation and amenable to movement (e.g., to produce fluid from the reservoir). As an example, information acquired by a tool or tools may be analyzed using a framework such as the TECHLOG framework (SLB, Houston, Texas). As an example, the TECHLOG framework may be interoperable with one or more other frameworks such as, for example, the PETREL framework (SLB, Houston, Texas). As an example, a computational environment such as, for example, the DELFI environment (SLB, Houston, Texas) may be utilized, which may provide for utilization of the PETREL framework and other frameworks, optionally in interrelated manners.

Figure 3:
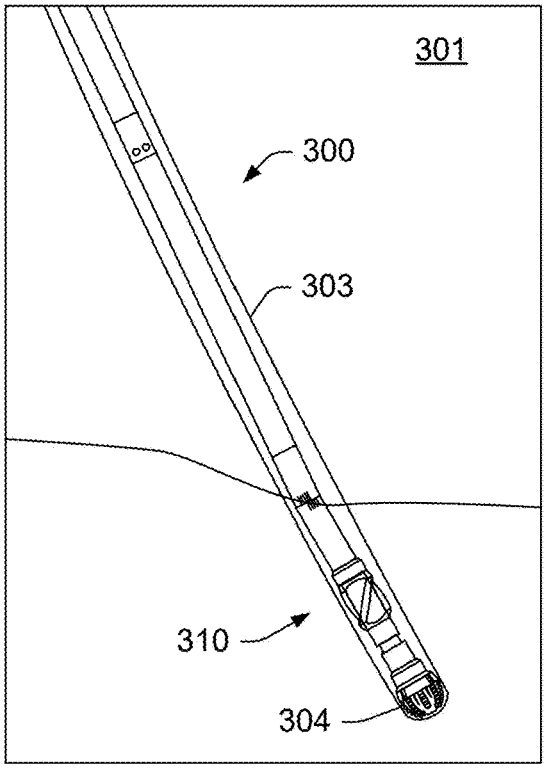
FIG. 3 illustrates an example of a geologic environment with a borehole and an example of a portion of a drillstring that may include various components.
Figure 3:
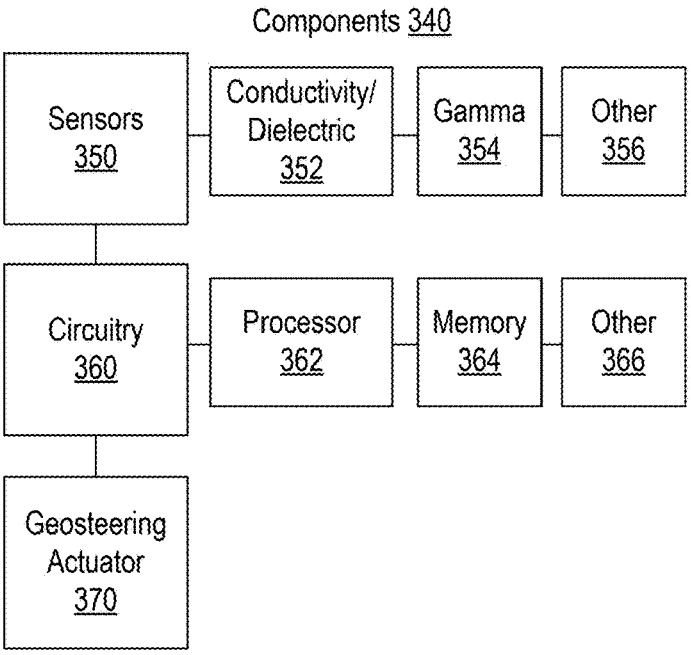
Figure 3:
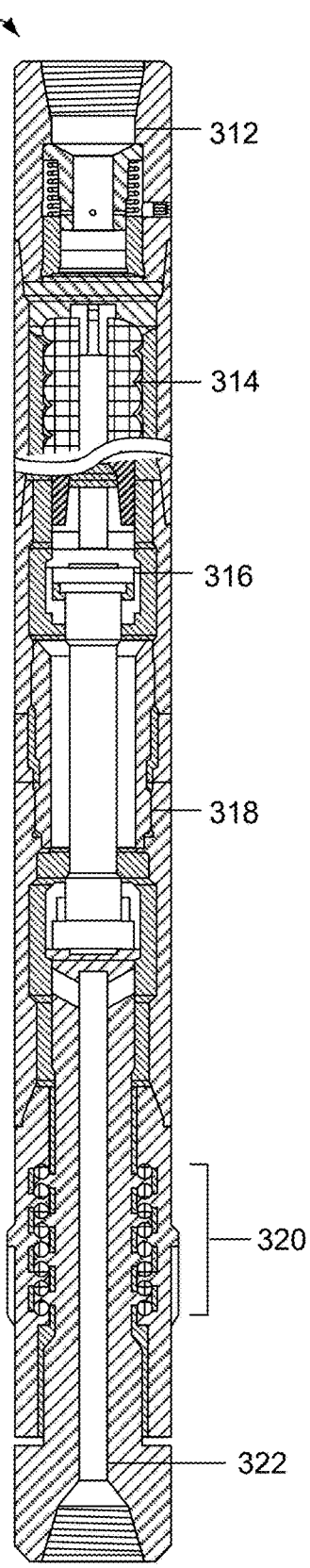

FIG. 3 shows an example of a drilling assembly 300 in a geologic environment 301 that includes a borehole 303 where the drilling assembly 300 (e.g., a drillstring) includes a bit 304 and a motor section 310 where the motor section 310 may drive the bit 304 (e.g., cause the bit 304 to rotate and deepen the borehole 303).

As shown, the motor section 310 may include a dump valve 312, a power section 314, a surface-adjustable bent housing 316, a transmission assembly 318, a bearing section 320 and a drive shaft 322, which may be operatively coupled to a bit such as the bit 304. The motor section 310 of FIG. 3 may be a POWERPAK family motor section (SLB, Houston, Texas) or another type of motor section.

A power section may convert hydraulic energy from drilling fluid into mechanical power to turn a bit. For example, consider the reverse application of the Moineau pump principle. During operation, drilling fluid may be pumped into a power section at a pressure that causes the rotor to rotate within the stator where the rotational force is transmitted through a transmission shaft and drive shaft to a bit.

FIG. 3 also shows examples of components 340 such as, for example, sensors 350, circuitry 360 and a geosteering actuator 370. As shown, the sensors 350 may include a conductivity and dielectric sensor 352, a gamma sensor 354 and one or more other sensors 356. As shown, the circuitry 360 may include a processor 362, memory 364 and one or more other types of circuitries 366. As shown, the geosteering actuator 370 may be operatively coupled to the circuitry 360 and the sensors 350. For example, the circuitry 360 may process signals (e.g., measurements or sensor data) of the sensors 350 to generate one or more commands for actuation of the geosteering actuator 370. In the example of FIG. 3, the geosteering actuator 370 may provide for one or more of PDM actuation and bent sub actuation, for example, to orient the drill bit 304.

Figure 4:
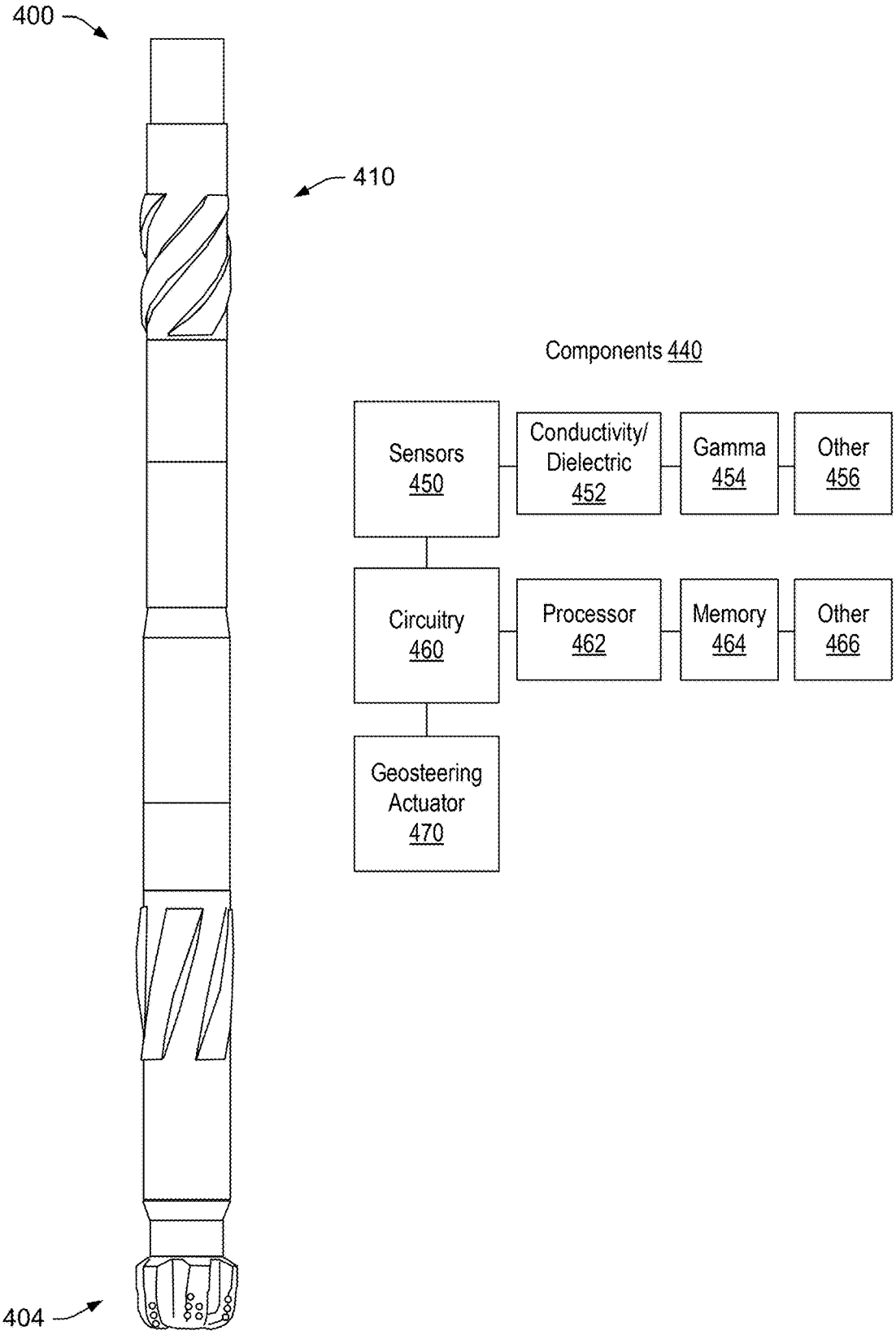
FIG. 4 illustrates an example of a portion of a drillstring that may include various components.

FIG. 4 shows an example of a drilling assembly 400 (e.g., a portion of a drillstring) that includes a bit 404 and a rotary steerable system (RSS) 410. As mentioned, an RSS may be utilized for directional drilling, including geosteering. As an example, the RSS 410 may include one or more features of a POWERDRIVE ARCHER RSS (SLB, Houston, Texas).

FIG. 4 also shows examples of components 440 such as, for example, sensors 450, circuitry 460 and a geosteering actuator 470. As shown, the sensors 450 may include a conductivity and dielectric sensor 452, a gamma sensor 454 and one or more other sensors 456. As shown, the circuitry 460 may include a processor 462, memory 464 and one or more other types of circuitries 466. As shown, the geosteering actuator 470 may be operatively coupled to the circuitry 460 and the sensors 450. For example, the circuitry 460 may process signals (e.g., measurements or sensor data) of the sensors 450 to generate one or more commands for actuation of the geosteering actuator 470. In the example of FIG. 4, the geosteering actuator 470 may provide for RSS actuation, for example, to orient the drill bit 404.

As an example, the drilling assembly 400 may include one or more of a near-bit continuous inclination and azimuth measurement unit or sub, a near-bit azimuthal gamma ray measurement unit or sub, and one or more other types of measurement units or subs.

As an example, a drilling assembly may include one or more types of circuitries. For example, consider a processing unit with a processor and associated memory where one or more sensors may generate signals that may be received by the processing unit. In such an example, the processing unit may perform computations that may utilize information in the signals (e.g., measurements, etc.) to generate commands for geosteering. In such an example, a drilling assembly may be capable of performing, at least in part, downhole geosteering according to geosteering commands generated downhole without transmission of information uphole to a controller and subsequent transmission of information downhole to geosteering equipment. In such an example, at least some types of geosteering processes may be performed more rapidly in response to sensor signals. For example, consider sensor signals indicative of one or more of presence of clay, an amount of clay, a type of clay, and a boundary as an interface between layers, where downhole geosteering equipment may act to steer a drill bit based on one or more of such sensor signals.

As an example, an electromagnetic conductivity measurement tool (ECM tool) may be implemented as a wireline tool and/or implemented as a LWD tool to generate permittivity and conductivity measurements at each frequency for one or more frequencies, which may be interpreted using a petrophysical model. In such an example, output parameters of the model may include water-filled porosity (hence water saturation if the total porosity is known) and water salinity. As an example, parameters that may be output using ECM tool measurements (e.g., induction, propagation, etc.) may include one or more of bulk formation cation exchange capacity (CEC), water saturation (Sw), connate water salinity, Archie cementation exponent and Archie saturation exponent.

Figure 5:
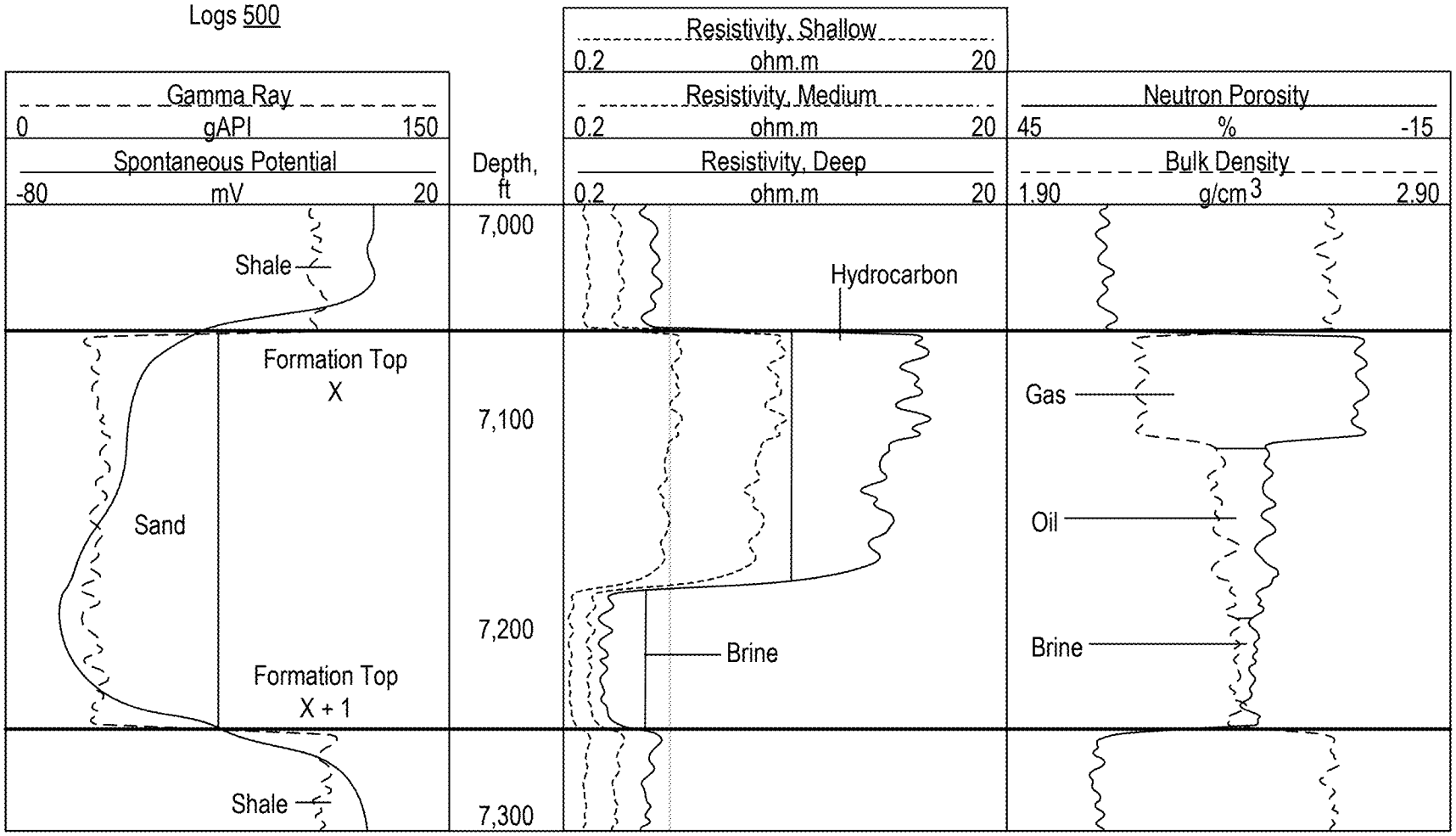
FIG. 5 illustrates examples of logs.

FIG. 5 shows example logs 500 that include various measurements acquired by one or more downhole tools. For example, the logs 500 include spontaneous potential (mV), gamma ray (gAPI), resistivity (ohm·m), neutron porosity (percent), and bulk density ($g \cdot cm^{-3}$). The gamma ray response (track 1) distinguishes the low gamma ray value of sand from the higher value of shale. The spontaneous potential curve generally follows a trend similar to that of the gamma ray. The next column, referred to as a depth track (track 2), indicates the depth at which measurements have been acquired. Across the sandstone formation, the resistivity measurements (track 3) are noticeably higher in the hydrocarbon zone than in the water-saturated zone in the lower part of the sand. Both neutron porosity and bulk density (track 4) provide measures of porosity. Within the hydrocarbon-bearing zone, the separation of the curves varies depending on the type of fluid encountered.

As an example, logs may be acquired as to formation parameters versus depth where, from such logs, lithologies may be identified that may differentiate various type of rock. For example, consider differentiating between porous and nonporous rock, which may provide for identification of one or more pay zones in subsurface formations. In a given field or local geological province, certain formations may have distinctive characteristics that appear similar from one well to the next, providing geologists with a basis for locating the depths of various strata in the subsurface. For example, consider identification of formation tops, which may be tracked from logs of one well to logs of another well. In the example of FIG. 5, the logs 500 include variations with respect to shale and sand where a first interface may be referred to as formation top X and a second interface may be referred to as formation top X+1. In such an example, an interface may be referred to as a boundary, which may also be identifiable in one or more other types of data such as, for example, seismic data. As an example, a workflow may include correlation of seismic picks to geologic picks, such as formation tops interpreted from well logs, to improve model building, etc.

In 1942, the relationship between resistivity, porosity and water saturation (and thus its inverse: hydrocarbon saturation) was established by G.E. Archie, paving the way for a quantitative evaluation of formation properties using well logs. The Archie equation or relationship may be expressed between the formation factor (F) and porosity (phi) as $F=1/phi^m$, where the porosity exponent, m, is a constant for a particular formation or type of rock, which may be referred to as the Archie cementation exponent (e.g., consider values between 1.8 and 2.0 for consolidated sandstones, and close to 1.3 for loosely consolidated sandstones).

As to resistivity of rock, it is a measure of the degree to which rock may impede the flow of an electric current. As shown, resistivity may be expressed in units of ohm·m, noting that it may be measured in $ohm \cdot m^2/m$. The reciprocal of resistivity is conductivity, which is typically expressed in terms of millimhos or mmhos. The ability to conduct electrical current is a function of the conductivity of water contained in pore space of rock. Pure water does not conduct electricity; whereas, salt ions found in most formation waters do provide for conduction of electricity. Brine-saturated rocks tend to have high conductivity and low resistivity, which may be seen in the resistivity log data of FIG. 5 at depths about 7,200 feet. Hydrocarbons, which are nonconductive, cause resistivity values to increase as the pore spaces within a rock become more saturated with oil or gas.

As to spontaneous potential (SP), it is a measurement of voltage difference between a movable electrode in a wellbore and a fixed electrode at the surface. This electrical potential is primarily generated as a result of exchanges of fluids of different salinities (e.g., salinity of drilling fluid and salinity of formation fluid). During the course of drilling, permeable rock within a wellbore may become invaded by drilling mud filtrate where, if the filtrate is less saline than formation fluid, negatively charged chlorine ions from formation water may cause the SP curve to deflect to the left from an arbitrary baseline established across impermeable shale formations. The magnitude of the deflection is influenced by a number of factors, including permeability, porosity, formation water salinity and mud filtrate properties. Permeable formations filled with water that is fresher than the filtrate will cause the curve to deflect to the right. Hence, by the nature of deflections, an SP log may indicate which formations are permeable. A permeable formation with a high resistivity may be more likely to contain hydrocarbons.

As shown in the logs 500, a gamma ray (GR) log may be included, along with one or more of multiple resistivity logs and porosity readings obtained from density, neutron, and/or sonic logs. As to GR log acquisition, a downhole tool may measure naturally occurring radioactivity from a formation where a GR log may help differentiate non-reservoir rocks (e.g., shales and clays) from reservoir rocks (e.g., sandstone and carbonates). Shales and clays tend to be derived from rocks that tend to contain naturally occurring radioactive elements, primarily potassium, uranium and thorium. As a consequence, shales and clays are more radioactive than clean sandstones and carbonates. Quartz and calcium carbonate produce almost no radiation. A log analysis may look for formations with low background radiation because they may have potential to contain moveable hydrocarbons.

Various resistivity tools may measure a formation at different depths of investigation (e.g., shallow, medium and deep). A resulting log may present shallow, medium and deep tracks. A shallow curve, charting the smallest radius of investigation, may indicate resistivity of a flushed zone surrounding a borehole; a medium curve may indicate resistivity of an invaded zone; and a deepest curve may indicate resistivity of an uncontaminated zone, which may be presumed to be a true formation resistivity; noting that such a curve may still be affected by the presence of mud filtrate. By evaluating separations between curves at different depths of investigation, an analysis may provide an estimation of a diameter of invasion by mud filtrate and may be able to determine which zones are more permeable than others.

As to formation bulk density, it provides a measure of porosity. The bulk density of a formation is based on a ratio of a measured interval's mass to its volume. In general, rock porosity tends to be inversely related to rock density. Formation bulk density may be derived from electron density of a formation. Such a measurement may be obtained by a logging device that emits gamma rays into a formation.

Gamma rays may collide with electrons in a formation, giving off energy and scattering in a process known as Compton scattering. The number of such collisions is directly related to the number of electrons in a formation. In low-density formations, more of these scattered gamma rays are able to reach a detector than in formations of higher density.

As hydrogen tends to be a major constituent of both water and hydrocarbons and because water and hydrocarbons concentrate in rock pores, the concentration of hydrogen atoms may be used to determine fluid-filled porosity of a formation. Hydrogen atoms have nearly the same mass as neutrons. Neutron logging tools emit neutrons using a chemical source or an electronic neutron generator. When these neutrons collide with hydrogen atoms in a formation, they lose the maximal energy, slow down and eventually reach a very-low-energy state (e.g., a thermal state). The rate at which neutrons reach the thermal state is proportional to the hydrogen concentration or index (HI). Various neutron porosity tools measure HI, which may be converted to neutron porosity.

As an example, a sonic log may be used to determine porosity by charting the speed of a compressional sound wave as it travels through a formation. Interval transit time ($\Delta t$), measured in microseconds per meter or foot and often referred to as slowness, is the reciprocal of velocity. Lithology and porosity affect $\Delta t$. Dense, consolidated formations characterized by compaction at depth generally result in a faster (shorter) $\Delta t$ while fluid-filled porosity results in a slower (longer) $\Delta t$. Measurements may be affected by formation and borehole conditions. In various instances, quality control processes may be performed on data. As an example, gas, fractures and lack of compaction may demand adjustments to be applied to a sonic log. Lithologies affect the density, neutron and sonic logs. Invasion of mud filtrate into porous formations affects resistivity readings, and temperature affects the resistivity of both filtrate and saline formation water.

As an example, directional drilling may involve drilling a number of different sections such as, for example, a build section, a landing section and a lateral section. In such an example, a build section may be a portion of a directional wellbore curve that may extend from a kick-off point (KOP) to another point. As to a landing section, it may be a portion of a wellbore beyond a build section where steering may be controlled in an effort to hit a target. A landing section may be composed of segments such as, for example, an upper segment, which may be referred to as an approach section, and a lower segment, which may be referred to as a taper section. In the approach section, the magnitude of changes may tend to be greater than in the taper section as the taper section may aim to form a wellbore that smoothly transition at the end of the landing as the drillstring enters a target zone (e.g., a target formation). As to a lateral section, it may be a portion of a wellbore that extends substantially horizontally from an end of a landing taper, out to an end of the wellbore. A course change within a lateral section may affect a reservoir for better or for worse. As an example, a lateral section may be drilled using a BHA, which may include a mud motor, an RSS, etc. In various scenarios, inclination and/or azimuth of a lateral section may be maintained through a combination of sliding and rotating of a drillstring.

As an example, directional drilling may include geosteering as part of a landing job (e.g., drilling a landing section). In a landing job for a well, estimated well tops in the current well may lack accuracy. For example, estimated well tops may be rough estimates based on data from one or more offset wells as may be visually assessed by one or more individuals. As explained, a drillstring may include one or more logging tools to acquire measurements while drilling (e.g., MWD, LWD, etc.). Thus, when a current well is being drilled, real-time log measurements may be acquired. Where such measurements are available, an assessment may involve performing a comparison of a current well's log data and log data from one or more other wells (e.g., log data from one or more offset wells) to generate a more accurate estimate of one or more well tops. Such an assessment may be referred to as log correlation during geosteering. During directional drilling, accurate estimation of well tops may provide for decision making. For example, consider decision making as to whether drilling has arrived one or more points along a trajectory (e.g., planned trajectory points, safety points, etc.). In various instances, a point may be associated with an operation (e.g., a downhole operation, etc.) that is to be performed. During a landing job, a decision may relate to termination of a landing section or a transition from one landing segment to another.

As explained, directional drilling may involve performing log correlation visually, for example, using a number of logs rendered to a display. In such an example, one or more well placement engineers may interact with a graphical user interface that may provide for rendering logs to a display and manually adjusting positions of logs with respect to one another, picking well tops, etc.

As an example, a framework may include one or more components and/or operatively coupled to one or more components for implementing an integrated predictive geosteering workflow. In such an example, components may provide for executing a structural update, a resistivity forward prediction and an uncertainty prediction.

As an example, a framework may include one or more plug-in components. For example, consider one or more PETREL framework plug-in components. As to the PETREL framework, it may operate in conjunction with one or more plug-ins. For example, a plug-in may instruct an instance of PETREL as to performance of one or more of techniques (e.g., import, export, computation, etc.). As an example, a plug-in may provide for launching one or more components within a PETREL framework environment, for example, executing using local resources and/or executing using remote resources (e.g., consider one or more of a workstation, a networked HPC cluster, a cloud platform, etc.). As an example of a plug-in for the PETREL framework, consider the PETREL multi-physics plug-in, which provides tools to integrate electromagnetic (EM) and potential fields data with geological knowledge, seismic data, and well logs. Such a plug may include components for magnetotellurics (MT), controlled source EM (CSEM), gravity and magnetics (GM), etc.

As an example, a workflow may be implemented for execution in real-time using at least in part field data. In such an example, components may be coordinated to expedite execution, for example, by reducing number of calls and responses, logistic waiting times, etc. For example, consider a plug-in that may be a unified plug-in for implementation of sub-workflows in an integrated predictive geosteering workflow (IPG workflow). In such an example, the sub-workflows may include a structural update sub-workflow, a resistivity forward prediction sub-workflow and an uncertainty prediction sub-workflow. In such an example, an IPG workflow may be executed using a one-click approach, for example, after setting of inputs, which may be or may include common inputs. As an example, a framework may provide a set of advanced settings for advanced users to investigate more detailed aspects of each sub-workflow and, for example, a dependency management component that may re-run corresponding sub-workflows automatically according to input and/or one or more setting changes. As an example, a framework may include one or more visualization components. For example, consider a component that may provide for implementing a method that creates visualizations of results from a number of sub-workflows, which may provide for improved interpretations.

Figure 6:
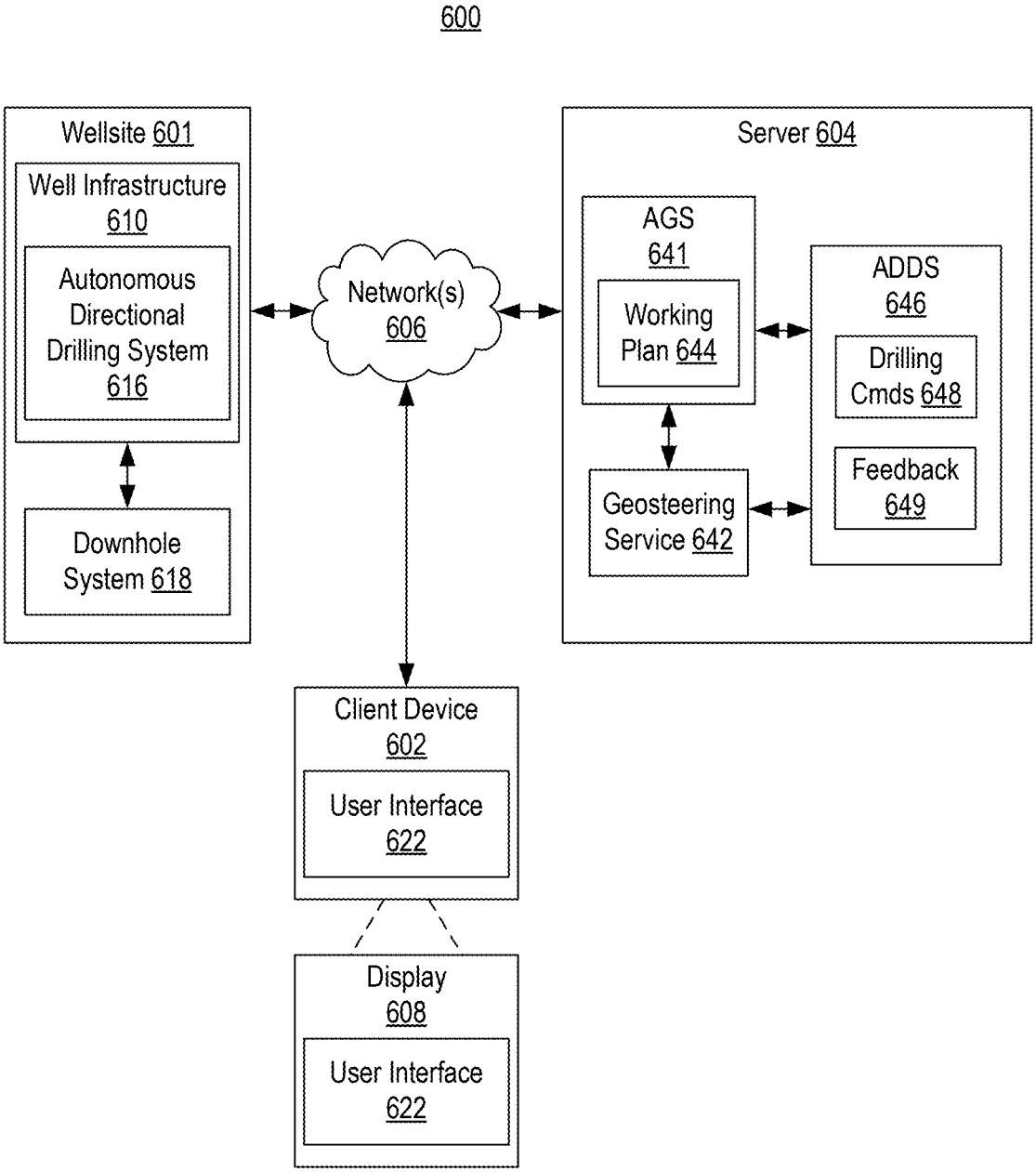
FIG. 6 illustrates an example of a system.

FIG. 6 illustrates an example environment 600 for autonomous geosteering and directional drilling. The environment 600 includes a client device 602 in communication with a server 604 through a network 606. The network 606 may include one or multiple networks and may use one or more communication platforms and/or technologies suitable for transmitting data. The network 606 may refer to any data link that enables transport of electronic data between devices of the environment 600. The network 606 may refer to a hardwired network, a wireless network, or a combination of a hardwired network and a wireless network. In one or more implementations, the network 606 includes one or more portions of the Internet. The network 606 may be configured to facilitate communication between the various computing devices via well-site information transfer standard markup language (WITSML) or similar protocol, or any other protocol or form of communication. The server 604 may include one or more computing devices (e.g., including processing units, data storage, etc.) organized in an architecture with various network interfaces for connecting to and providing data management and distribution across one or more client systems.

The client device 602 may be representative of one or multiple client devices and may refer to various types of computing devices. For example, the client device 602 may include a mobile device such as a mobile telephone, a smartphone, a personal digital assistant (PDA), a tablet, a laptop, or any other portable device. Additionally, or alternatively, the client device 602 may include one or more non-mobile devices such as a desktop computer, server device, surface or downhole processor or computer (e.g., associated with a sensor, system, or function of the downhole system), or other non-portable device. In one or more implementations, the client device 602 includes a user interfaces (UI) 622 thereon (e.g., a screen of a mobile device). In addition, or as an alternative, one or more of the client device 602 may be communicatively coupled (e.g., wired or wirelessly) to a display device 608 having the user interface 622 rendered thereon for providing a display of system content. The server 604 may similarly refer to various types of computing devices. Each of the devices of the environment 600 may include features and/or functionalities described herein.

In some implementations, the server 604 is a cloud server remote from the client device 602 accessed through the network 606. The server 604 includes an autonomous geosteering system (AGS) 641 that facilitates an automatic workflow for autonomous geosteering operations and autonomous directional drilling. In some implementations, the AGS 641 is hosted on one or more virtual machines instantiated in resources of a cloud platform. In some implementations, the AGS 641 may be implemented on an edge device (e.g., an edge computing device that may be local at a field site). The AGS 641 may be accessible via the network 606. For example, a uniform resource locator (URL) configured to an end point of the AGS 641 may provide operative coupling to the client device 602 such that users may access one or more features using a browser on the client device 602. Another example includes an application on the client device 602 that may provide access the AGS 641.

The AGS 641 may be connected to equipment at a wellsite 601, for example, via the network 606. The wellsite 601 can include equipment that may be suitable for deployment, at least in part, downhole (e.g., as part of a drillstring, etc.). The wellsite 601 may include a well infrastructure 610 that includes one or more interfaces to obtain information (e.g., status, data, etc.) of an autonomous directional drilling system (ADDS) 616, for example, as part of a downhole system that may perform one or more actions for drilling. As an example, measurements may be obtained in real-time or near real-time by the well infrastructure 610 as a downhole system performs the drilling.

The AGS 641 may be operatively coupled to the ADDS 616 as resident at least in part at the wellsite 601 and/or as resident at least in part in a server environment (e.g., a cloud platform, etc.), for example, per the ADDS 646 represented in the server 604. The ADDS 641 and/or 646 may provide for substantially fully autonomous geosteering operation. The AGS 641 may be operatively coupled to a geosteering service 642 that provides inversion information and updated geological models. For example, consider inversion of downhole sensor data to generate a geological model of a portion of a subsurface environment that may be along a borehole or a borehole trajectory (e.g., a planned portion of a borehole). In some implementations, the ADDS 616 and/or 646, the geosteering service 642, and the AGS 641 may be combined as a single system (e.g., hosted on a single computing device or cluster of devices). As an example, the AGS 641 may perform automatic boundary interpretation, automatic formation prediction, and real-time navigation and steering decisions based on the real-time geological context provided by the well infrastructure 610 and, for example, may integrate one or more cross domain workflows to generate a real-time working plan 644. In some implementations, the AGS 641 may include or otherwise implement an AI enabled, multi-domain workflow to achieve autonomous geosteering and directional drilling.

As an example, the AGS 641 may automatically send the working plan 644 to the ADDS 616 and/or 646. The working plan 644 can include instructions for drilling along a path (e.g., a trajectory). The ADDS 616 and/or 646 may automatically generate drilling commands 648 to drill according to the working plan 644. In some implementations, the ADDS 616 and/or 646 can encode the drilling commands 648 and transmit the drilling commands 648 to a downhole rotary steerable system (RSS) to execute directional drilling in response to the drilling commands 648 following the working plan 644. The ADDS 616 and/or 646 can provide feedback 649 to the AGS 641 during drilling operations. For example, the feedback 649 may provide information as to whether the working plan 644 can be executed (e.g., drilled along a predicted trajectory of the path). Another example may include the feedback 649 providing a current geological context of a well.

The AGS 641 may use the feedback 649 provided by the ADDS 616 and/or 646 to validate the working plan 644. In some implementations, the AGS 641 modifies or updates the working plan 644 in response to the feedback 649. In some implementations, the AGS 641 maintains the working plan 644 in response to the feedback 649.

In some implementations, the AGS 641 includes a geosteering application that is a cloud application resident on the server 604, which may be instantiated as one or more instances for one or more sites, optionally including a ghost or redundant instance (e.g., for security, back-up, etc.). In some implementations, such a geosteering application may be local to the client device 602 and provides access to the AGS 641.

The AGS 641 may provide automation functionalities to the geosteering service 642. In some implementations, the AGS 641 can include artificial intelligence (AI) based automatic boundary interpretation. The AGS 641 may provide for automatic identification of top and/or bottom boundaries of a formation using a pre-trained real-time AI model or models, for example, responsive to generation of an inversion result (e.g., a geological model honed using downhole data). As an example, a rendering of a structural model may include boundaries, which may be polylines in a 2D view that represent top and bottom intersection lines formed by formation layer surfaces and a trajectory curtain. As an example, in a 3D view, boundaries may be rendered as 3D surfaces formed by formation layer surfaces, as may be cut by a columnar area defined by one or more 2D inversion slides.

In some implementations, the AGS 641 can predict formation geometry ahead of an end of a borehole (e.g., a bottom of a hole) by extending one or more boundaries with a certain strategy at the drilling direction in response to the boundaries automatically being identified by the AGS 641. As an example, the AGS 641 can generate steering decisions for steering a drillstring to one or more targets using one or more predicted formation boundaries. As an example, a target may be specified using 3D coordinates and a 3D vector, defining position and direction for directional drilling to achieve, within one or more pre-set constraints. As an example, one or more coordinate systems may be utilized to specify a target, a location, a position, a direction, etc. For example, consider utilization of one or more of a Cartesian coordinate system and a cylindrical coordinate system. As to a cylindrical coordinate system, it may be defined with respect to another coordinate system such that a relevant cylinder may be defined in space, for example, with respect to orientation, depth, direction, etc. As an example, a system may utilize an advancing cylinder approach whereby a cylinder advances in space with respect to time responsive to drilling. As an example, a borehole may be defined by a series of cylinders where, for example, each cylinder may be stored in memory along with various properties, parameters, instructions, etc., which may relate to geosteering, borehole integrity, formation characteristics, etc. As an example, the AGS 641 may generate a recommended trajectory design and the working plan 644 to achieve steering decisions for preview and further approval, if desired.

The AGS 616 may be operatively coupled to the ADDS 616 and/or 646 and automatically transmit the working plan 644 to the ADDS 616 and/or 646. The ADDS 616 and/or 646 may automatically generate the drilling commands 648 using the working plan 644 to control drilling to one or more targets.

The environment 600 provides for operatively coupling the AGS 641 with the ADDS 616 and/or 646, for example, to enable substantially fully autonomous directional drilling with geosteering delivering a geosteering service with high accuracy, efficiency, and consistency of performance (see, e.g., the geosteering service 642).

In some implementations, one or more computing devices (e.g., servers and/or devices) are used to perform the processing of the environments 600. The one or more computing devices may include, but are not limited to, server devices, cloud virtual machines, personal computers, a mobile device, such as, a mobile telephone, a smartphone, a PDA, a tablet, or a laptop, and/or a non-mobile device. The features and functionalities discussed herein in connection with the various systems may be implemented on one computing device or across multiple computing devices. For example, the AGS 641, the geosteering service 642, and the ADDS 616 and/or 646 may be implemented on a single computing device or may be implemented across one or more devices of a cloud computing environment to leverage processing capabilities, memory capabilities, connectivity, speed, etc., that such cloud computing environments offer to facilitate one or more features and/or functionalities described herein.

In some implementations, components of the environment 600 include hardware, software, or both. For example, the components of the environment 600 may include one or more instructions stored on a computer-readable storage medium and executable by processors of one or more computing devices. When executed by the one or more processors, the computer-executable instructions of one or more computing devices can perform one or more methods described herein. In some implementations, the components of the environment 600 include hardware, such as a special purpose processing device to perform a certain function or group of functions. In some implementations, the components of the environment 600 include a combination of computer-executable instructions and hardware.

Figure 7:
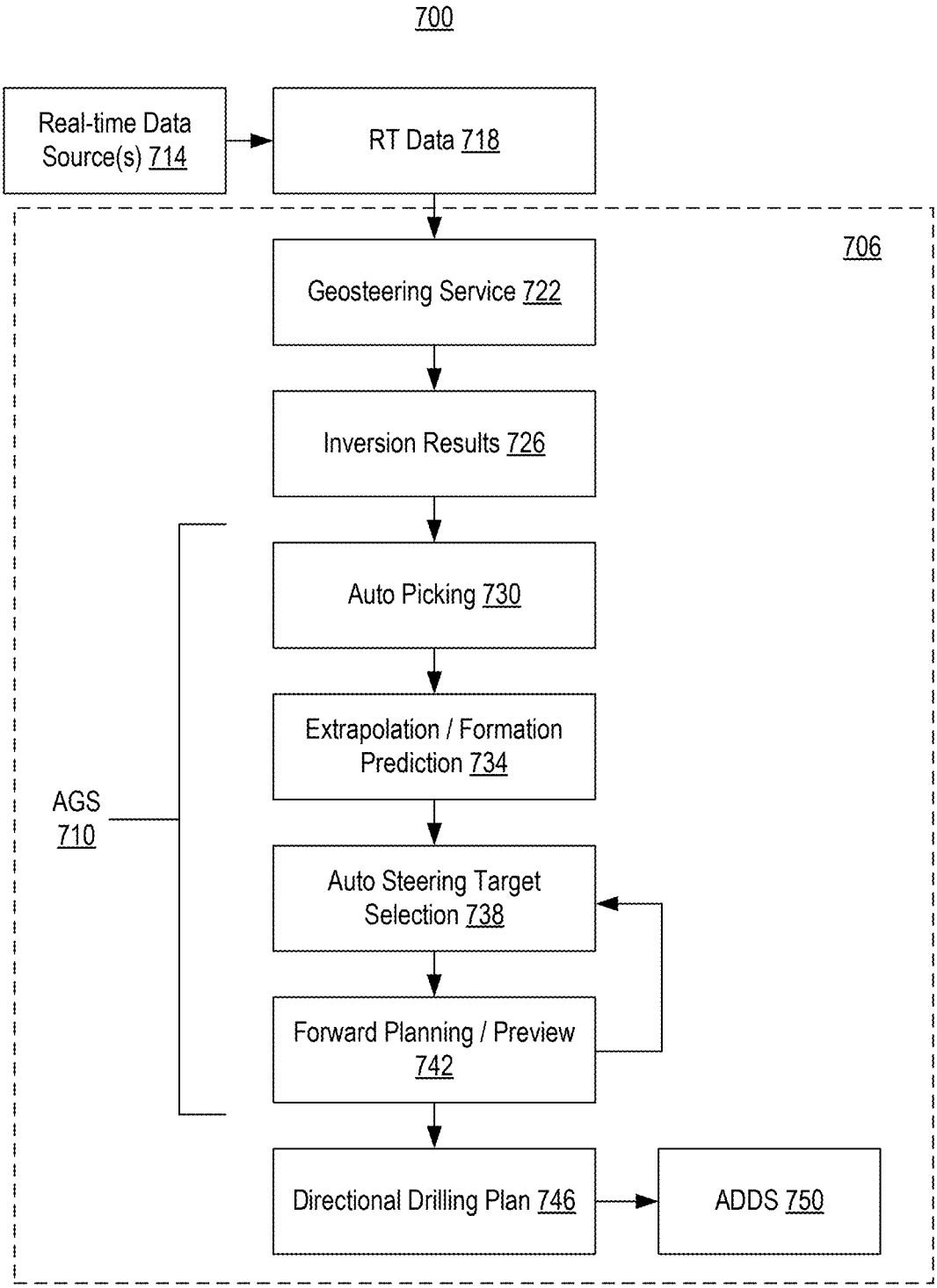
FIG. 7 illustrates an example of a method.

FIG. 7 illustrates an example method 700 for autonomous geosteering. The method 700 includes one or more real-time data sources 714 that provide real-time (RT) data 718. As shown, the RT data 718 may be received by a computing system 706, which may be a server, cores, multiple servers, etc. In such an example, a suitable transmission channel and protocol may be utilized for transmission of the RT data 718. As shown, a geosteering service 722 may be implemented using the computing system 706, which may provide for generation of inversion results 726 based at least in part on at least a portion of the RT data 718.

In the example of FIG. 7, the method 700 may provide for implementation of one or more features of an AGS 710, which, as explained, may provide for one or more of auto picking of one or more boundaries 730, extrapolation of one or more boundaries and/or formation prediction 734, auto steering target selection 738, and forward planning and/or preview 742, which may form a loop with the auto steering target selection 738 (e.g., an iterative loop, etc.).

As shown, the AGS 710 may generate a directional drilling plan 746, which may be an output of the AGS 710. As shown, the directional drilling plan 746 may be received by an automated directional drilling system (ADDS) 750, which can, for example, operate according to one or more instructions specified in the directional drilling plan 746, which may be a digital file and/or a digital stream or streams.

Figure 8:
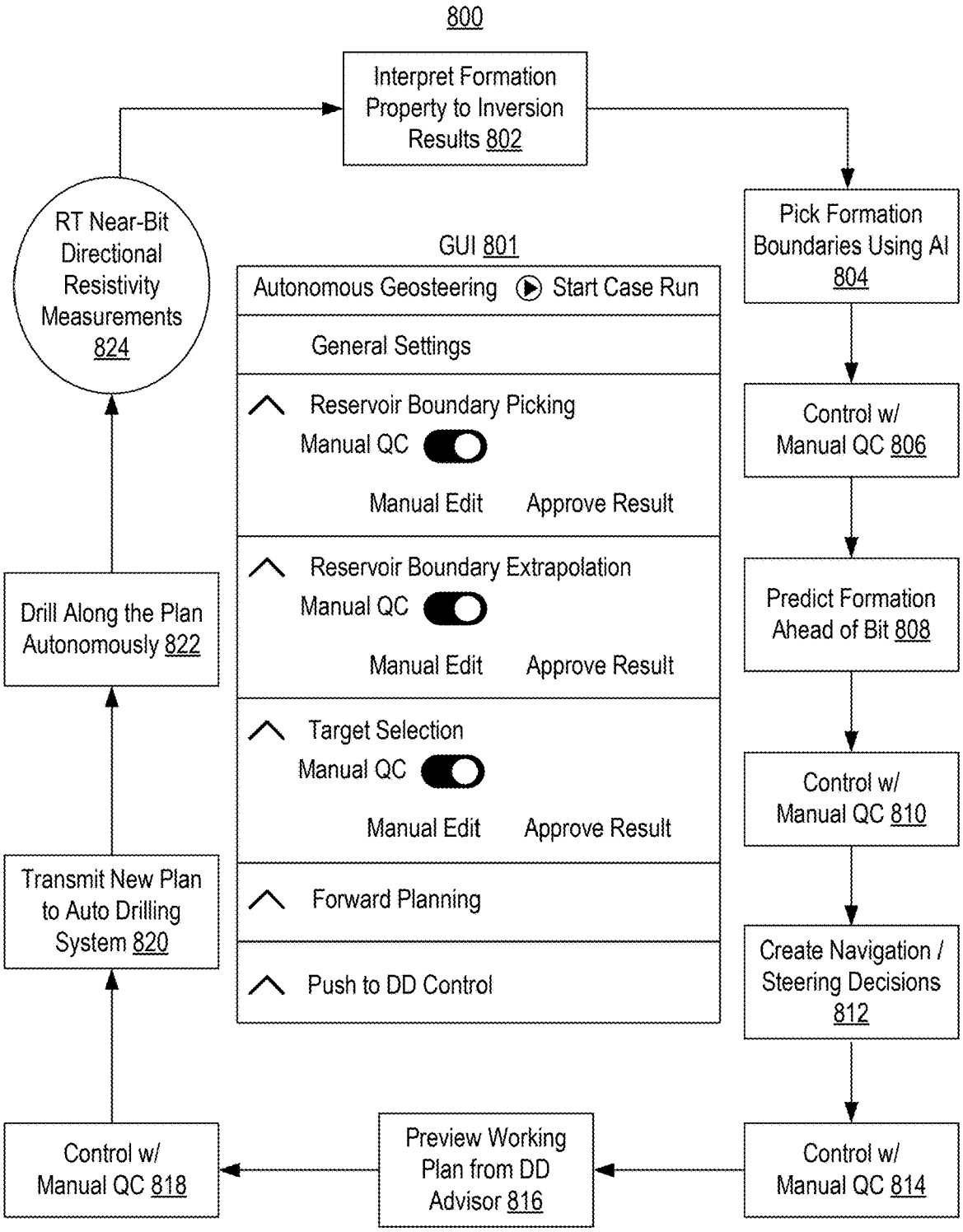
FIG. 8 illustrates an example of a method.

FIG. 8 illustrates an example workflow 800 for autonomous geosteering and directional drilling. In some implementation, the workflow 800 may be performed by a combination of the AGS 641, 710, etc., the geosteering service 642, 722, etc., and the ADDS 616, 646, 750, etc. As shown, the workflow 800 may include rendering a GUI 801 that can include various graphical controls, fields, etc. For example, consider controls for reservoir boundary picking, reservoir boundary extrapolation, target selection, forward planning, pushing to a directional drilling controller (e.g., DD control). As shown, the GUI 801 can include controls for selection of manual quality control, manual editing, approving a result, etc. As shown, the GUI 801 may include various portions that may be ordered in a logical manner to facilitate workflow execution, monitoring, etc.

As shown, the workflow 800 can include an interpretation block 802 for interpretation of one or more formation properties to inversion results, a pick block 804 for picking one or more formation boundaries using one or more artificial intelligence technologies or techniques, a control block 806 for optionally implementing manual quality control (QC), a prediction block 808 for predicting formation ahead of a bit (or bottom of hole), a control block 810 for optionally implementing manual quality control (QC), a creation block 812 for creating one or more navigation and/or steering decisions, a control block 814 for optionally implementing manual quality control (QC), a preview block 816 for previewing a working plan from a directional drilling controller (e.g., DD control), a control block 818 for optionally implementing manual quality control (QC), a transmission block 820 for transmitting a new plan to an automated drilling system, a drill block 822 for drilling along a plan autonomously, and a real-time (RT), near-bit directional resistivity measurements block 824 for acquiring RT, near-bit directional resistivity measurements using downhole equipment. While resistivity is mentioned, one or more additional or alternative measurements may be acquired, which may be utilized, for example, in performing one or more inversion to generate results for continuing the workflow 800 and lengthening a borehole in a subsurface environment.

As explained, formation property to inversion results may be provided in real-time or near real-time in response to the real-time near-bit deep direction resistivity measurements provided by a directional drilling system. Such a directional drilling system may provide an AGS with a current geological context of the well, for example, from measurements obtained by a drilling tool assembly, allowing the AGS to interpret formation property to inversion results of a current geological context of the borehole. For example, a directional drilling system can provide feedback with measurements obtained by a drilling tool assembly.

As to the block 804, the workflow 800 can include picking formation boundaries using AI. In some implementations, an AGS automatically identifies top and bottom boundaries of a formation using pre-trained AI models based at least in part on an inversion result.

As to the block 806, the workflow 800 optionally includes a manual quality control option. For example, the GUI 801 as may be rendered to a display of a client device can present an icon that a user may select to review or verify the formation boundaries automatically identified by an AGS. In response to receiving a selection of the icon, the GUI 801 may present formation boundaries for further user review, editing, etc. In some implementations, a user may make modifications or changes to one or more formation boundaries. In some implementations, a user may accept formation boundaries without making changes to the formation boundaries.

As to the block 808, the workflow 800 can include using an AGS for predicting formation(s) ahead of a bit (e.g., a bottom of a hole). In some implementations, an AGS may use one or more algorithms to automatically predict formation(s) ahead of a bit in a direction of drilling. For example, an algorithm may use boundaries automatically identified by an AGS to predict spatially, property-wise, boundary-wise, etc., one or more formations in front of a bit (e.g., beyond an end of a borehole). In some implementations, an AGS may use one or more algorithms to predict formation geometry in front by extending one or more boundaries forward in a drilling direction in response to boundaries automatically identified by the AGS.

As to the block 810, the workflow 800 optionally includes a manual quality control option. As explained, the GUI 801 may include one or more icons that a user may select to review or verify information, which may include predicted formation(s) ahead of a bit automatically identified by an AGS. In response to receiving a selection of the icon, the GUI 801 may present predicted formation(s) for further user review. As an example, the GUI 801 may include a control for rendering a 3D geological context for a user to review. In some implementations, a user may make modifications or changes to one or more predicted formations. In some implementations, a user may accept predicted formations without making changes to the predicted formations.

As to the block 812, the workflow 800 includes creating navigation and/or steering decisions. For example, an AGS may automatically identify one or more targets based on real-time drilling status and interpretation of formations using one or more algorithms. In some implementations, one or more targets may be identified within an offset from a defined top boundary. In some implementations, an AGS may create a drilling target as part of steering decisions using one or more predicted formation boundaries. As explained, a target may be specified using 3D coordinates and a 3D vector, defining position and direction for directional drilling to achieve, for example, within one or more pre-set constraints. As an example, an AGS may generate a recommended trajectory design and working plan to achieve steering decisions. An AGS may take target constraints as an input to generate trajectory plans for a working plan using one or more improved automatic trajectory design engines.

As to the block 814, as explained, the workflow 800 optionally includes one or more manual quality control options. As an example, the GUI 801 may include an icon that a user may select to review or verify a working plan. In response to receiving a selection of the icon, the GUI 801 may present the working plan for further user review. For example, the GUI 801 may present visual trajectories of the working plan for the user to evaluate. In some implementations, a user may make modifications or changes to a working plan. In some implementations, a user may accept a working plan without making changes to the working plan.

As to the block 816, the workflow 800 includes previewing the working plan. In some implementations, an AGS has a plurality of working plans automatically generated and AGS may automatically evaluate and rank trajectories of the working plans based on one or more factors. Example factors may include comprehensive drilling cost functions, drilling constraints, and geological context. An AGS may automatically select a working plan in response to ranking (e.g., a top ranked working plan) to send to an ADDS.

As to the block 818, the workflow 800 optionally includes a manual quality control option. For example, the user interface 822 may present visual trajectories of the working plan for the user to evaluate. In some implementations, the user makes modifications or changes to the working plan. In some implementations, the user accepts the working plan 14 without making changes to the working plan.

As to the block 820, the workflow 800 can include transmitting a new plan (e.g., a new working plan) to an automated drilling system. As to the block 822, the workflow 800 can include instructing an automated drilling system to drilling according the new plan autonomously (e.g., at one or more levels of autonomy. As an example, an AGS may automatically send drilling commands to a downhole system to drill along a trajectory provided in a working plan. For example, an AGS may schedule drilling commands for a working plan based on one or more factors, such as, for example, BHA design and/or formation characteristics. As an example, a system may convert scheduled drilling commands to a form that can be consumed by an ADDS and transfer results within a digital platform to a downhole system. In such an example, the downhole system may perform drilling in response to the drilling commands.

As to the block 824, the workflow 800 can include providing real-time near bit deep directional resistivity measurements to an AGS. In such an example, the real-time near bit deep directional resistivity measurements may provide accurate information of a current context of a drill bit in a borehole. As an example, an AGS may use a current context of a drill bit to automatically determine whether modifications or changes are necessary for a working plan. As an example, an AGS may use the current context of a drill bit to revise or update, if needed, a working plan, for example, to help ensure an optimal path is drilled in a subsurface formation.

As an example, the workflow 800 can operatively couple an AGS and an ADDS to provide a fully automatic real-time well placement service and autonomous directional drilling system improving efficiency, accuracy, and performance consistency of an AGS. The workflow 800 may allow an AGS to perform real-time re-planning of a working plan based on the latest formation information achieved by the geosteering real-time interpretation. An AGS may receive real-time near-bit deep directional resistivity measurements (e.g., feedback) from an ADDS and perform real-time steering decision making and working plan generation based on the latest formation changes updated by the geosteering real-time interpretation.

Figure 9:
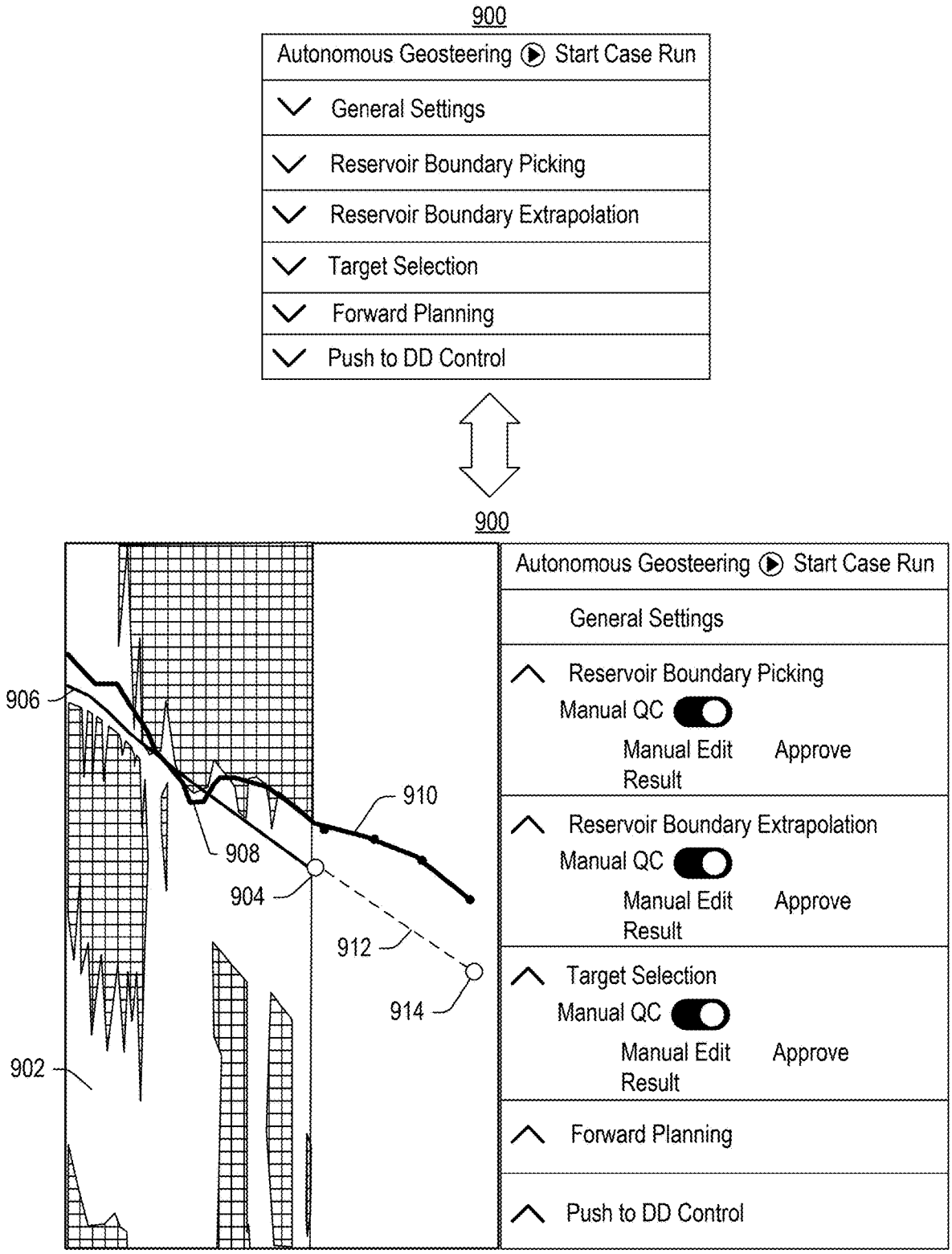
FIG. 9 illustrates an example of a graphical user interface.

FIG. 9 illustrates an example graphical user interface (GUI) 900 in a compressed view and in an expanded view for an autonomous geosteering guided workflow; noting that the GUI 900 may include one or more features of the GUI 801 of FIG. 8. As an example, the GUI 900 may be rendered to a display or displays to function as a user interface. In some implementations, the autonomous geosteering guided workflow may be akin to the method 700 of FIG. 7. In some implementations, the autonomous geosteering guided workflow is may be akin to the workflow 800 of FIG. 8. A user may select different portions of an autonomous geosteering guided GUI (e.g., the general settings, reservoir boundary picking, reservoir boundary extrapolation, target selection, forward planning, and push to directional drilling advisor) and additional features may be displayed. For example, the GUI 900 at the top of the page may be expanded to render additional features as illustrated at the bottom of the page. As indicated by a double-headed arrow, the GUI 900 may be expanded and contracted as appropriate.

As to various expandable features, the GUI 900 may include features for an autonomous geosteering guided workflow and an image. In some implementations, an image may be presented in response to a user selecting one or more features for an autonomous geosteering guided workflow presented in the GUI 900. In some implementations, the image is generated automatically at different portions of the autonomous geosteering workflow (e.g., the method 700 or the workflow 800 by an AGS).

In the example of FIG. 9, the image may illustrate received input data (e.g., the real-time measurements from a directional drilling system) converted into a resistivity map 902 of formations. In some implementations, the resistivity map 902 may an integrated view of an inversion. As shown, a marker 904 may indicate a current position of a drill bit in a borehole. As shown, a line 906 may indicate an original trajectory or path that the drill bit is following.

In some implementations, an AGS may predict one or more formation boundaries, characteristics, etc. ahead of a drill bit and automatically make navigation and/or steering decisions for a working plan in real-time in response to the predicted formations ahead of the drill bit. As an example, measurements received as input (e.g., the real-time measurements) may provide information from behind a drill bit (e.g., a distance uphole from a bit). An AGS may use such information provided as input to automatically predict formations in front of the drill bit, which may be in a direction of drilling.

In the example of FIG. 9, the image may illustrate boundaries (see, e.g., a top boundary with curve 908) automatically identified by an AGS. In some implementations, an AGS may automatically identify a top boundary to keep the drilling bit within while steering the drill bit. For example, the marker 804 (the drilling bit) remains below the boundary (see, e.g., curve 908). In some implementations, an AGS may automatically identify a lower boundary to keep the drilling bit within while steering the drill bit. In some implementations, an AGS may automatically identify a top boundary and a lower boundary to keep the drilling bit in a layer defined by these boundaries while steering the drill bit.

As an example, an image may be used to represent one or more predicted formations ahead of a drill bit. For example, one or more boundaries may be extended (see, e.g., the curve 908) in front of the drill bit (see, e.g., the marker 904). In some implementations, an AGS may implement one or more algorithms to automatically extend one or more boundaries ahead of a position of a drill bit and use an extended boundary (see, e.g., a curve 910) to predict where formations may be located in front of the drill bit.

In the example of FIG. 9, the image illustrates a target 914 below the extended boundary (see, e.g., the curve 910). In some implementations, an AGS may use one or more algorithms to automatically select the target 914 within the constraints of one or more extended boundaries. In the example of FIG. 9, the image illustrates a new path 912 for the drill bit to follow to the target 914. An AGS may automatically generate a working plan with the new path 912 to the target 914. The new path 912 may define a relatively smooth path to drill to the target 914. The working plan may provide instructions to send to a drill bit (e.g., directions, how many degrees to turn) for forming the new path 912.

The image may be a graphical representation of a working plan with a new path to a target, as may be received by a system for execution (drilling). In some implementations, an image may illustrate a progression of drilling along a new path to a target by a directional drilling system. As a drill bit drills along a new path, measurements may be obtained by a directional drilling system and provided to an AGS. In such an example, the AGS may modify a working plan in response to the new measurements or may maintain a working plan in response to the new measurements. In some implementations, an extended boundary may intersect an original path that a drill bit is following or a new path that the drill bit is following. An AGS may automatically modify an original path or a new path in response to an extended boundary intersecting the original path or the new path to prevent the drill bit from detrimentally moving towards a formation that is predicted in front of the drill bit (e.g., to maintain the drill bit and hence a borehole within a reservoir layer to increase reservoir contact of the borehole).

Figure 10:
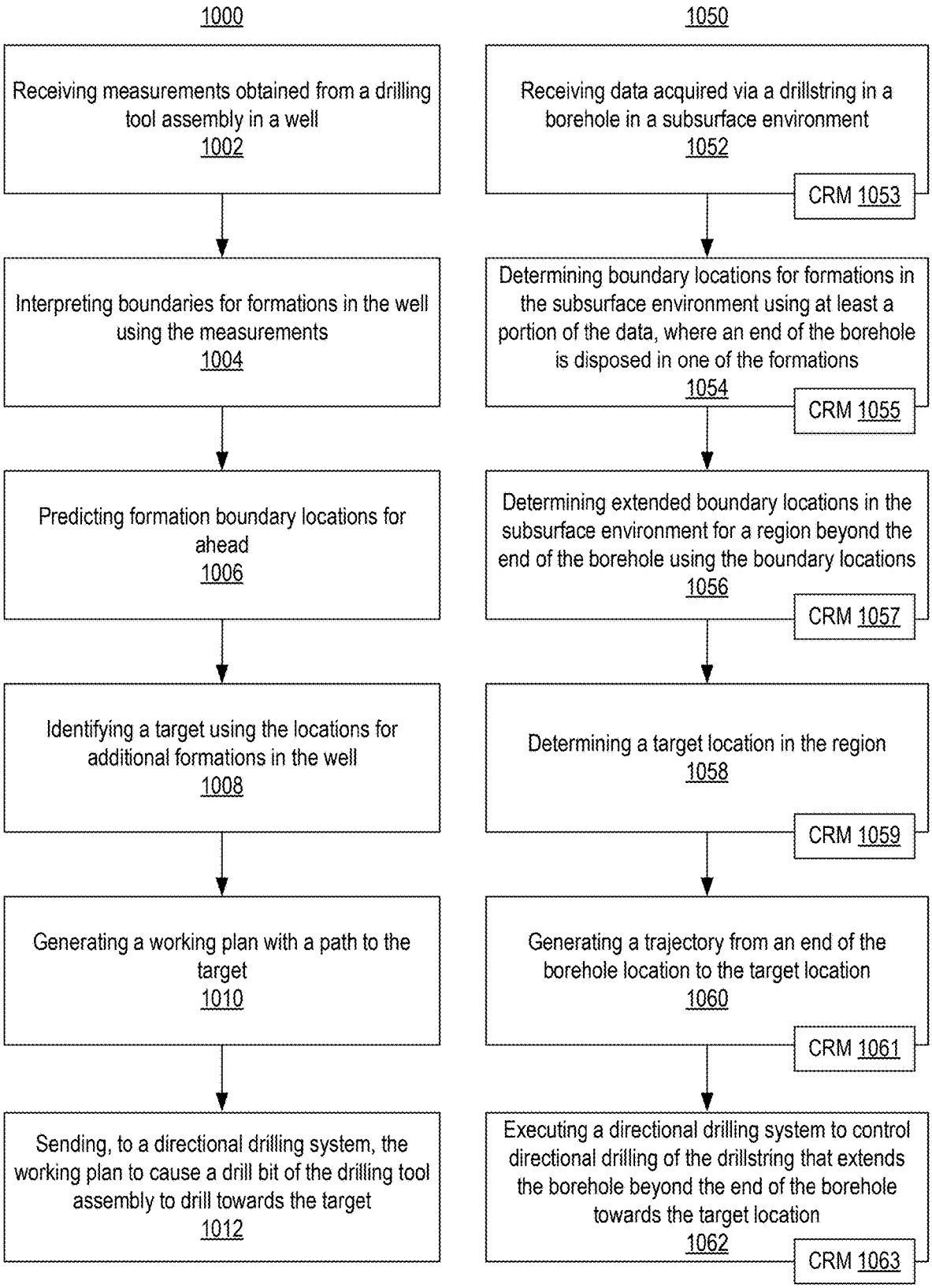
FIG. 10 illustrates examples of methods.

FIG. 10 illustrates example methods 1000 and 1050 for autonomous geosteering and directional drilling. At a block 1002, the method 1000 includes receiving measurements obtained from a drilling tool assembly in a well. For example, an AGS may receive measurements obtained from a drilling tool assembly in a well.

At a block 1004, the method 1000 includes interpreting boundaries for formations in the well using the measurements. In some implementations, an AGS may automatically interpret boundaries for formations in the well using the measurements.

At a block 1006, the method 1000 includes predicting formation boundary locations ahead in the well using the boundaries. In some implementations, an AGS may automatically predicts formation boundary locations ahead in the well using the boundaries.

At a block 1008, the method 1000 includes automatically identifying a target using the locations for additional formations in the well. In some implementations, an AGS may automatically predict formation boundary locations ahead in the well.

At a block 1010, the method 1000 includes generating a working plan with a path to the target. In some implementations, an AGS may automatically generate a working plan with a path to the target.

At a block 1012, the method 1000 includes sending, to a directional drilling system, the working plan to cause a drill bit of the drilling tool assembly to drill towards the target. In some implementations, an AGS may automatically send to a directional drilling system a working plan to cause a drill bit of the drilling tool assembly to drill towards a target.

As shown, the method 1050 includes a block 1052 for receiving data acquired via a drillstring in a borehole in a subsurface environment; a block 1054 for determining boundary locations for formations in the subsurface environment using at least a portion of the data, where an end of the borehole is disposed in one of the formations; a block 1056 for determining extended boundary locations in the subsurface environment for a region beyond the end of the borehole using the boundary locations; a block 1058 for determining a target location in the region; a block 1060 for generating a trajectory from an end of the borehole location to the target location; and a block 1062 for executing a directional drilling system to control directional drilling of the drillstring that extends the borehole beyond the end of the borehole towards the target location. As shown, computer-readable media (CRM) blocks may be provided, which may include CRM blocks 1053, 1055, 1057, 1059, 1061, and 1063.

The method 1000 and/or the method 1050 may achieve directional drilling with geosteering autonomously delivering a geosteering service with high accuracy, efficiency, and consistency of performance.

As explained with respect to the logs 500 of FIG. 5, electromagnetic techniques may be utilized to acquire resistivity measurements, which may be at different depths. For example, consider the resistivity logs of FIG. 5, which include shallow, medium, and deep logs with ohm-meter units (e.g., acquired in units of ohm·m$^2$/m). The reciprocal of resistivity is conductivity, which may be expressed in terms of millimhos or mmhos. The ability to conduct electrical current tends to be a function of conductivity of water contained in pore spaces of rock. Fresh water tends to be a poor conductor; whereas most formation waters are conductive due to the presence of salt ions. Thus, unless water is fresh, water-saturated rocks tend to have relatively high conductivity and low resistivity. Hydrocarbons, which tend to be nonconductive, cause resistivity values to increase as pore spaces within a rock become more saturated with oil or gas. Such phenomena are illustrated within the resistivity logs of FIG. 5.

As an example, a drillstring may include a tool set that provides for increased automation of drilling, for example, to impart a higher level of autonomy. As explained, a tool may provide for shallow, medium, and deep EM measurements with a measurement point located near a control unit bias sub just above a drill bit. As explained, an RSS may be utilized on a drillstring that provides functionality to drill and steer, for example, in a manner that can maintain continuous drilling.

As an example, an RSS may include a bias unit, an extension sub and a control unit. The bias unit may include an internal rotary valve controlling hydraulic actuation of externally mounted pads for mechanical bit deflection. The control unit may include a geostationary electronics package mounted within an RSS collar (e.g., circuitry for toolface control, steering percentage, etc.). An RSS may utilize a stabilizer that acts as a point of borehole wall contact for directional control. As an example, a flex joint may be used to increase dogleg capability.

As an example, a control unit (e.g., mounted inside a control collar) may derive power from flow of drilling fluid across an impeller. As an example, a control shaft may be coupled to a downhole end of a control unit, which may run down into a bias unit. As explained, fluid may be directed to activate one or more pads for pushing against a borehole wall where action of the one or more pads can forces a bit in a desired direction. Communication with an RSS, for example, to change steering direction and strength may be achieved by executing combinations of flow rate changes at surface (e.g., using surface equipment).

As an example, an RSS may include a bit shaft connected to an electric motor slightly off-center from a tool axis in a steering section. Such an approach results in an offset at a bit box and, thus, at a drill bit itself. To hold a given toolface setting (TF), the electric motor can be rotated at exactly the same speed as the collar but in the opposite direction. In such an approach, the net result is that the bit shaft offset remains stationary relative to the borehole. As an example, drillstring RPM, torque, and weight can be transmitted through the collar and into the bit shaft just above the bit box by a universal joint arrangement. Generally, an RSS' internal components are protected from forces generated by drilling.

As an example, a workflow can include transmitting a set of EM responses uphole via telemetry for a real-time inversion of an RSS tool's location within a layered formation at depth. In such an example, the layered formation may be represented via a model, for example, as a virtual layered formation structure. In such an example, a region in the virtual layered formation structure, around the measure point, may be assessed by a drilling assistant or artificial intelligence (AI) framework and a reviewed decision can be sent by telemetry down to the bias unit near the measure point to change or maintain a current trajectory. As an example, formation parameters assessed by an AI framework may be one or more of mechanical, electrical, or geological in nature; noting that all may be feed into the AI framework for decision-making. For example, if a formation is soft or hard will govern how hard a bias unit must push on a rotating drill bit to build a desired angle (e.g., as may be specified by a desired percentage per hundred feet). As an example, various drilling parameters may be utilized by a driller and an AI framework to assess and decide how to drill during drilling.

As an example, an AI framework may include or provide one or more machine learning models suitable for use at surface and/or downhole. As an example, consider a lightweight model suitable for implementation in a downhole tool. In such an example, the downhole tool may include circuitry (e.g., one or more processors, etc.) capable of performing a downhole inversion using resistivity measurements and, for example, one or more other types of measurements. In such an example, a model may be trained prior to deployment in a downhole environment. For example, consider loading a model into memory of a downhole tool prior to running the downhole tool into a borehole as part of a drillstring. As an example, a model may be a time series model, a 1D model, a 2D model, a 3D model, or a 4D model (e.g., three spatial dimensions and time as a temporal dimension or measured depth as a fourth dimension). As an example, a model may be image-based, for example, capable of generating and processing 2D arrays such as a pixel array. As an example, a system may provide for geosteering guided using a downhole closed loop control technique.

As to boundaries (e.g., interfaces) of layers in a subsurface environment, as an example, an AI framework may operate to automatically correlation and output an upper boundary and a lower boundary of a layer, which may be a pay zone. In such an example, the boundaries may be utilized as constraints by a control scheme to maintain a trajectory in a position relative to the boundaries. As explained, one or more types of inversions may be performed using one or more types of data (e.g., measurements, etc.) for purposes of structural understanding in a region being drilled. As an example, an inversion process may provide for generation of a representation of a portion of a subsurface environment, which may be a multi-dimensional representation. As an example, resistivity data and seismic data may be utilized for purposes of inversion, prediction, etc., which may include generation of a representation of a portion of a subsurface environment beyond an end of a borehole being drilled.

Figure 11:
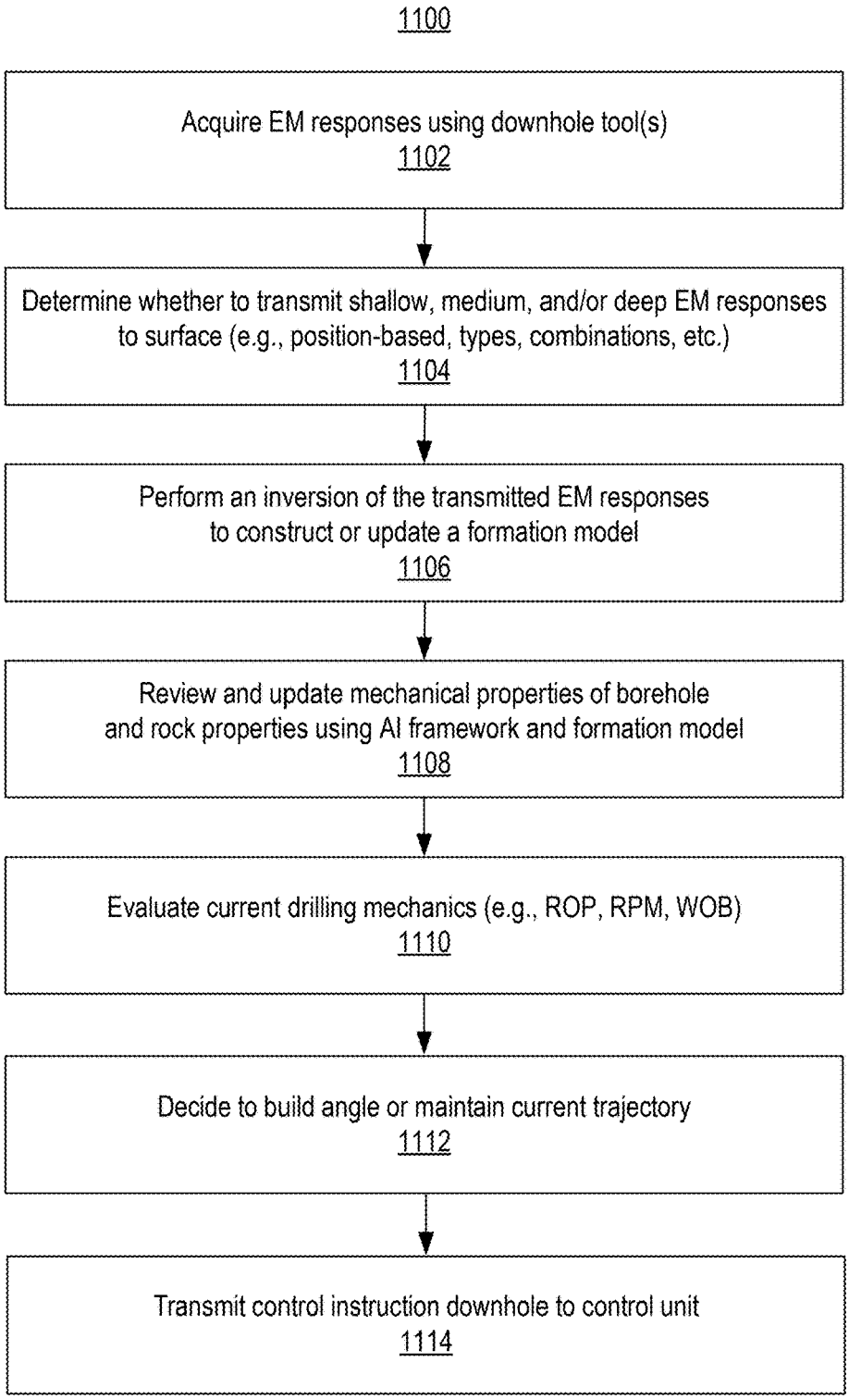
FIG. 11 illustrates an example of a method.

FIG. 11 shows an example of a method 1100 that includes an acquisition block 1102 for acquiring EM responses using one or more downhole tools, a determination block 1104 for determining whether to transmit shallow, medium, and/or deep EM responses to surface (e.g., to surface equipment) for inversion (e.g., consider determining based on position, type, combination, etc.), a performance block 1106 for performing an inversion of the transmitted EM responses to construct or update a formation model, a review and update block 1108 for reviewing and updating mechanical properties of a borehole and rock properties using an AI framework and the formation model, an evaluation block 1110 for evaluating current drilling mechanics (e.g., using one or more of ROP, RPM, and WOB), a decision block 1112 for deciding whether to build angle or maintain a current trajectory, and a transmission block 1114 for transmitting control instruction(s) downhole to the control unit of an RSS. In such an example, the method 1100 may be performed responsive to an event, a trigger, a stand connection, a distance interval, a time interval, ROP-based metric, etc.

As an example, a workflow may include acquiring EM responses and implementing one or more algorithms downhole using downhole tool circuitry to decide which of shallow, medium and deep measurements are to be transmitted to surface for purposes of performing an inversion to construct or update a formation model. In such an example, the workflow may include perform an inversion of the EM responses to construct or update the formation model. As an example, given an updated formation model, along with one or more other types of information, an AI framework, with or without a human-in-the-loop (HITL), may provide for reviewing and/or updating mechanical properties of the borehole and rock properties. As an example, an AI framework, with or without an HITL, may provide for evaluating current drilling mechanics, such as, for example, one or more of ROP, RPM, and WOB. As an example, an AI framework, with or without an HITL, may provide for deciding to build angle or maintain a current trajectory. As explained, an AI framework, with or without an HITL, may operate using surface equipment to generate a result that can then be transmitted downhole for purposes of control. For example, consider transmitting one or more control instructions downhole to a control unit of an RSS using a mud-based telemetry technology (e.g., or wire, if available). As explained, a workflow may be automated with or without an HITL or multiple individuals such as individuals of a team. As an example, a workflow may be performed iteratively, for example, on a particular basis, which may be at regular intervals based on ROP, etc.

As to various angles for geosteering control, consider one or more of a build angle, a hold angle, and a drop angle. As an example, a hold angle may be implemented to maintain a borehole to be drilled along a current trajectory, while a build or a drop angle may cause a borehole to be drilled along a different trajectory. As explained, an RSS may provide for directional drilling while a drillstring continuously rotates, which may provide for adequate well cleaning through rotation, a smoother wellbore, and more accurate directional control. As explained, an RSS may be controlled via transmission of commands from surface (e.g., using pressure fluctuations in a mud column) and/or via localized, downhole equipment-based control. As explained, an RSS may include pads that may push against an internal sleeve that pivots and points a drill bit in a desired direction. As an example, a dogleg severity may be rated in terms of degrees per 100 feet or per 30 meters (e.g., consider 18 degrees per 30 m). As explained, a trajectory may be planned and adjusted as appropriate, for example, with an aim to increases wellbore exposure to a reservoir (e.g., a pay zone). As an example, a downhole system may use a system-matched mud motor in combination with an RSS tool below it. Such a BHA configuration may help to enable higher revolutions per minute at a drill bit along with enhanced steering control and increased rate of penetration (ROP).

As an example, a workflow can be tailored for a job, which may be a drilling job that involves geosteering a drillstring to break rock in a formation using a drill bit. In such an example, a pre-job phase may include generating a model of a subsurface environment (e.g., an earth model), generating a resistivity model (e.g., based on structural features and properties of a subsurface environment), performing one or more drilling simulations (e.g., using an IDEAS framework, etc.), determining one or more equipment specifications (e.g., RSS, sensors, telemetry, etc.), determining a level or levels of automation for the job, and building and/or tuning one or more machine learning models for the job. As to the one or more machine learning models, consider utilizing an earth model, a resistivity model, drilling simulation results, data from one or more other drilling jobs, etc. As explained, a machine learning model, which may be part of an AI framework, may be utilized for one or more purposes (see, e.g., the method 1100 of FIG. 11). For example, consider an AI framework that may provide for generation of a relatively lightweight machine learning model that may be implemented downhole using downhole circuitry. In such an example, the model may provide for choosing optimal measurement channels and/or data therefrom to transmit uphole, which may aim to reduce bandwidth and/or payload demands for mud-pulse telemetry. In such an example, the model may provide for transmitting data relevant to an inversion technique that may involve inverting downhole measurements to generate a model of a relevant formation or formations around and/or ahead of a borehole being drilled (e.g., per a drilling job). As an example, by strategically determining what data to transmit, decision-making and control may be expedited such that geosteering control becomes more continuous and, for example, more autonomous.

As an example, a workflow may involve commencing drilling job (e.g., consider drilling of a new section of a borehole at a smaller diameter, etc.). In such an example, the workflow may include loading appropriate instructions, data, parameters, etc., into memory of a downhole tool that may be at surface and ready to run-in-hole (RIH) to perform drilling. In such an example, consider loading a relatively lightweight machine learning model into memory where the downhole tool includes circuitry that can execute the model for one or more purposes (e.g., determining what data to transmit to surface, etc.). While such a model may be loaded into memory while a downhole tool is at surface, an alternative may be to load while the downhole tool is downhole, for example, using downhole telemetry (e.g., from surface equipment to the downhole tool). As an example, a model may be tailored using one or more parameters where, for example, a parameter value may be transmitted from surface to downhole, as desired, prior to or during a job to thereby tailor the model.

In commencing a drilling job, once a drillstring has been RIH to an appropriate measured depth, rotation may be initiated for a drill bit of the drillstring and the drill bit advanced such that it contacts rock and starts to crush the rock. As explained, during drilling, some level of downhole automation is possible. For example, consider automation as to transmission of measurements to surface. As an example, a downhole application, which may be a model-based application, may detect if a formation is non-1D and, responsive to such a detection, may automatically decide to select a particular set of measurement channels to transmit to surface equipment (e.g., for inversion and subsurface environment modeling). In such an example, a 1D formation may be a formation that, per measurements and/or model, does not exhibit indicators of a formation layer boundary being within a certain distance of the borehole or otherwise changing in a direction that may be a reason to steering a drill bit in a different direction. As an example, where measurements may indicate transitioning from 1D to non-1D or a risk thereof (e.g., according to one or more thresholds, metrics, etc.), downhole circuitry may determine that measurements to be transmitted to surface may be more comprehensive such that the non-1D nature of a relevant portion of the subsurface environment (e.g., along or ahead of the borehole) may be more accurately discerned (e.g., via inversion, etc.). As an example, one or more techniques may provide for adjusting types of measurements, amount of measurements, etc., to transmit to surface where such adjusting may adjust automatically responsive to downhole conditions and/or to one or more instructions as may be transmitted from surface.

As an example, a downhole model may provide for generation of one or more instructions for informing a surface process. For example, consider a trigger that may be transmitted to trigger an AI framework at surface that may be involved in an inversion or other assessment process. As explained, an AI framework may provide for making decisions as to build angle, maintaining current trajectory, etc. In such an approach, one or more drilling commands (e.g., control instructions) may be generated at surface for transmission downhole to instruction downhole equipment to drill in a certain manner (e.g., change angle, change toolface, etc.).

As an example, a workflow may include performing one or more actions during tripping, whether RIH or POOH. For example, consider acquiring measurements during tripping where such measurements may provide for training, retraining, etc., one or more machine learning models. In such an example, measurements may pertain to position, curvature, direction, friction, borehole integrity, speed, swab, surge, etc. As an example, certain tripping measurements may be stored in memory of a downhole tool where, for example, once at surface, the memory may be interrogated (e.g., content dumped) for one or more purposes. As an example, during a RIH, measurements may be utilized to tailor a downhole machine learning model, for example, to calibrate the model as to one or more characteristics of the borehole, the drillstring, interactions between borehole and drillstring, etc.

As an example, a workflow may include a post-job phase. In such an example, the post-job phase may involve data analysis and AI framework and/or machine learning model updating. For example, consider updating a model for another job for the site, which may be for another section of a borehole (e.g., at a smaller borehole diameter, etc.).

As an example, a method can include performing drilling at some level of autonomous geosteering based on an AI framework that may provide one or more machine learning models, which may be implemented at surface (e.g., using surface equipment circuitry) and/or downhole (e.g., using downhole equipment circuitry).

As an example, a method may include performing decision-making downhole using downhole equipment circuitry as to what data and/or when to transmit data. As explained, a downhole tool may be a smart tool that may operate its own circuitry in a manner responsive to information contained in measurements, which may be processed using a model, comparing to a model, etc.

As an example, a method may include using an AI framework at surface for performing decision-making as to possibly updating a physics-based model, a data-driven model (e.g., a machine learning model), and/or a hybrid model (e.g., physics-based and data-driven). As an example, a method may involve decision-making at surface as to possibly running a physics-based model simulation while drilling to aid in understanding of an unexpected non-1D geology that may be encountered downhole per indications in downhole measurements, which may be assessed at surface, automatically and/or with a HITL. As an example, an AI framework may provide for retraining, tuning, etc., of one or more machine learning models, which may occur in a manner responsive to decision-making based at least in part on data, whether surface data and/or downhole data.

As an example, a method may provide for decision-making as to what data (e.g., measurements) to transmit from downhole to surface. As explained, such decision-making may pertain to one or more of shallow, medium, and/or deep EM data. As an example, decision-making may be performed downhole, for example, in a manner dependent on one or more distances to an object and/or a boundary laterally from a borehole or planned borehole trajectory and/or one or more distances to an object and/or a boundary ahead of a bit (e.g., beyond an end of a borehole). As an example, decision-making may be performed in a manner that depends on ROP. In such an example, consider decision-making that involves weighing distance and ROP with latency in control and/or controllability for geosteering of a drillstring. As explained, control may be directed to control decisions as to whether to build angle or maintain a current trajectory. As explained, in various instances, decisions may be made at surface using surface equipment and, in various instances, decisions may be made downhole using downhole equipment. As explained, in various instances, decisions may be made autonomously, optionally with inclusion of a HITL.

As explained, autonomous decision-making as to data transmissions from downhole to surface may provide for expedited decision-making in geosteering control. As explained, decisions-making as to what data to transmit to surface for purposes of data-based inversion to generate a model of a portion of a subsurface environment can improve geosteering, for example, by allowing for more frequent geosteering decisions, which may thereby provide for an improved borehole trajectory, improved equipment utilization, less non-productive time, improved borehole integrity, etc. As explained, an AI framework-based approach may provide for continual learning and improvement, for example, as to subsequent sections of a borehole and/or for drilling of one or more offset boreholes in a field.

As explained, an AI framework-based approach to decision-making in geosteering can reduce demands for human intervention, provide increased autonomy for control, improve modeling, improve drilling, improve borehole trajectory (e.g., wellbore trajectory), address one or more types of data issues (e.g., bandwidth, payload, noise, SNR, etc.), etc. As explained, an AI framework may reduce time for decision-making to thereby improve control.

As an example, a framework may provide for utilization of deep directional electromagnetic (EM) measurements acquired while drilling, which may provide highly resolved, reservoir-scale, images with radial depths of investigation (DOI) in excess of 30 m, which may respond to the true 3D nature of the inhomogeneous electrical resistivity distribution around a borehole. As an example, a framework may provide for implementing a while-drilling, real-time process that integrates deep EM resistivity data and available seismic data. In such an example, the seismic data may be provided as acoustic impedance, which may be interpreted jointly with deep EM resistivity data to provide added information specifically on reservoir petrophysical properties around a borehole being drilled and also in front of a drill bit utilized for drilling that lengthens the borehole.

As an example, a framework may provide for addressing one or more reservoir characterization objectives, for example, consider objectives to estimate petrophysical properties of prospective hydrocarbon traps and to reduce uncertainty of interpretation. In such an example, the framework may provide for implementing a workflow for petrophysical joint inversion of seismic and EM attributes to estimate a petrophysical model, for example, in terms of porosity and water saturation. As explained, a workflow may involve joint inversion within a probabilistic structure provided by a Bayesian approach. As an example, a framework may be applied to a real hydrocarbon exploration scenario to evaluate its contribution to an interpretation phase. As an example, 3D volumes of estimated porosity and saturation may be generated via joint inversion of acoustic impedance and electrical resistivity, which may provide a quantitative description of reservoir properties along with a measure of uncertainty, which may be consistent with a petrophysical model and observations.

As an example, a joint inversion may provide for addressing scenarios where a lack of data points exist, for example, by using an anisotropic response of electromagnetic measurements obtained using deep directional EM LWD tools (e.g., consider use of the GEOSPHERE tool (SLB, Houston, Texas). As an example, given a relationship between vertical and horizontal resistivities and reservoir properties, as explained, a workflow may provide for setting up a problem to solve for porosity, water saturation and volume of shale using acoustic impedance, resistivity horizontal Rh and resistivity vertical Rv.

As an example, a functional relationship between Rh and Rv with respect to porosity, saturation, volume of clay, and one or more other properties may be directed from one or more empirical relationships, one or more physical relationships, one or more machine learning models, etc. As an example, a functional relationship may be derived using one or more effective medium theory approaches.

As an example, one or more approaches may be used in connection with saturation mapping of fluids in subsurface geologic strata, for example, through knowledge of water salinity and temperature, hydraulic boundaries mapping in subsurface strata, imaging and detection of trapped fluids in geologic formations, etc.

As explained, improved geosteering may improve borehole characteristics such that completions and production may be improved, for example, by reducing the number of wells to be placed, by creating better wells with greater certainty, by meeting production targets, by reducing CO2 emissions, etc. For example, by achieving a production target for a field or an area thereof with fewer wells, energy may be conserved and, correspondingly, emissions of one or more greenhouse gases (GHGs) such as CO2.

As an example, a framework may provide for improved understanding of a subsurface environment at a borehole, particularly where such subsurface environment may be complex, heterogenous, etc. As an example, a framework may provide for delineation of structural features and/or fluid.

Figure 12:
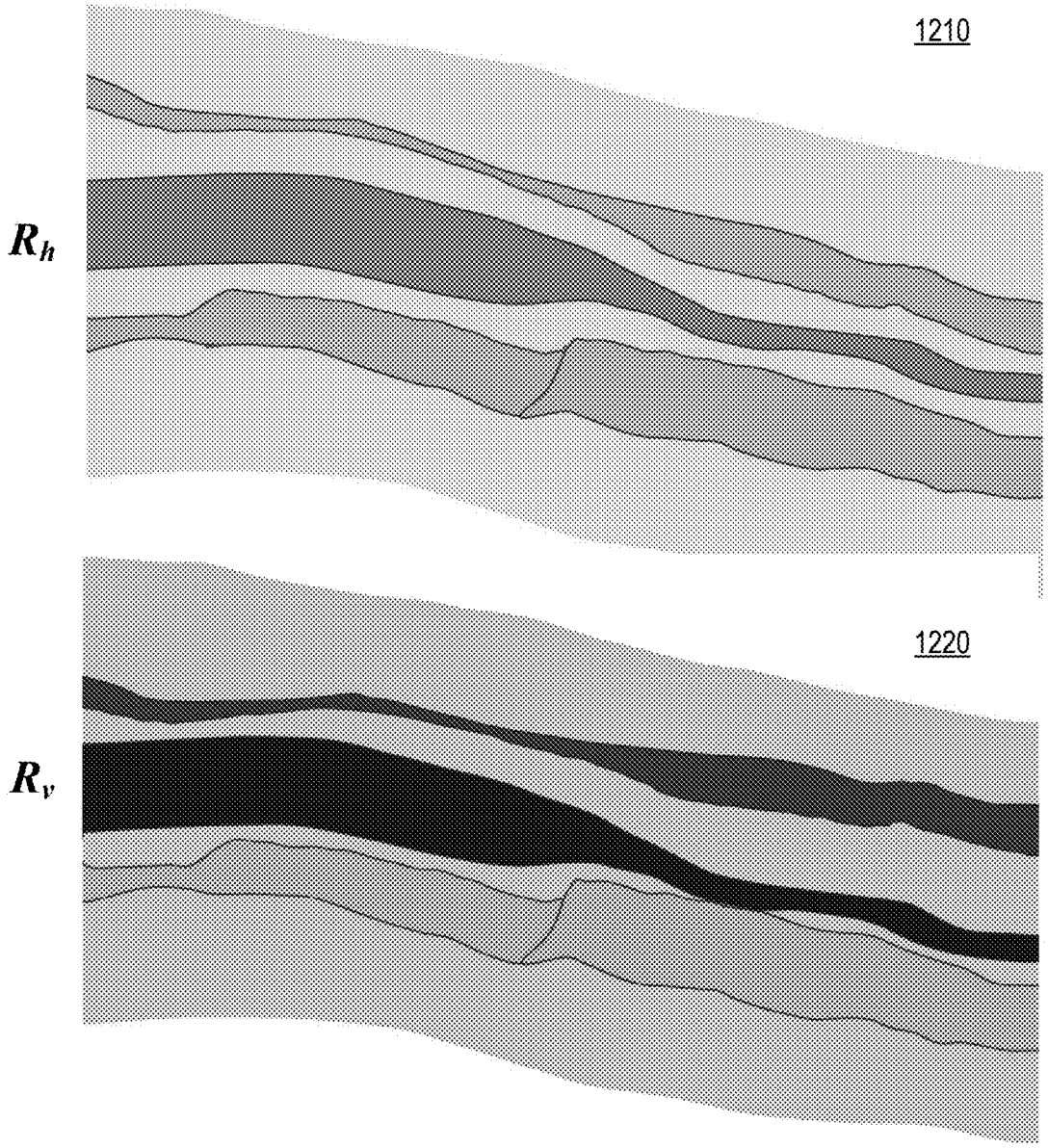
FIG. 12 illustrates example images of horizontal resistivity and vertical resistivity in a subsurface region.

FIG. 12 shows example images 1210 and 1220 for resistivities in a subsurface region where various differences exist as to horizontal resistivity and vertical resistivity. As explained, a region may include anisotropies with respect to measurements, which may be relevant to drilling, particularly, geosteering in a substantially lateral reservoir.

As explained, subsurface structures may vary spatially, which may vary with respect to composition, fluid content, etc. As an example, layers may be dipping with varying thicknesses. Where geosteering of a drill bit aims to achieve acceptable reservoir contact between a borehole being drilled and a reservoir, generation of properties in a see ahead region may improve reservoir contact, for example, via controlled geosteering. In such an example, a borehole may be generated, as a product of drilling, where the borehole may possess desirable quality, which may be characterized via integrity, distance from one or more boundaries, etc. For example, consider a boundary for a layer that may pose one or more risks as to water intrusion, borehole integrity, completions workflows, etc.

As an example, a 1D, 2D, or 3D resistivity region may be extrapolated to estimate expected resistivity distribution in front of a drill bit (e.g., ahead of or beyond an end of a borehole). As an example, extrapolation may be performed using one or more techniques.

Figure 13:
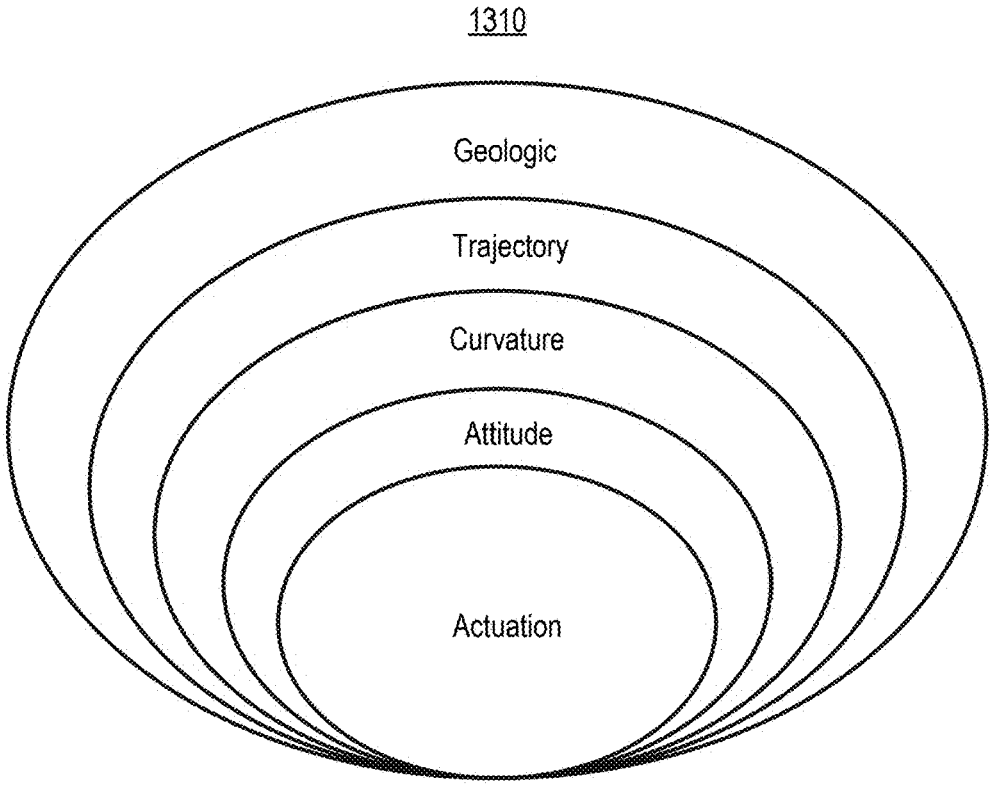
FIG. 13 illustrates an example of a graphic and an example of a system.
Figure 13:
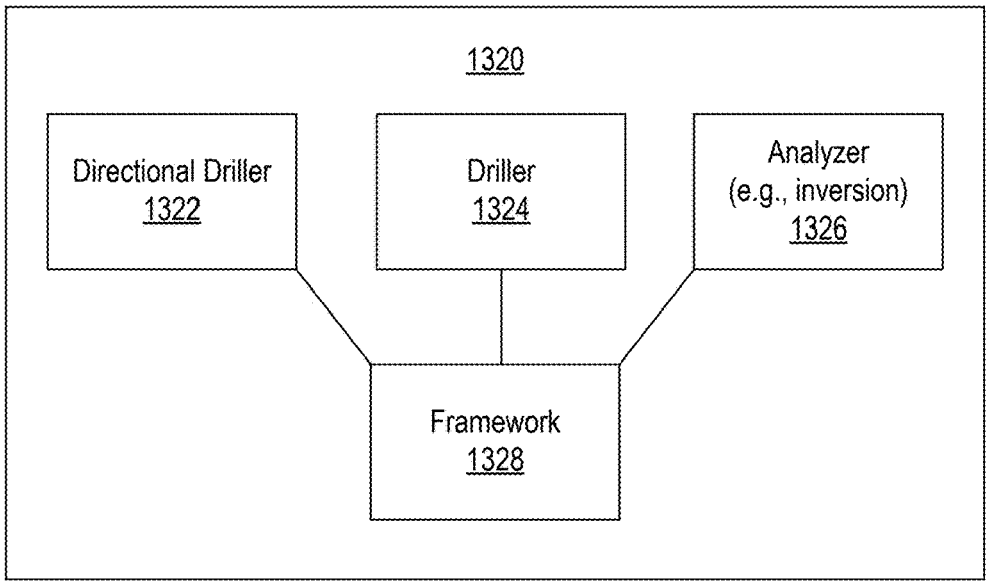

FIG. 13 shows an example of a decision graphic 1310 and an example of a system 1320. As shown, the decision graphic 1310 includes information domains with respect to geologic information, trajectory information curvature information, attitude information, and actuation information. As an example, decision-making may be tiered and may include one or more loops, which may be implemented to arrive at a decision on equipment actuation for directional drilling. For example, equipment actuation may provide for controlling one or more pieces of equipment at surface and/or downhole to drill directionally to a target. As explained, directional drilling equipment may include an RSS, a mud motor, etc. As explained, factors such as WOB, torque, ROP, etc., may be involved in drilling directionally.

The attitude of downhole drilling tools can involve inclination angle, azimuth angle, and tool face angle where inclination angle can describe degree to which a tool is tilted relative to a vertical line, azimuth angle can indicate angle through which the tool has rotated in a clockwise direction from true north (e.g., or other reference) to a borehole azimuth line on a horizontal projection, and tool face angle can describe directional angle of a drill bit in a vertical plane. Together, these three parameters can determine attitude of a drilling tool underground for purposes of accurate geological target positioning and optimizing drilling paths. The precise control and measurement of downhole drilling tool attitude has an impact on drilling efficiency, reduction of non-productive time (NPT), minimization of drilling risks, and enhancement of resource recovery rates (e.g., or other goal(s)).

As shown in the example graphic 1310, attitude encompasses actuation, which may provide for an adjustment in one or more of inclination angle, azimuth angle, and tool face angle. Actuation may involve actuating equipment downhole, for example, via a telemetry system, and/or actuating equipment at surface, for example, via a surface controller (e.g., a framework, etc.).

As shown in FIG. 13, the example system 1320 can include a directional driller block 1322 (DD block), a driller block 1324, an analyzer block 1326 (e.g., for inversions, etc.), and a framework 1328. In the system 1320, individual humans may be present, for example, as an individual associated with the directional driller block 1322, an individual associated with the driller block 1324, and an individual associated with the analyzer block 1326. As an example, these three individuals may be present within a cabin at a rigsite (e.g., a "doghouse").

As an example, the analyzer block 1326 may provide for processing data for understanding a downhole environment structurally. For example, consider shallow, medium, and deep resistivity data that can be inverted to generate a structural model around a borehole, but may not necessarily provide for a "view" in front of a bit (e.g., an end of the borehole). The analyzer block 1326 may determine that a borehole is to be directed downwardly (or up, left, or right) over the next stand of drillpipe (e.g., 30 meters), after which, upon making a connection, a survey may be performed to determine where the end of a drillstring may be located in the subsurface environment. Once such information is communicated to the directional driller block 1322, it is to be integrated with additional information concerning, for example, formation characteristics (e.g., rock hardness, etc.). Such information may also be communicated to the driller block 1326, which may be responsible for control of parameters such as WOB, torque, flow rate (e.g., mud flow rate), etc. As the amount of information for the different roles performed by the blocks 1322, 1324, and 1326 may be considerable, the framework 1328 may provide for coordination and/or other assistance. For example, consider a framework that can generate visualizations for rendering to a display as part of a graphical user interface that can be viewed by a group of individuals and/or that can generate instructions, for example, executable to extend a borehole via further drilling.

As an example, the framework 1328 may provide for assessing available data, which may include logs additional to resistivity logs (e.g., EM logs). For example, consider a gamma ray log, a borehole imager log, etc. In such an approach, the framework 1328 may provide for expediting communication as to relevant log information. For example, consider rendering indications of rock type, which may be relevant to the driller block 1324 where a driller would understand that ROP would likely be diminished for drilling in one type of rock versus another type of rock. As explained, the framework 1328 may provide for integrating information from a number of logs, which can supplement resistivity logs in the context of directional drilling such that the directional driller block 1322, the driller block 1324, and the analyzer block 1326 can operate in an improved and coordinated manner.

As an example, the blocks 1322, 1324, and 1326 may include computational equipment with human-machine interfaces. In such an example, the blocks 1322, 1324, and 1326 may provide for real-time interactions with the framework 1328, which may provide for individual GUI rendering and/or a coordinated, overarching GUI, which may be presented to a display viewable by individuals with roles for directional drilling, drilling control, and analyzing EM log data.

As an example, the framework 1328 may provide for democratizing the doghouse, in that roles performed by humans and equipment in the doghouse become more leveled and objective in decision-making. As explained, a monolithic approach to presenting relevant graphics for structure, logs, decisions, on a sufficiently large display (e.g., or array of displays), may allow individuals to see the same information upon which decisions may be made for a "common good", for example, directionally drilling a borehole with improved characteristics in an improved manner (e.g., lesser equipment wear, lesser emissions, etc.). In such an example, impact may be lessened as to characteristics of individuals, for example, whether given strong or weak personalities, the framework 1328 may provide for driving informed decision making in a timely manner.

As an example, the framework 1328 may provide for accessing data, generating data-based products, etc. As an example, the framework 1328 may be local and/or remote. For example, consider a framework that includes cloud platform-based resources that may be suitably provisioned to handle data flows and demands. As an example, the framework 1328 may provide one or more types of machine learning models. For example, consider a generative chat feature that may be generic or specialized for one or more purposes. As an example, the framework 1328 may provide generative chat features for individual roles, such as, for example, a directional driller role, a driller role, and an analyzer role. In such an example, the generative chat features may be exposed to a number of individuals yet under control exclusive to an assigned individual. As an example, a generic generative chat feature may be accessible to individuals for different roles and may help to mediate disagreements, sort priorities, etc., amongst a team in a doghouse.

As an example, when an individual has a recommendation, that recommendation may be fed to a chat feature for assessment where the results thereof may be presented on a display viewable to individuals of a team. In such an approach, if the results are consistent, then decision-making may proceed; whereas, for inconsistent results, the individual may assent to the results or may reconsider and reformulate his recommendation. As explained, the framework 1328 may provide for democratization in the doghouse in a manner that expedites decision making and helps to assure individuals are in agreement or otherwise know the basis for a decision.

Figure 14:
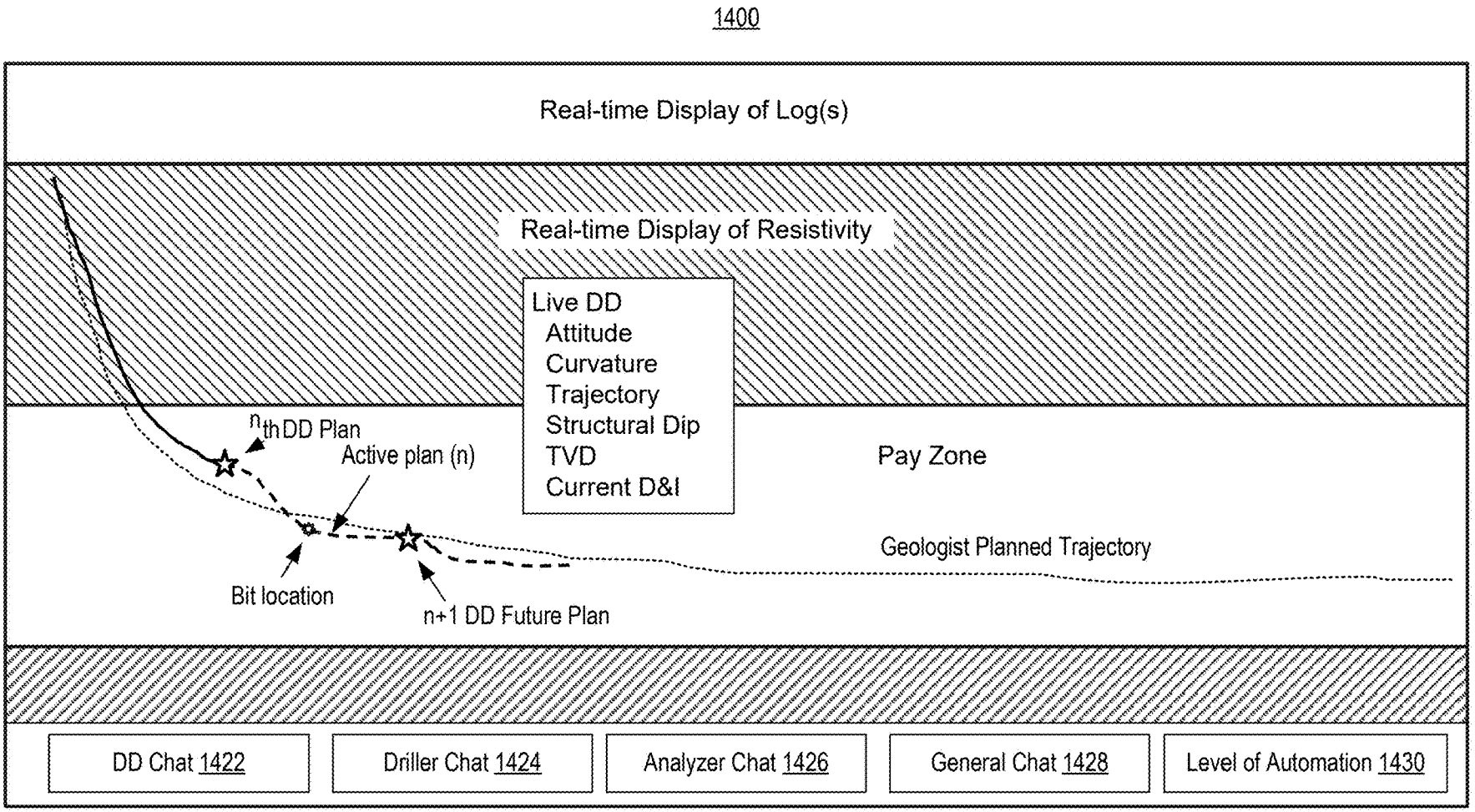
FIG. 14 illustrates an example of a graphical user interface.

FIG. 14 shows an example of a graphical user interface (GUI) 1400 that includes various panels and graphical controls, for example, for a directional driller chat feature 1422, a driller chat feature 1424, and analyzer chat feature 1426, a general chat feature 1428, and a level of automation feature 1430.

As shown, the GUI 1400 may provide for rendering of one or more logs, resistivity (e.g., structure from inversion, etc.), trajectories, etc. As shown, information from a directional drilling plan may be rendered for one or more iterations, along with location of a bit and/or end of a borehole. As an example, drilling parameters may be rendered. As shown, directional drilling information may be rendered, which may include attitude, curvature, trajectory, structural dip, TVD, current direction and inclination (e.g., D&I, as acquired using downhole sensors, etc.).

As shown, the GUI 1400 may render real-time structural data from a real-time EM geologic model. In such an example, the GUI 1400 may update the next (n+1) planned drilling target and parameters, provide for rendering of DD inputs as to formation mechanics (e.g. rock hardness of layers), DD down links for a plan to a control unit which controls actuation during the next section (n+1).

As explained, a framework may provide access to chat types of features, which may be tailored for particular roles, tasks, equipment control, data assessments, etc. In such an example, results may be rendered to the GUI 1400 such that a number of individuals may see the results, which may provide for improved decision making and control of directional drilling to form a borehole. As an example, a framework may provide for audio generation, which may be provided in a voice with tone, etc., that may help individuals to remain calm and aware.

As explained, the GUI 1400 can be generated by a framework to present a real-time window display bringing together participant inputs with a next step in a drill plan. As explained, during geosteering activity there tend to be multiple parties running different optimization algorithms for their part of the geosteering process. As explained, the GUI 1400 may help to consolidate and display a next planned trajectory, for example, based on inputs and/or outputs from various roles.

As an example, a driller parameters window may provide for rendering of information as to managing hole cleanout, integrity and overall efficiency, RPM, torque, WOB, ROP, etc. As an example, a directional driller parameters window may provide for rendering TVD and relative dip, attitude, curvature, trajectory, live D&I from a BHA, and knowledge of geology from real-time and/or prior logs (e.g., consider logs from one or more offset wells). As an example, an analyzer parameters window may provide for rendering real-time short, medium, and deep EM inversion information, real-time logs and shallow imaging, real-time estimated TVD and dip for a DD plan (e.g., n+1 decision) with attitude, curvature, trajectory, along with real-time tool position and offset well "ground truth".

As explained a GUI may present EM real-time algorithm updates for a current geologic model (n), EM real-time algorithm updates (n+1) for a drill plan, and confidence on a drill plan as may be affected by one or more inverted boundaries, TVD, structural dip, ROP, etc. As an example, a GUI may render indicia of uncertainty, probabilities, etc.

As an example, a framework may provide for generation of feedback to individuals, which may facilitate learning. For example, consider "good job team", followed by a reason or reasons why the team did a good job. For example, consider feedback on a stand-by-stand basis. As an example, consider a job where ROP may be approximately 10 meters to 30 meters per hour where a stand is 30 meters in length. In such an example, a connection may take approximately 5 minutes or less, which may be accompanied by a survey to gain location information. Hence, in a time period of minutes to a few hours, decision may be made as to a direction to drill a next stand. As an example, a framework may provide for updating a GUI as to future drilling at intervals of approximately a minute to approximately five minutes, which may help to keep individuals engaged, particularly for lower ROPs.

As an example, a framework may provide for bootstrapping log information, particularly EM logs. For example, using shallow EM data to generate structural information near a borehole, analyzing medium EM data to generate structural information extending further out from the borehole, and then analyzing deep EM to generate structural information extending even further out from the borehole. In such an approach, the framework may provide for progressively updating structural features in a subsurface environment in a GUI rendered to a display.

As explained, in various instances geosteering services may be autonomous to some level of autonomy. For example, consider a series of levels or a level hierarchy that may range from manual to fully automatic. In many instances, implemented levels of automation will involve some amount of human involvement (e.g., a human-in-the-loop (HITL)). For example, an HITL may provide for some amount of human-managed operations and communications, impacting efficiency, accuracy, and consistency.

As explained, a trajectory may be designed based on one or more geological models from seismic interpretations and well log correlations. In various instances, relatively low resolution and some amount of uncertainty of seismic data may result in suboptimal pay zone exposure (e.g., data revealing extent, quality, etc., of a pay zone). As explained, one or more real-time geosteering services may aim to address suboptimal pay zone exposure by providing real-time interpretation of formation boundaries, which may thereby assist in optimizing trajectory-reservoir contact (e.g., optimizing contact on a unit length basis, etc.). As explained, during complex geosteering activities, multiple individuals may be responsible for executing different computational applications (e.g., computational frameworks, etc.) with corresponding optimization components to generate results for respective parts of a geosteering process. For example, as explained, a directional driller, a driller, and an analyzer may be involved, which may be humans that interact with corresponding computational frameworks for decision-making, control, etc.

As explained, a framework may provide for integrating a number of different frameworks. As explained, such a framework may provide for rendering a graphical user interface to assist in guiding and informing individuals as to particular tasks in geosteering process operable at some level of autonomy. In such an example, the framework may operate in an automated manner, which may be responsive to interactions, from machines and/or human-machine interfaces (HMIs). For example, a framework may provide an automatic system, paired with a user-friendly graphical interface, that integrates and customizes, for different personas, to streamline communication, reduce manual interventions, and minimize errors. In such an example, the framework may enhance efficiency and effectiveness of geosteering drilling operations.

As explained, a framework can provide for generation of a real-time interactive GUI for geosteering workflows, which may consolidate and display actionable graphics, such as, for example, a next planned trajectory, based on inputs from a number of computational applications (e.g., directional drilling for geosteering, general rig operations for drilling, analysis of data, etc.).

Figure 15:
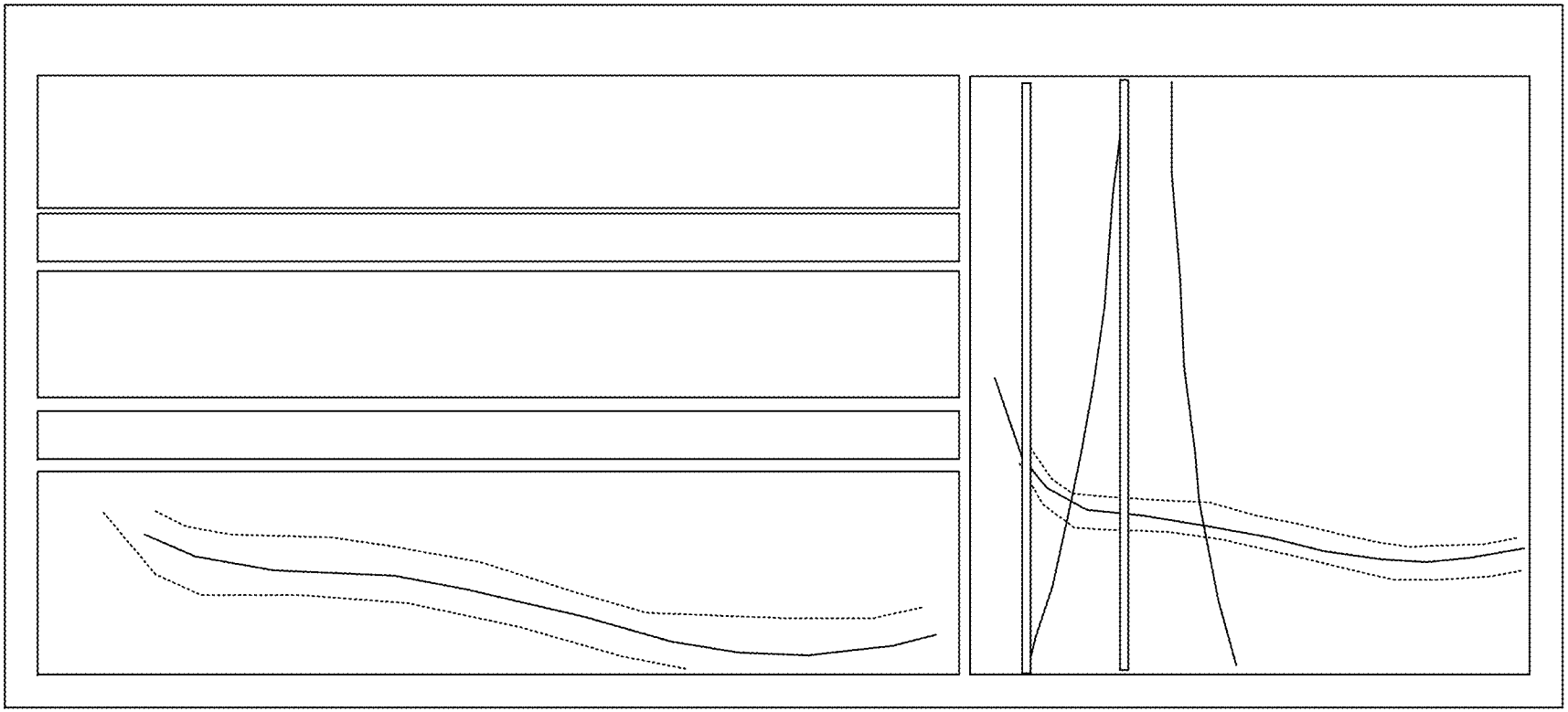
FIG. 15 illustrates an example of a graphical user interface.

FIG. 15 shows an example of a graphical user interface (GUI) 1500 that includes various panels (e.g., panes, windows, fields, etc.). As shown, the GUI 1500 may include panels for logs that are ordered as rows for a substantially horizontal portion of a trajectory along with a close-up rendering of the trajectory together with structural information, as may be derived from log and/or other data. In such an example, the panel for the trajectory may be a curtain section, for example, a two-dimensional slice through a subsurface environment where structural information may indicate a pay zone and one or more boundaries. Further, the GUI 1500 may include a panel that presents a perspective view, in a see-through manner, of the trajectory and structural information germane to geosteering along with locations of offset wells that may be functional wells for injection and/or production and/or exploratory wells, for example, for purposes of acquiring logs. In such an example, the locations of the offset wells may be overlaid with structural information as may be log data or data generated based at least in part on log data. For example, consider a substantially vertical exploratory offset well that has been utilized to acquire borehole imagery data with respect to depth (e.g., true vertical depth) that can be rendered to assist in quality control of one or more boundaries that may appear in the structural information surrounding the trajectory of the borehole being drilled via geosteering.

As an example, the GUI 1500 may include one or more panels for rendering of driller-related information with respect to time and/or depth (e.g., measured depth, TVD, etc.). In such an example, one or more tracks or channels of surface data and/or downhole data may be rendered, which may include, for example, WOB, block position, torque, RPM, flow rate, etc. In such an example, the GUI 1500 may provide for integration of different types of data and/or data-based products into a single GUI. As explained, a GUI may include one or more chat features. As an example, a chat feature may be enabled via a graphical control that may be positioned as desired with respect to a GUI. For example, consider a GUI that includes driller data and a driller chat feature positioned proximate to a panel for the driller data. In such an approach, an individual may actuate the driller chat feature without having to navigate a cursor, etc., away from the driller data panel. Such an approach may also help to prevent chat feature confusion in that one chat feature is actuated when an individual intended to actuate a different chat feature.

As an example, a GUI may be interactive in a multi-thread manner. For example, consider a GUI that can support multiple cursors such that multiple users can simultaneously interact with different regions, features, etc., of the GUI. As an example, for a multi-user GUI, each user may have associated credentials that may limit one or more aspects of GUI interaction. For example, consider a driller login account that limits a user to use of a driller chat feature and, for example, a general chat feature. Similarly, a directional driller login account and an analyzer login account may be provided, which may have associated limitations. In such an approach, individuals may interact with a common GUI without overstepping their bounds, for example, actuating a GUI feature that is within the domain of another individual. As an example, an emergency override may exist, where appropriate, to assure that if one individual is unable to respond, some action may be taken in an effort to keep a workflow moving or to suspend one or more workflow tasks until the individual is able to respond (e.g., depending on level of risk, level of automation, etc.).

As an example, where a framework provides for a relatively high level of automation, a GUI may provide for rendering indicators as to automated tasks. For example, consider a pop-up that indicates "boundaries extrapolated", which may draw attention as to rendering of extrapolated boundaries. In such an example, if an individual deems the quality of one or more of the extrapolated boundaries unacceptable or open to improvement, the individual make actuate a graphical control to reduce a level of automation and/or to halt an automated task, which may thereby allow for interactions by the individual, for example, to edit, redraw, reassess, etc., one or more boundaries (e.g., as extrapolated or otherwise). While boundaries are mentioned, such an approach may also be applied to one or more trajectory paths, which may be generated paths that extend ahead of an end of a borehole, for example, to a target. In such an example, a directional driller may take control to improve a data-based product as may be represented through visual rendering to a common GUI. As to a driller, consider an ability to alter a planned or automated WOB, whether current or to occur sometime in the future, as may be indicated by time, depth, etc.

As explained, a GUI may provide for transparency in interactions performed by a number of individuals where such interactions may be informative as to different assigned roles. For example, where an analyzer uncovers a change in rock hardness of a region ahead of a bit and thereby acts to enhance a result (e.g., increase resolution, add other log data to the mix, etc.), that may catch the attention of a driller, who can, at an appropriate time, adjust one or more drilling parameters to account for the change in rock hardness. In turn, a directional driller may see what colleagues are doing and re-run a process to optimize a path towards a target. Such an approach may include multiple interactions from multiple individuals that aim to optimize directional drilling. While such an approach may involve loops, interactions may be transparent and facilitate communication and understanding such that the number of loops tends to be few and converge on an optimal solution for drilling ahead.

Figure 16:
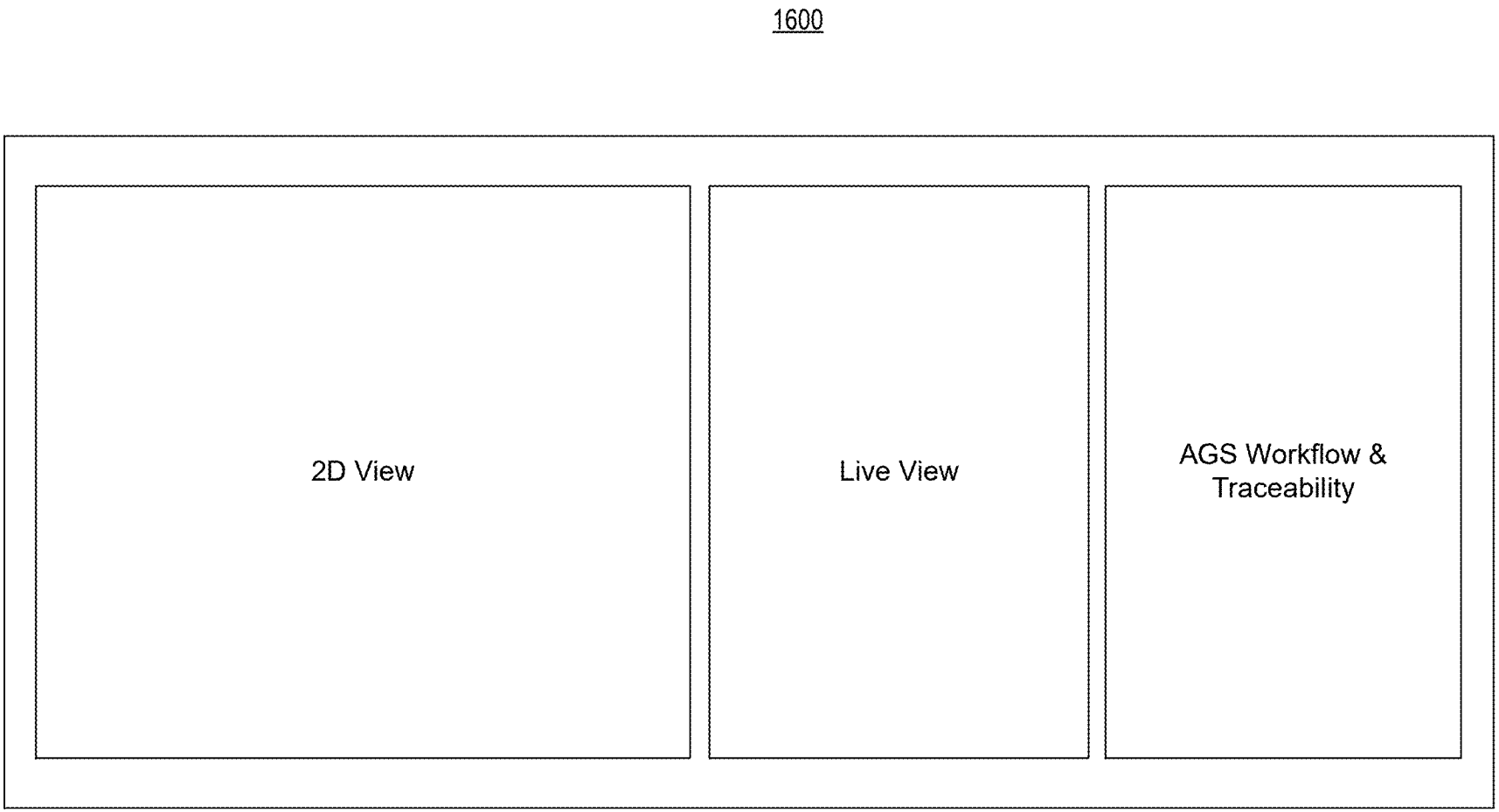
FIG. 16 illustrates an example of a graphical user interface.

FIG. 16 shows an example of a graphical user interface (GUI) 1600 that includes various panels, which may include a 2D view panel, a live view panel, and an AGS workflow and traceability panel. As an example, the 2D view panel may include logs and an enlarged view as a curtain view through a trajectory along with relevant structural information (e.g., based on resistivity, etc.). As an example, the live view panel may include a perspective graphic with renderings of structures, logs, offset wells, etc. As an example, the live view panel may include directional information, for example, as to attitude. As an example, the AGS workflow and traceability panel may include one or more graphical controls as may be shown in FIG. 8, FIG. 9, etc.

Figure 17:
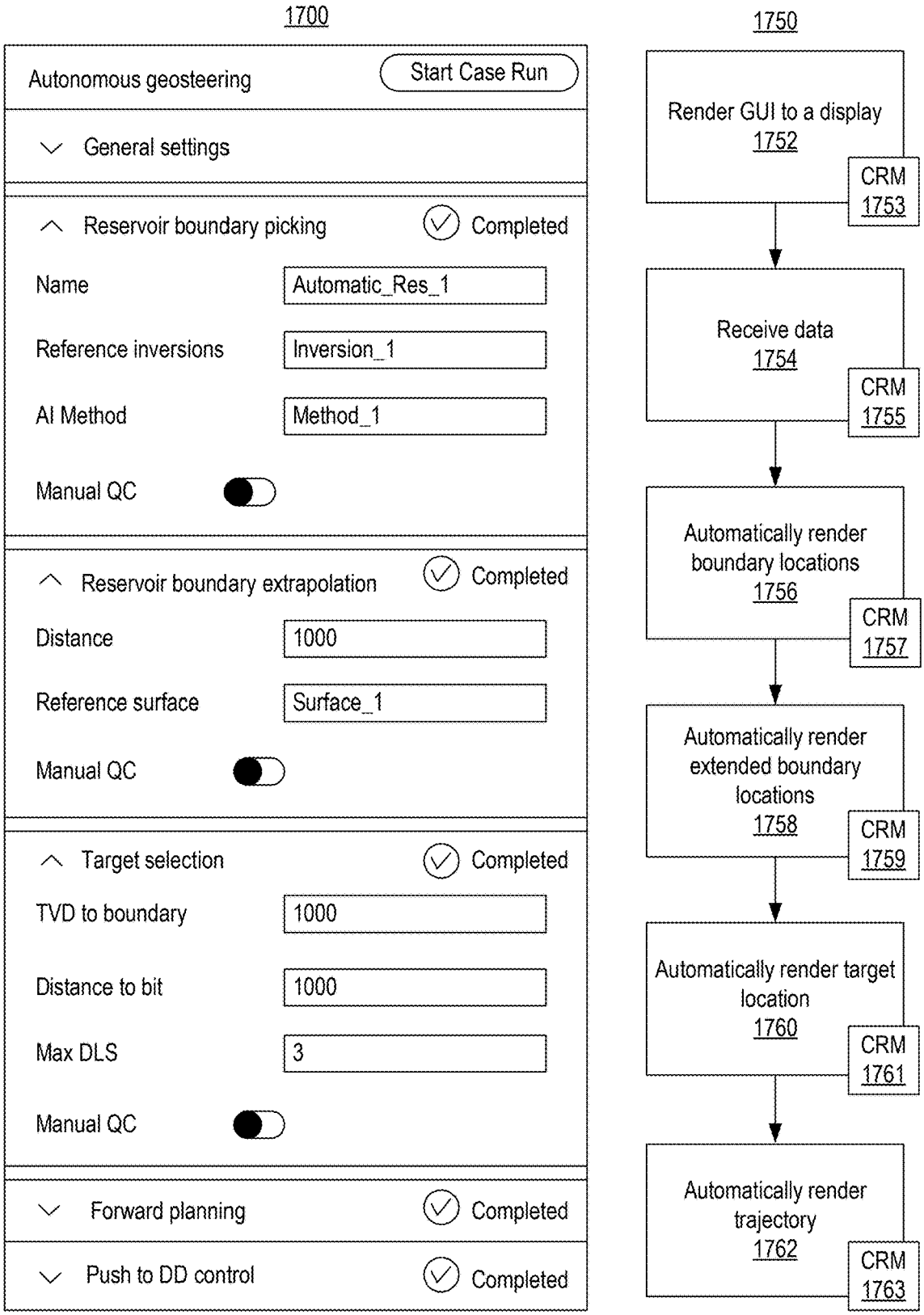
FIG. 17 illustrates an example of a graphical user interface and an example of a method.

FIG. 17 shows an example of a graphical user interface (GUI) 1700 that may be rendered to a display, for example, by a framework, along with an example of a method 1750. As shown, the GUI 1700 may include one or more features of the GUI 801 of FIG. 8 and/or the GUI 900 of FIG. 9. As an example, the GUI 1700 may be rendered as part of a panel of a GUI, such as, for example, the GUI 1600 of FIG. 16, which may provide for rendering an AGS workflow and traceability panel. As shown in the example GUI 1700, reservoir boundary picking may be controlled using reference inversions, AI methods (e.g., one or more machine learning models), etc. As shown, reservoir boundary extrapolation may be controlled using distance, one or more reservoir surfaces, etc. As shown, target selection may be controlled using TVD to boundary (or boundaries), distance to bit (e.g., as disposed in a borehole at an end of the borehole), maximum dogleg severity (DLS), etc. As indicated, the GUI 1700 may include one or more features for adjusting a level of automation, which may include switching to manual quality control, which may be assisted by one or more computational techniques (e.g., for semi-automated interactions, etc.). As explained, in various instances, an individual or individuals may intervene to adjust, improve, etc., one or more aspects of a workflow, which may include interactions as to boundaries, targets, etc.

As shown in the example GUI 1700, forward planning may be performed along with a push to DD control, which may provide for instructing one or more pieces of equipment in the field, which may be at surface and/or downhole. In such an example, a framework may help to coordinate tasks to improve directional drilling that involves geosteering, whether via surface equipment and/or downhole equipment.

As to the method 1750, it can include a render block 1752 for rendering a graphical user interface to a display; a reception block 1754 for receiving data acquired by a drillstring disposed in a borehole in a subsurface environment; a render block 1756 for, responsive to determining boundary locations for formations in the subsurface environment using the data, automatically rendering the boundary locations in the graphical user interface along with graphic representations of the data for visual quality assessment of the boundary locations and a first graphical control actuatable for interactive adjustment of the boundary locations; a render block 1758 for, responsive to determining extended boundary locations in the subsurface environment for a region beyond an end of the borehole using the boundary locations, automatically rendering the extended boundary locations in the graphical user interface for visual quality assessment of the extended boundary locations along with a second graphical control actuatable for interactive adjustment of the extended boundary locations; a render block 1760 for, responsive to determining a target location in the region using the extended boundary locations, automatically rendering the target location in the graphical user interface for visual quality assessment of the target location along with a third graphical control actuatable for interactive adjustment of the target location; and a render block 1762 for, responsive to generation of a trajectory from an end of the borehole location to the target location, automatically rendering the trajectory in the graphical user interface for visual quality assessment of the trajectory along with a fourth graphical control actuatable for interactive adjustment of the trajectory. As shown, one or more computer-readable media (CRM) blocks may be provided, which may include CRM blocks 1753, 1755, 1757, 1759, 1761, and 1763.

Figure 18:
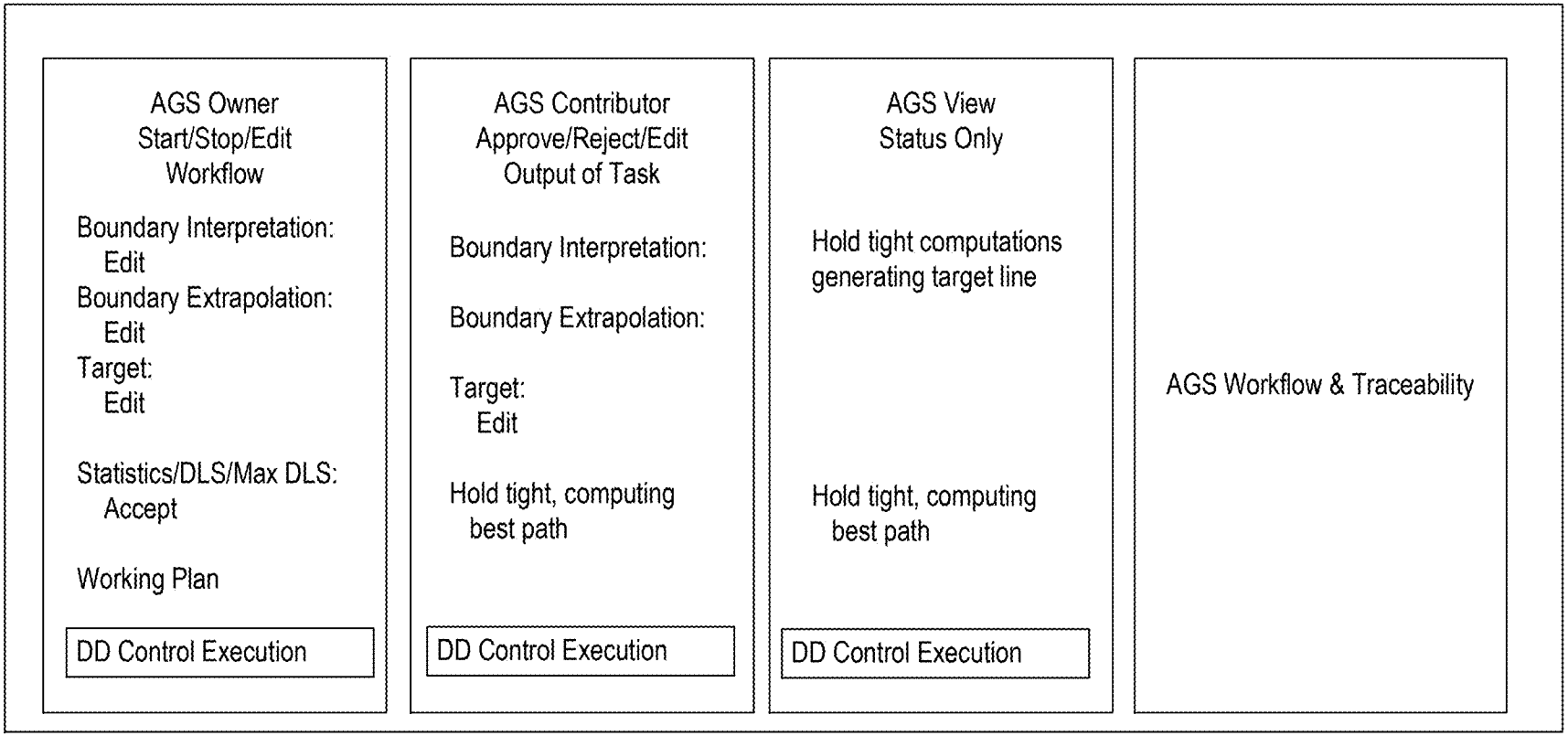
FIG. 18 illustrates an example of a graphical user interface.

FIG. 18 shows an example of a graphical user interface 1800 that can include various panels, which may include an AGS owner panel, an AGS contributor panel, an AGS view panel, and an AGS workflow and traceability panel. In such an example, different levels of authority may be assigned such that one or more individuals may be limited as to use of GUI features. As explained, a GUI may be a multi-user GUI where limitations restrict use of one or more features. As shown, an AGS owner may start, stop, and/or edit a workflow, an AGS contributor may approve, reject, and/or edit output of a task (e.g., as may be generated using automation, etc.), and an AGS viewer may view status messages, such as, for example, "hold tight" due to a wait time for "computations generating target line" (e.g., or target curve). As shown, each of the panels may include one or more graphical controls for execution of instructions in the field. For example, consider one or more DD control execution graphics, which may be enabled and/or disabled based on one or more criteria (e.g., authority, task in a workflow, etc.).

Figure 19:
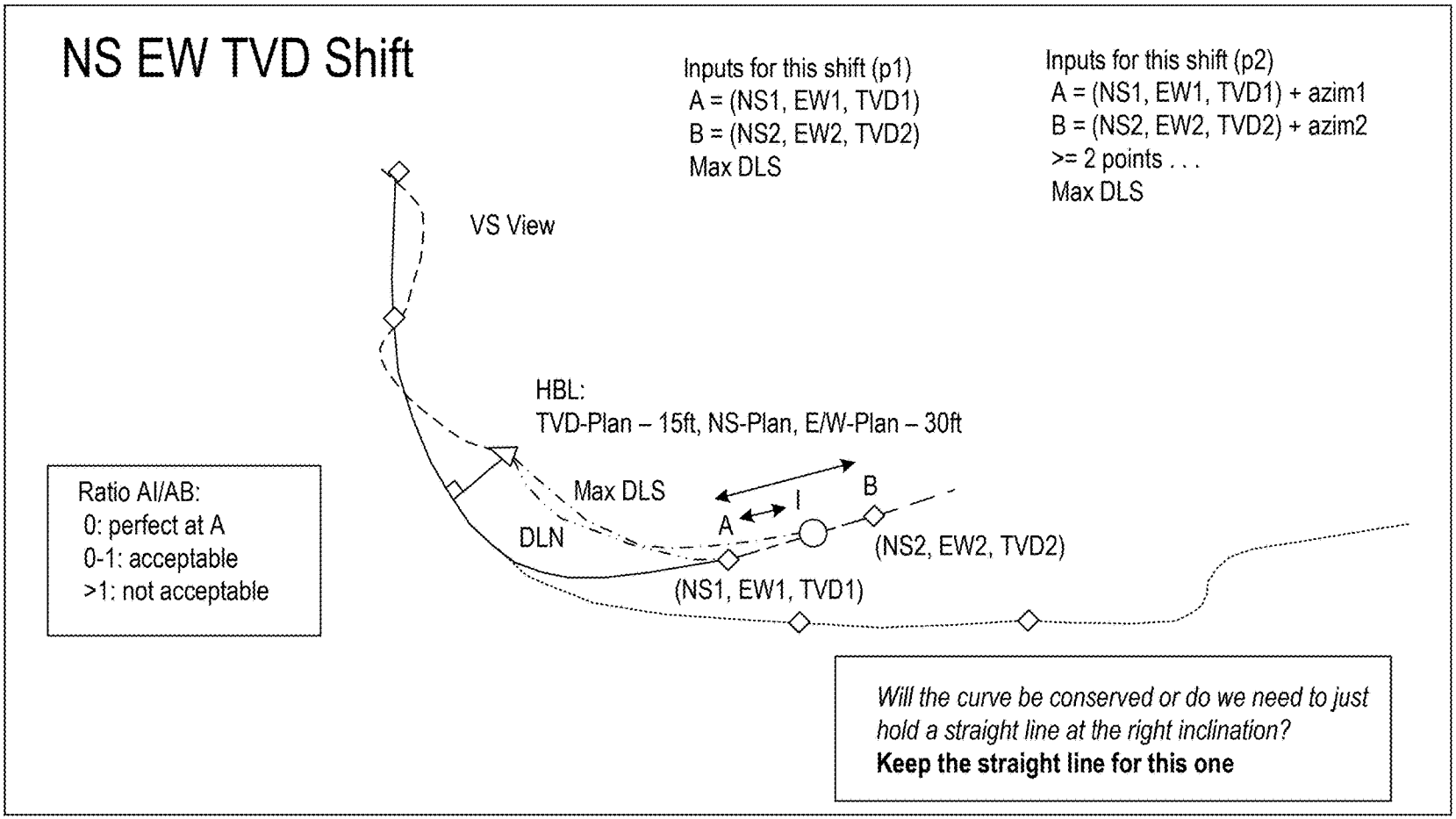
FIG. 19 illustrates an example of a graphical user interface.

FIG. 19 shows an example of a graphical user interface (GUI) 1900 that includes a rendering of various trajectories with respect to a directional drilling project where inputs may be rendered along with points, which can include a drill bit point, a target point or target points, etc. As shown, various metrics may be rendered, which may provide for assessing points, for example, as to acceptability. As shown, a chat feature may provide for rendering of messages, queries, answers, etc. For example, consider a query: "Will the curve be conserved or do we need to just hold a straight line at the right inclination?" In response, a framework may generate and render an answer, such as, for example: "Keep the straight line for this one." In such an example, the "this one" may refer to drilling for a stand or a portion of a stand, which, as explained, may be approximately 30 meters in length.

As shown in the example GUI 1900, a line approach may be utilized for a target. For example, in assessing the target three points may be utilized, defined as A, I, and B. In such an example, a distance AI and a distance AB may be determined and, for example, a ratio of AI over AB may be determined, which may be assessed to determine acceptability. For example, if this ratio is between 0 and 1, that may indicate acceptable; whereas, if this ratio is greater than 1, it may be unacceptable (e.g., not acceptable). Such a metric may provide for expediting assessment of directional drilling and may be part of a chat feature or another assessment feature. For example, a chat feature may account for one or more metrics as to directional drilling when generating an answer to a query.

As explained, directional drilling may involve geosteering where one or more types of data may be utilized for optimizing control and/or results. In various instances, one or more functional relations may be utilized, which may depend on one or more types of data.

As an example, one or more functional relations may be calibrated and/or fine-tuned using offset well measurements of one or more of resistivity, acoustic impedance, and rock properties. As an example, one or more functional relations may be fine-tuned using well log measurements acquired while drilling (e.g., using one or more MWD tools) as may be acquired for a borehole trajectory as being drilled and/or during tripping (e.g., running-in-hole (RIH) and/or pulling-out-of-hole (POOH)).

As explained, mud-pulse telemetry may be utilized as a method of transmitting data from one or more downhole tools (e.g., LWD tool, MWD tool, etc.) to surface. Mud-pulse telemetry involves using pressure pulses in the mud system (e.g., within drillpipe, in an annulus, etc.). As an example, measurements may be converted into an amplitude- or frequency-modulated pattern of mud pulses. As an example, mud-pulse telemetry system may be used to transmit commands from the surface to one or more downhole tools (e.g., LWD tool, MWD tool, mud motor, bent sub, RSS tool, etc.). As an example, geosteering may be performed using mud-pulse telemetry for transmission of one or more control commands from surface to downhole to cause one or more pieces of downhole equipment to perform one or more actions (e.g., to direct a drill bit in particular direction, etc.).

As an example, a real-time process for characterizing a subsurface region using resistivity data may be performed according to a telemetry time and a computational time. As to a telemetry time, it may depend on length of a borehole. As to a computational time, it may depend on available computational resources. As an example, where a drillstring includes computational resources sufficient to perform such characterizing, telemetry time may be minimal, whether accomplished via wire and/or mud-pulse technologies. As an example, a drillstring may include one or more components with computational resources sufficient to implement at least a portion of a framework, which may provide, for example, generation of control commands for geosteering. In such an approach, geosteering may be performed using downhole computations without delay (e.g., latency) associated with transmissions uphole (e.g., to surface) and/or downhole (e.g., to relevant downhole equipment of a drillstring).

As an example, one or more components of a framework may utilize one or more machine learning models. For example, consider a machine learning model that may be utilized to assess, compare, match, etc., one or more datasets, types of data, etc. As an example, an image-based approach may be utilized, which may provide for single or multidimensional reservoir property generation and/or application.

As explained, knowledge of what lies ahead can be beneficial in drilling, particularly where the knowledge of what lies ahead extends a sufficient distance (in one or more dimensions) to meaningfully allow for practical decisions in drilling. As an example, a framework may provide for real-time and/or near real-time output that is actionable given constraints in drilling, which may include ROP, borehole quality, length of stands, number of drillpipes per stand, etc. As an example, a framework may provide for at least a stand ahead improved view of a subsurface region with respect to at least one or more properties. As an example, consider a two to three stands ahead improved view of a subsurface region, where, for example, the view may be accompanied by uncertainty, which may facilitate decision-making, control, etc., of drilling.

As to types of machine learning models, consider one or more of a support vector machine (SVM) model, a k-nearest neighbors (KNN) model, an ensemble classifier model, a neural network (NN) model, etc. As an example, a machine learning model may be a deep learning model (e.g., deep Boltzmann machine, deep belief network, convolutional neural network, stacked auto-encoder, etc.), an ensemble model (e.g., random forest, gradient boosting machine, bootstrapped aggregation, AdaBoost, stacked generalization, gradient boosted regression tree, etc.), a neural network model (e.g., radial basis function network, perceptron, back-propagation, Hopfield network, etc.), a regularization model (e.g., ridge regression, least absolute shrinkage and selection operator, elastic net, least angle regression), a rule system model (e.g., cubist, one rule, zero rule, repeated incremental pruning to produce error reduction), a regression model (e.g., linear regression, ordinary least squares regression, stepwise regression, multivariate adaptive regression splines, locally estimated scatterplot smoothing, logistic regression, etc.), a Bayesian model (e.g., naïve Bayes, average on-dependence estimators, Bayesian belief network, Gaussian naïve Bayes, multinomial naïve Bayes, Bayesian network), a decision tree model (e.g., classification and regression tree, iterative dichotomiser 3, C4.5, C5.0, chi-squared automatic interaction detection, decision stump, conditional decision tree, M5), a dimensionality reduction model (e.g., principal component analysis, partial least squares regression, Sammon mapping, multidimensional scaling, projection pursuit, principal component regression, partial least squares discriminant analysis, mixture discriminant analysis, quadratic discriminant analysis, regularized discriminant analysis, flexible discriminant analysis, linear discriminant analysis, etc.), an instance model (e.g., k-nearest neighbor, learning vector quantization, self-organizing map, locally weighted learning, etc.), a clustering model (e.g., k-means, k-medians, expectation maximization, hierarchical clustering, etc.), etc.

As an example, a machine model, which may be a machine learning model (ML model), may be built using a computational framework with a library, a toolbox, etc., such as, for example, those of the MATLAB framework (MathWorks, Inc., Natick, Massachusetts). The MATLAB framework includes a toolbox that provides supervised and unsupervised machine learning algorithms, including support vector machines (SVMs), boosted and bagged decision trees, k-nearest neighbor (KNN), k-means, k-medoids, hierarchical clustering, Gaussian mixture models, and hidden Markov models. Another MATLAB framework toolbox is the Deep Learning Toolbox (DLT), which provides a framework for designing and implementing deep neural networks with algorithms, pretrained models, and apps. The DLT provides convolutional neural networks (ConvNets, CNNs) and long short-term memory (LSTM) networks to perform classification and regression on image, time-series, and text data. The DLT includes features to build network architectures such as generative adversarial networks (GANs) and Siamese networks using custom training loops, shared weights, and automatic differentiation. The DLT provides for model exchange various other frameworks.

As an example, the TENSORFLOW framework (Google LLC, Mountain View, CA) may be implemented, which is an open-source software library for dataflow programming that includes a symbolic math library, which may be implemented for machine learning applications that may include neural networks. As an example, the CAFFE framework may be implemented, which is a DL framework developed by Berkeley AI Research (BAIR) (University of California, Berkeley, California). As another example, consider the SCIKIT platform (e.g., scikit-learn), which utilizes the PYTHON programming language. As an example, a framework such as the APOLLO AI framework may be utilized (APOLLO.AI GmbH, Germany). As an example, a framework such as the PYTORCH framework may be utilized (Facebook AI Research Lab (FAIR), Facebook, Inc., Menlo Park, California).

As an example, a training method may include various actions that may operate on a dataset to train an ML model. As an example, a dataset may be split into training data and test data where test data may provide for evaluation. A method may include cross-validation of parameters and best parameters, which may be provided for model training.

The TENSORFLOW framework may run on multiple CPUs and GPUs (with optional CUDA (NVIDIA Corp., Santa Clara, California) and SYCL (The Khronos Group Inc., Beaverton, Oregon) extensions for general-purpose computing on graphics processing units (GPUs)). TENSORFLOW is available on 64-bit LINUX, MACOS (Apple Inc., Cupertino, California), WINDOWS (Microsoft Corp., Redmond, Washington), and mobile computing platforms including ANDROID (Google LLC, Mountain View, California) and IOS (Apple Inc.) operating system-based platforms.

TENSORFLOW computations may be expressed as stateful dataflow graphs; noting that the name TENSORFLOW derives from the operations that such neural networks perform on multidimensional data arrays. Such arrays may be referred to as "tensors".

As an example, a device may utilize TENSORFLOW LITE (TFL) or another type of lightweight framework. For example, consider a gateway that may be in the field (e.g., on-site) and that may utilize the TFL and/or one or more other types of lightweight frameworks. The TFL framework is a set of tools that enables on-device machine learning where models may run on mobile, embedded, and IoT devices. The TFL framework is optimized for on-device machine learning, by addressing latency (no round-trip to a server), privacy (no personal data leaves the device), connectivity (Internet connectivity is demanded), size (reduced model and binary size) and power consumption (e.g., efficient inference and a lack of network connections). The TFL framework offers multiple platform support, covering ANDROID and iOS devices, embedded LINUX, and microcontrollers. The TFL framework offers diverse language support includes JAVA, SWIFT, Objective-C, C++, and PYTHON. The TFL framework may provide high performance via hardware acceleration and model optimization.

Figure 20:
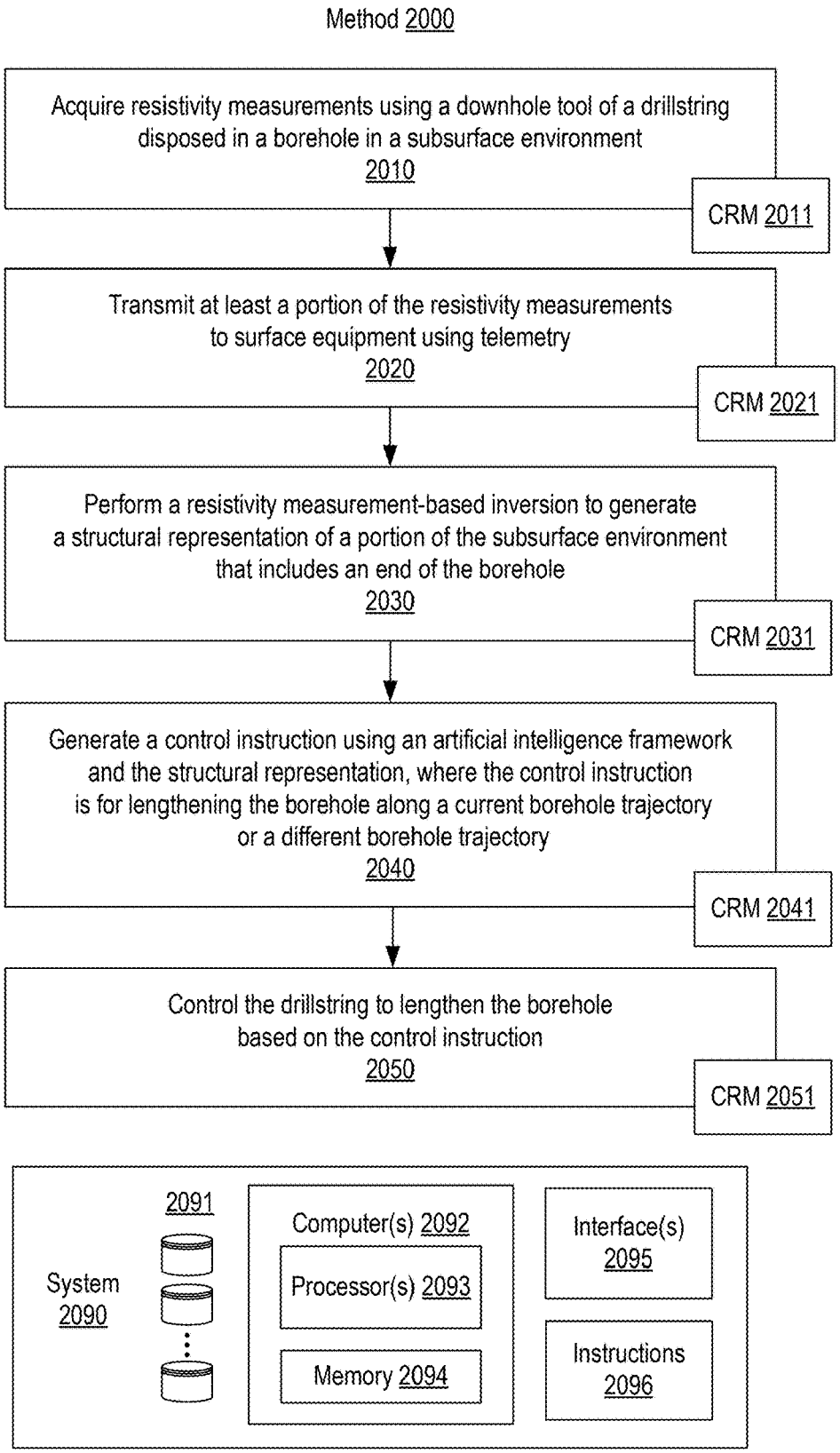
FIG. 20 illustrates an example of a method and an example of a system.

FIG. 20 shows an example of a method 2000 that includes an acquisition block 2010 for acquiring resistivity measurements using a downhole tool of a drillstring disposed in a borehole in a subsurface environment; an optional transmission block 2020 for transmitting at least a portion of the resistivity measurements to surface equipment using telemetry (e.g., consider a downhole implementation performed without telemetry to surface); a performance block 2030 for performing a resistivity measurement-based inversion to generate a structural representation of a portion of the subsurface environment that includes an end of the borehole; a generation block 2040 for generating a control instruction using an artificial intelligence framework and the structural representation, where the control instruction is for lengthening the borehole along a current borehole trajectory or a different borehole trajectory; and a control block 2050 for controlling the drillstring to lengthen the borehole based on the control instruction.

The method 2000 of FIG. 20 is shown as including various computer-readable storage medium (CRM) blocks 2011, 2021, 2031, 2041, and 2051 that may include processor-executable instructions that may instruct a computing system, which may be a control system, to perform one or more of the actions described with respect to the method 2000.

As shown in the example of FIG. 20, the system 2090 may include one or more computers 2092 that include one or more processors 2093, memory 2094 operatively coupled to at least one of the one or more processors 2093, instructions 2096 that may be, for example, stored in the memory 2094, and one or more interfaces 2095 (e.g., one or more network interfaces and/or other interfaces). As an example, the system 2090 may include one or more processor-readable media that include processor-executable instructions executable by at least one of the one or more processors 2093 to cause the system 2090 to perform actions such as, for example, one or more actions of the method 2000. As an example, the instructions 2096 may include instructions of one or more of the CRM blocks 2011, 2021, 2031, 2041, and 2051. The memory 2094 may be or include the one or more processor-readable media where the processor-executable instructions may be or include instructions. As an example, a processor-readable medium may be a computer-readable storage medium that is non-transitory that is not a signal and that is not a carrier wave.

As an example, the system 2090 may include subsystems. For example, the system 2090 may include a plurality of subsystems that may operate using equipment that is distributed where a subsystem may be referred to as being a system. For example, consider a downhole tool system and a surface system. As an example, one or more operations of the block 2050 of the method 2000 may be performed using a downhole tool system (e.g., consider in integrated controller in a drillstring). The method 2000 may be implemented using, for example, a downhole system and/or a surface system, which may be a cloud-based or cloud-coupled system.

As an example, a method can include receiving data acquired via a drillstring in a borehole in a subsurface environment; determining boundary locations for formations in the subsurface environment using at least a portion of the data, where an end of the borehole is disposed in one of the formations; determining extended boundary locations in the subsurface environment for a region beyond the end of the borehole using the boundary locations; determining a target location in the region; generating a trajectory from an end of the borehole location to the target location; and executing a directional drilling system to control directional drilling of the drillstring that extends the borehole beyond the end of the borehole towards the target location. As an example, a directional drilling system may include one or more types of equipment (e.g., a mud motor, an RSS, etc.).

As an example, boundary locations for formations may be automatically interpreted using data. As an example, extended boundary locations may be automatically predicted by automatically extending boundary locations into a region.

As an example, a method can include determining a target location that includes selecting a location with respect to at least one boundary at a distance beyond an end of a borehole location. As an example, a target location may be defined using one or more values, for example, consider a point, a line, a 2D surface, a 3D surface, etc. As an example, a method may determine and/or account for tolerances or uncertainties of a boundary position and/or a bottom hole position, for example, to generate a target location within a safety margin. As an example, a target location may be automatically determined.

As an example, determining the boundary locations may include using a machine learning model to automatically identify a top boundary or a bottom boundary with respect to an end of a borehole location. As an example, determining extended boundary locations may include predicting the extended boundary locations using a machine learning model. As an example, a machine learning model may be pre-trained, trained on the job, etc. As an example, a machine learning model may be a local model for a borehole, a field model, or a global model. As an example, a model may be trained to make it more local in character.

As an example, determining a target location can include using a machine learning model to automatically determine the target location. As an example, generating a trajectory may include using a pre-trained machine learning model to automatically generate the trajectory.

As an example, a method may include automatically transmitting a trajectory to a directional drilling system. In such an example, automatically transmitting may occur responsive to generating the trajectory or responsive to actuation of a graphical control of a graphical user interface via a human-machine interface.

As an example, a trajectory may include associated instructions for instructing a directional drilling system, where, for example, the trajectory and the associated instructions form a working plan. As an example, a working plan may be or include a trajectory from a current hole bottom position to a target. As an example, a command scheduler may provide for transforming a trajectory into a set of drilling instructions. As an example, a trajectory may include associated instructions for instructing a directional drilling system, where, for example, the trajectory and associated instructions form a drilling command sequence to control the directional drilling system.

As an example, a method may include displaying a working plan; receiving a modification to the working plan; and updating the working plan in response to the modification.

As an example, a method may include receiving additional data acquired via a drillstring in a borehole in response to directional drilling towards a target location; automatically modifying the trajectory or associated instructions for instructing the directional drilling system in response to at least a portion of the additional data; and executing the directional drilling system according to the modified trajectory or associated instructions for further directional drilling that extends the borehole. In such an example, modifying may include selecting a different target location or adjusting the trajectory.

As an example, a method may include receiving additional data acquired via a drillstring in a borehole in response to directional drilling towards a target location; analyzing the additional data with respect to one or more extended boundary locations; and, based on the analyzing, deciding to maintain directional drilling toward the target location, where the target location may be between extended boundary locations for a reservoir zone.

As an example, a method may include rendering a graphical user interface to a display where the graphical user interface includes graphical controls actuatable for selection of automated or manual determining of one or more boundary locations, actuatable for selection of automated or manual determining of one or more extended boundary locations, and actuatable for selection of automated or manual generation of a target location. In such an example, the method may, responsive to selection of automated determining of one or more boundary locations, automated determining of one or more extended boundary locations, and automated generation of the target location, automatically executing a directional drilling system to control directional drilling of drillstring.

As an example, a system can include a memory to store data and instructions; and a processor operable to communicate with the memory, where the processor is operable to: receive data acquired via a drillstring in a borehole in a subsurface environment; determine boundary locations for formations in the subsurface environment using the data, where an end of the borehole is disposed in one of the formations; determine extended boundary locations in the subsurface environment for a region beyond the end of the borehole using the boundary locations; determine a target location in the region; generate a trajectory from an end of the borehole location to the target location; and execute a directional drilling system to control directional drilling of the drillstring that extends the borehole beyond the end of the borehole towards the target location.

As an example, a computer-readable storage medium can include instructions that, when executed by a processor, cause the processor to: receive measurements obtained from a drilling tool assembly in a borehole; interpret boundaries for formations in the borehole using the measurements; predict locations for additional formations in the borehole using the boundaries; identify a target using the locations for additional formations in the borehole; generate a working plan with a path to the target; and send, to a directional drilling system, the working plan to cause a drill bit of the drilling tool assembly to drill to extend the borehole towards the target.

As an example, a method can include acquiring resistivity measurements using a downhole tool of a drillstring disposed in a borehole in a subsurface environment; performing a resistivity measurement-based inversion to generate a structural representation of a portion of the subsurface environment that includes an end of the borehole; generating a control instruction using an artificial intelligence framework and the structural representation, where the control instruction is for lengthening the borehole along a current borehole trajectory or a different borehole trajectory; and controlling the drillstring to lengthen the borehole based on the control instruction. As an example, such a method may include use of one or more downhole artificial intelligence components and/or one or more surface artificial intelligence components. As an example, a drillstring may include one or more components with a processor and memory cable of executing one or more machine learning models. As an example, a system may provide for downhole closed-loop control of one or more aspects of drilling, particularly directional drilling, for example, using geosteering.

As an example, an inversion may involve a process whereby data are utilized to generate a structural model. For example, consider spatially distributed log data as acquired using one or more downhole tools where an inversion of such log data may generate a structural model, which may provide for identification of one or more subsurface structural features (e.g., one or more boundaries, etc.).

As an example, a method can include determining at least a portion of resistivity measurements for use downhole using circuitry of the downhole tool. For example, consider selection of certain measurements downhole prior to use for one or more purposes, transmission for one or more purposes, etc. As an example, determining may include assessing a dimensional characteristic of a subsurface environment in a region about a borehole. For example, consider a dimensional characteristic as being a one-dimensional characteristic or a non-one-dimensional characteristic.

As an example, resistivity measurements may include shallow, medium, and deep classes of resistivity measurements. In such an example, at least a portion of the resistivity measurements may include a downhole tool-based automated selection of one or more of the shallow, medium, and deep classes of resistivity measurements. In such an example, the downhole tool may be an intelligent tool that facilitates data selection for one or more purposes.

As an example, generating of a control instruction may be based at least in part on mechanical properties of a borehole and rock properties of a subsurface environment. As an example, a method may utilize one or more metrics, constraints, etc., in generating. For example, consider one or more constraints of a completions system, information from one or more other wells (e.g., location, etc.), etc. As an example, generating a control instruction may be based at least in part on drilling mechanics that depend on one or more of rate of penetration, rotation per minute of a drill bit, and weight on the drill bit. As an example, a control instruction may pertain to drilling, directional drilling, etc.

As an example, a control instruction may be for lengthening a borehole along a different borehole trajectory, where, for example, execution of the control instruction adjusts an angle of a drill bit of the drillstring. In such an example, the angle may be a build angle or a drop angle. As an example, a control instruction may be for lengthening a borehole along a current trajectory, where, for example, execution of the control instruction holds an angle of a drill bit of the drillstring.

As an example, a control instruction may be associated with one or more other control instructions for one or more pieces of surface equipment. For example, consider one or more pieces of surface equipment that may include one or more of a top drive for rotational control, a drawworks for weight on bit control, and a mud pump for drilling fluid flow control.

As an example, generating an instruction may include interpreting one or more boundaries for formations in a subsurface environment, where, for example, a pay zone exists between two of the boundaries, and where controlling a drillstring to lengthen a borehole lengthens the borehole in the pay zone.

As an example, an instruction may pertain to a distance or distances from a single boundary. For example, consider an instruction that assures that a drill bit does not come within a certain distance of a boundary and/or that the drill bit remains within a certain distance of a boundary. In such an approach, a trajectory may be constrained relative to a single boundary or multiple boundaries.

As an example, generating an instruction may include predicting formation locations beyond an end of a borehole in a subsurface environment using one or more boundaries. In such an example, generating may include identifying a target using the predicted formation locations beyond the end of the borehole. In such an example, generating may include creating a working plan with a path to the target. In such an example, controlling a drillstring may lengthen the borehole in a pay zone along the path to the target.

As an example, a system can include a processor; memory accessible to the processor; and processor-executable instructions stored in the memory and executable by the processor to instruct the system to: acquire resistivity measurements using a downhole tool of a drillstring disposed in a borehole in a subsurface environment; perform a resistivity measurement-based inversion to generate a structural representation of a portion of the subsurface environment that includes an end of the borehole; generate a control instruction using an artificial intelligence framework and the structural representation, where the control instruction is for lengthening the borehole along a current borehole trajectory or a different borehole trajectory; and control the drillstring to lengthen the borehole based on the control instruction.

As an example, one or more non-transitory computer-readable storage media can include processor-executable instructions executable to instruct a processor to: acquire resistivity measurements using a downhole tool of a drillstring disposed in a borehole in a subsurface environment; perform a resistivity measurement-based inversion to generate a structural representation of a portion of the subsurface environment that includes an end of the borehole; generate a control instruction using an artificial intelligence framework and the structural representation, where the control instruction is for lengthening the borehole along a current borehole trajectory or a different borehole trajectory; and control the drillstring to lengthen the borehole based on the control instruction.

As an example, a method can include rendering a graphical user interface to a display; receiving data acquired by a drillstring disposed in a borehole in a subsurface environment; responsive to determining boundary locations for formations in the subsurface environment using the data, automatically rendering the boundary locations in the graphical user interface along with graphic representations of the data for visual quality assessment of the boundary locations and a first graphical control actuatable for interactive adjustment of the boundary locations; responsive to determining extended boundary locations in the subsurface environment for a region beyond an end of the borehole using the boundary locations, automatically rendering the extended boundary locations in the graphical user interface for visual quality assessment of the extended boundary locations along with a second graphical control actuatable for interactive adjustment of the extended boundary locations; responsive to determining a target location in the region using the extended boundary locations, automatically rendering the target location in the graphical user interface for visual quality assessment of the target location along with a third graphical control actuatable for interactive adjustment of the target location; and, responsive to generation of a trajectory from an end of the borehole location to the target location, automatically rendering the trajectory in the graphical user interface for visual quality assessment of the trajectory along with a fourth graphical control actuatable for interactive adjustment of the trajectory.

In such an example, the method may include performing directional drilling to extend the borehole beyond an end of the borehole along the trajectory and, responsive to receiving additional data during the directional drilling, rendering an updated end of the borehole location to the graphical user interface. In such an example, the method may include rendering a fifth graphical control actuatable for interactive adjustment of one or more of the trajectory and the target location.

As an example, data may include resistivity data. As an example, data may include resistivity data and other data, which may be log data acquired using one or more downhole tools.

As an example, a method may include updating graphic representations of data dynamically responsive to receiving additional data. In such an example, receiving additional data may occur in real-time.

As an example, a method may include, responsive to non-actuation of a fourth graphical control, instructing a directional drilling system to commence directional drilling based at least in part on a trajectory. In such an example, non-actuation may occur in a connection period where one or more segments of drillpipe are added to the drillstring.

As an example, a method may include rendering a graphical control to a graphical user interface actuatable to instruct a directional drilling system to commence directional drilling.

As an example, a method may include rendering a graphic representation of a location of a bit of a drillstring to a graphical user interface.

As an example, a method may include rendering indica of uncertainty and/or one or more uncertainty, probability, statistical, etc., metrics to a graphical user interface, which may pertain to spatial aspects for directional drilling. For example, consider uncertainty in the position of a boundary, an extended boundary, a target, etc.

As an example, a method may include rendering a graphic representation of a planned trajectory to a graphical user interface, which may be rendered with or without uncertainty, etc.

As an example, a method may include rendering one or more of attitude, curvature, structural dip, total vertical depth, measured depth, direction, and inclination to a graphical user interface, where, during directional drilling, the rendering occurs in real-time responsive to receiving corresponding values.

As an example, a method may include rendering indicia of uncertainty in extended boundary locations to a graphical user interface. In such an example, the indicia may be automatically updated in real-time, for example, as drilling occurs, measurements are received, further modeling performed, etc. As explained, a bootstrapped approach may be utilized for resistivity data in going from shallow to medium to deep to successive improve a model. In such an approach, a model may progressively improve with respect to time such that a more accurate model is generated. For example, when commencing drilling for a new stand of drillpipe, the location of the end of the borehole may be known with some higher amount of certainty along with surrounding structure whereas along a trajectory, uncertainty may exist. During drilling of the stand, the uncertainty may be reduced in a bootstrapped manner as shallow data are received, followed by medium data, and then deep data. In such an approach, a rendering may be updated in real-time to facilitate real-time drilling control for the stand being drilled (e.g., toward a target, which may be revised, as appropriate, based on updates in structure, etc.).

As an example, a method may include rendering indicia of uncertainty in a target location to a graphical user interface. As an example, a method may include rendering of uncertainty of measurements (e.g., resistivity, etc.), which may carry over to uncertainty of one or more boundaries. As an example, a method may include rendering indicia of uncertainty in a trajectory to a graphical user interface. For example, consider a cone approach where the uncertainty increases in a direction away from an end of a borehole.

As an example, a method may include rendering one or more real-time drilling parameters of a directional drilling system to a graphical user interface. For example, consider one or more real-time drilling parameters that may include one or more of rotational speed, torque, weight-on-bit, and rate of penetration.

As an example, a method may include rendering a graphical control for selection of one or more types of resistivity data, where the types depend on a distance of investigation about a borehole.

As an example, a method may include rendering a graphical control for selection of a level of automation (e.g., along a spectrum from manual to fully-automated or binary manual or automated). In such an approach, the graphical control may relate to quality control (QC) of one or more aspects of directional drilling. As an example, a high-level autonomous mode may be enabled or disabled within each of a number of different tasks in a workflow (e.g., within each automation task as to boundary identification, boundary extend, target generation, etc.).

As an example, graphical elements may be rendered as to status of an automation cycle, one or more past history of decisions, approval of a workflow, panels that may be selected to be shareable for customer collaboration, other measurement, other measurement interpretations, etc.

As an example, a system can include a processor; memory accessible to the processor; and processor-executable instructions stored in the memory and executable by the processor to instruct the system to: render a graphical user interface to a display; receive data acquired by a drillstring disposed in a borehole in a subsurface environment; responsive to determination of boundary locations for formations in the subsurface environment using the data, automatically render the boundary locations in the graphical user interface along with graphic representations of the data for visual quality assessment of the boundary locations and a first graphical control actuatable for interactive adjustment of the boundary locations; responsive to determination of extended boundary locations in the subsurface environment for a region beyond an end of the borehole using the boundary locations, automatically render the extended boundary locations in the graphical user interface for visual quality assessment of the extended boundary locations along with a second graphical control actuatable for interactive adjustment of the extended boundary locations; responsive to determination of a target location in the region using the extended boundary locations, automatically render the target location in the graphical user interface for visual quality assessment of the target location along with a third graphical control actuatable for interactive adjustment of the target location; and, responsive to generation of a trajectory from an end of the borehole location to the target location, automatically render the trajectory in the graphical user interface for visual quality assessment of the trajectory along with a fourth graphical control actuatable for interactive adjustment of the trajectory.

As an example, one or more non-transitory computer-readable storage media can include processor-executable instructions executable to instruct a processor to: render a graphical user interface to a display; receive data acquired by a drillstring disposed in a borehole in a subsurface environment; responsive to determination of boundary locations for formations in the subsurface environment using the data, automatically render the boundary locations in the graphical user interface along with graphic representations of the data for visual quality assessment of the boundary locations and a first graphical control actuatable for interactive adjustment of the boundary locations; responsive to determination of extended boundary locations in the subsurface environment for a region beyond an end of the borehole using the boundary locations, automatically render the extended boundary locations in the graphical user interface for visual quality assessment of the extended boundary locations along with a second graphical control actuatable for interactive adjustment of the extended boundary locations; responsive to determination of a target location in the region using the extended boundary locations, automatically render the target location in the graphical user interface for visual quality assessment of the target location along with a third graphical control actuatable for interactive adjustment of the target location; and, responsive to generation of a trajectory from an end of the borehole location to the target location, automatically render the trajectory in the graphical user interface for visual quality assessment of the trajectory along with a fourth graphical control actuatable for interactive adjustment of the trajectory.

In some implementations, a method includes receiving measurements obtained from a drilling tool assembly in a well. The method includes interpreting boundaries for formations in the well using the measurements. The method includes predicting formation locations ahead in the well using the boundaries. The method includes identifying a target using the predicted formation locations ahead in the well. The method includes generating a working plan with a path to the target. The method includes sending, to a directional drilling system, the working plan to cause a drill bit of the drilling tool assembly to drill towards the target.

In some implementations, the method includes the boundaries for the formations are automatically interpreted using the measurements.

In some implementations, the method includes the formation locations ahead are automatically predicted by automatically extending the boundaries for the formations in front of the drill bit.

In some implementations, the method includes predicting formation locations ahead by extending the boundaries for the formations in front of the drill bit.

In some implementations, the method includes identifying the target by selecting a location within the boundaries at a distance in front of the drill bit.

In some implementations, the method includes the target is automatically identified and the location is automatically selected within the boundaries at the distance in front of the drill bit.

In some implementations, the method includes interpreting boundaries for the formations using a pre-trained machine learning model to automatically identify a top boundary or a bottom boundary for the formations. In some implementations, the method includes predicting formation locations ahead using a pre-trained machine learning model to automatically predict the formation locations ahead in the well. In some implementations, the method includes identifying the target using a pre-trained machine learning model to automatically identify the target. In some implementations, the method includes generating the working plan using a pre-trained machine learning model to automatically generate the working plan with the path to the target.

In some implementations, the method includes the working plan is automatically sent to the directional drilling system to cause the drill bit of the drilling tool assembly to drill towards the target. In some implementations, the method includes instructions for the drill bit to automatically drill to the target along the path using the instructions.

In some implementations, the method includes displaying the working plan and the path; receiving a modification to the working plan; and updating the working plan in response to the modification.

In some implementations, the method includes receiving updated measurements from the drilling tool assembly in response to the drill bit drilling along the path; automatically modifying the working plan in response to the updated measurements; and sending, to the directional drilling system, a modified working plan to cause the drill bit to drill along the modified working plan.

In some implementations, the method includes modifying the working plan by selecting a different target or adjusting the path.

In some implementations, the method includes receiving updated measurements from the drilling tool assembly in response to the drill bit drilling along the path; and maintaining the working plan in response to the updated measurements.

In some implementations, the system includes a memory to store data and instructions; and a processor operable to communicate with the memory, where the processor is operable to: receive measurements obtained from a drilling tool assembly in a well; interpret boundaries for formations in the well using the measurements; predict formation locations ahead in the well using the boundaries; identify a target using the predicted formation locations ahead in the well; generate a working plan with a path to the target; and send, to a directional drilling system, the working plan to cause a drill bit of the drilling tool assembly to drill towards the target.

In some implementations, a computer-readable storage medium including instructions that, when executed by a processor, cause the processor to: receive measurements obtained from a drilling tool assembly in a well; interpret boundaries for formations in the well using the measurements; predict formation locations ahead in the well using the boundaries; identify a target using the predicted formation locations ahead in the well; generate a working plan with a path to the target; and send, to a directional drilling system, the working plan to cause a drill bit of the drilling tool assembly to drill towards the target.

In some implementations, a method includes picking boundaries for formations in a well in response to receiving measurements obtained from a wellsite. The method includes predicting formation locations ahead in the well using the boundaries. The method includes generating a working plan with a path to a target in the well. The method includes sending, to a directional drilling system, the working plan to cause a drill bit to drill towards the target.

In some implementations, the method includes receiving a modification to the boundaries; and predicting the formation locations ahead using modified boundaries.

In some implementations, the method includes receiving a modification to the formation locations ahead in the well; and generating the working plan using modified formation locations.

In some implementations, the method includes receiving a modification to the working plan; and sending a modified working plan to the directional drilling system.

In some implementations, a system includes a memory to store data and instructions; and a processor operable to communicate with the memory, where the processor is operable to: pick boundaries for formations in a well in response to receiving measurements obtained from a wellsite; predict formation locations ahead in the well using the boundaries; generate a working plan with a path to a target in the well; and send, to a directional drilling system, the working plan to cause a drill bit to drill towards the target.

In some implementations, a computer-readable storage medium including instructions that, when executed by a processor, cause the processor to: pick boundaries for formations in a well in response to receiving measurements obtained from a wellsite; predict formation locations ahead in the well using the boundaries; generate a working plan with a path to a target in the well; and send, to a directional drilling system, the working plan to cause a drill bit to drill towards the target.

In some implementations, a method includes receiving measurements obtained from a drilling tool assembly in a well. The method includes automatically interpreting boundaries for formations in the well using the measurements. The method includes automatically predicting locations for additional formations in the well using the boundaries. The method includes automatically identifying a target using the locations for additional formations in the well. The method includes generating a working plan with a path to the target. The method includes sending, to a directional drilling system, the working plan to cause a drill bit of the drilling tool assembly to drill towards the target.

In some implementations, the method includes automatically predicting locations for additional formations by extending the boundaries for the formations in front of the drill bit.

In some implementations, the method includes identifying the target by selecting a location within the boundaries at a distance in front of the drill bit.

In some implementations, the method includes automatically interpreting boundaries for the formations using a pre-trained machine learning model to identify a top boundary and a bottom boundary for the formations.

In some implementations, the method includes the working plan including instructions for the drill bit to automatically drill to the target along the path using the instructions.

In some implementations, the method includes displaying the working plan and the path; receiving a modification to the working plan; and updating the working plan in response to the modification.

In some implementations, the method includes receiving updated measurements from the drilling tool assembly in response to the drill bit drilling along the path; automatically modifying the working plan in response to the updated measurements; and sending, to the directional drilling system, a modified working plan to cause the drill bit to drill along the modified working plan. In some implementations, the method includes modifying the working plan includes by selecting a different target or adjusting the path.

In some implementations, the method includes receiving updated measurements from the drilling tool assembly in response to the drill bit drilling along the path; and maintaining the working plan in response to the updated measurements.

In some implementations, a system includes a memory to store data and instructions; and a processor operable to communicate with the memory, where the processor is operable to: receive measurements obtained from a drilling tool assembly in a well; automatically interpret boundaries for formations in the well using the measurements; automatically predict locations for additional formations in the well using the boundaries; automatically identify a target using the locations for additional formations in the well; generate a working plan with a path to the target; and send, to a directional drilling system, the working plan to cause a drill bit of the drilling tool assembly to drill towards the target.

In some implementations, a computer-readable storage medium including instructions that, when executed by a processor, cause the processor to: receive measurements obtained from a drilling tool assembly in a well; automatically interpret boundaries for formations in the well using the measurements; automatically predict locations for additional formations in the well using the boundaries; automatically identify a target using the locations for additional formations in the well; generate a working plan with a path to the target; and send, to a directional drilling system, the working plan to cause a drill bit of the drilling tool assembly to drill towards the target.

Various examples of implementations of a geosteering service and a directional drilling system have been primarily described with reference to wellbore drilling operations; the geosteering service and a directional drilling system described herein may be used in applications other than the drilling of a wellbore. In other implementations, a geosteering service and a directional drilling system may be used outside a wellbore or other downhole environment used for the exploration or production of natural resources or, for example, storage of material (e.g., consider carbon sequestration). As an example, a Geosteering service and a directional drilling system may be used in a borehole used for placement of utility lines.

As an example, one or more computer-readable storage media may include processor-executable instructions to instruct a computing system to perform one or more methods. In such an example, the one or more computer-readable storage media may be a program product (e.g., a computer program product, a computer system program product, etc.).

Figure 21:
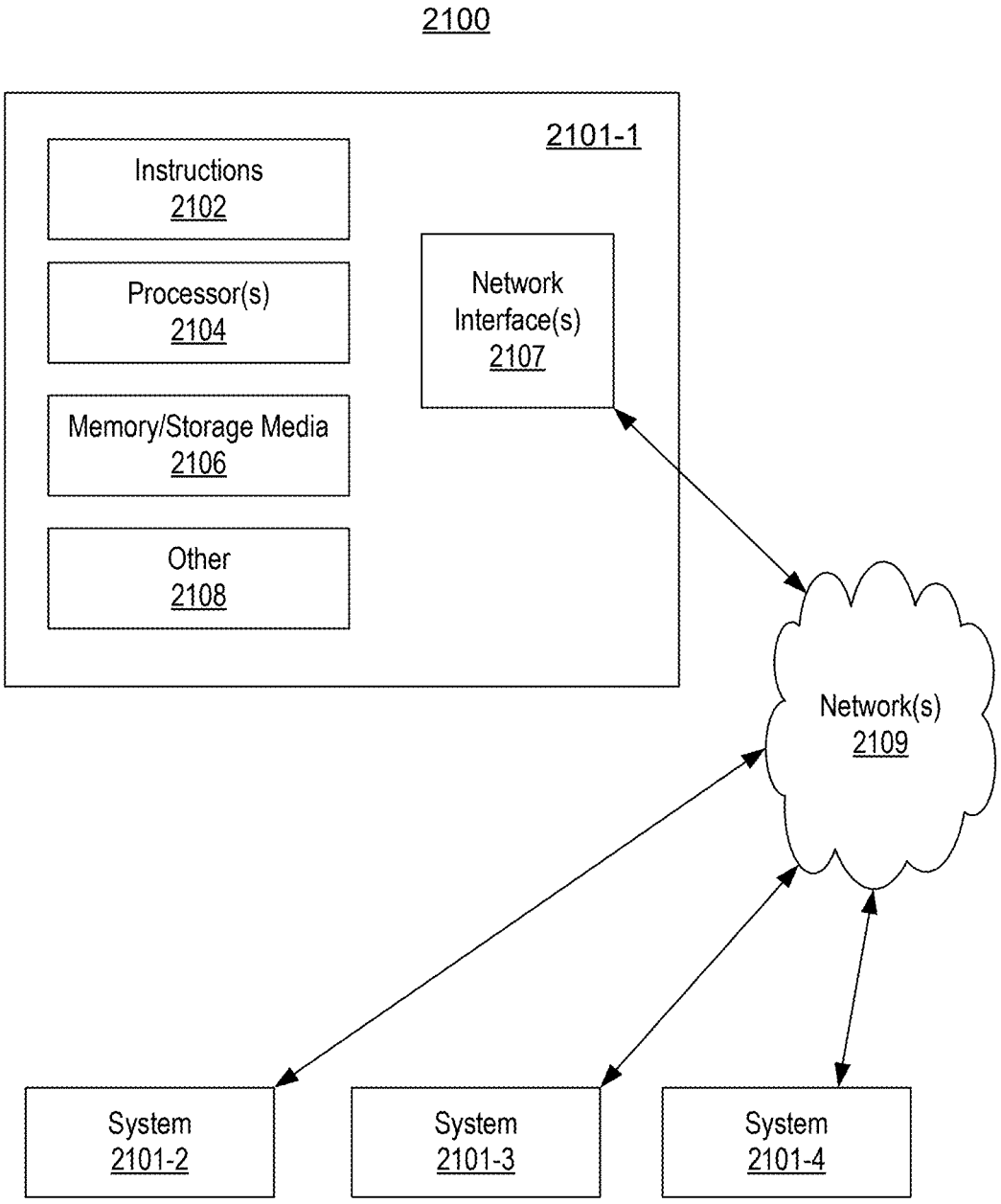
FIG. 21 illustrates examples of computing and networking equipment.

In some embodiments, a method or methods may be executed by a computing system. FIG. 21 shows an example of a system 2100 that may include one or more computing systems 2101-1, 2101-2, 2101-3 and 2101-4, which may be operatively coupled via one or more networks 2109, which may include wired and/or wireless networks.

As an example, a system may include an individual computer system or an arrangement of distributed computer systems. In the example of FIG. 21, the computer system 2101-1 may include one or more sets of instructions 2102, which may be or include processor-executable instructions, for example, executable to perform various tasks (e.g., receiving information, requesting information, processing information, simulation, outputting information, etc.).

As an example, a set of instructions may be executed independently, or in coordination with, one or more processors 2104, which is (or are) operatively coupled to one or more storage media 2106 (e.g., via wire, wirelessly, etc.). As an example, one or more of the one or more processors 2104 may be operatively coupled to at least one of one or more network interface 2107. In such an example, the computer system 2101-1 may transmit and/or receive information, for example, via the one or more networks 2109 (e.g., consider one or more of the Internet, a private network, a cellular network, a satellite network, etc.). As shown, one or more other components 2108 may be included.

As an example, the computer system 2101-1 may receive from and/or transmit information to one or more other devices, which may be or include, for example, one or more of the computer systems 2101-2, etc. A device may be located in a physical location that differs from that of the computer system 2101-1. As an example, a location may be, for example, a processing facility location, a data center location (e.g., server farm, etc.), a rig location, a wellsite location, a downhole location, etc.

As an example, a processor may be or include a microprocessor, microcontroller, processor component or subsystem, programmable integrated circuit, programmable gate array, or another control or computing device.

As an example, the storage media 2106 may be implemented as one or more computer-readable or machine-readable storage media. As an example, storage may be distributed within and/or across multiple internal and/or external enclosures of a computing system and/or additional computing systems.

As an example, a storage medium or storage media may include one or more different forms of memory including semiconductor memory devices such as dynamic or static random access memories (DRAMs or SRAMs), erasable and programmable read-only memories (EPROMs), electrically erasable and programmable read-only memories (EE- PROMs) and flash memories, magnetic disks such as fixed, floppy and removable disks, other magnetic media including tape, optical media such as compact disks (CDs) or digital video disks (DVDs), BLUERAY disks, or other types of optical storage, or other types of storage devices.

As an example, a storage medium or media may be located in a machine running machine-readable instructions, or located at a remote site from which machine-readable instructions may be downloaded over a network for execution.

As an example, various components of a system such as, for example, a computer system, may be implemented in hardware, software, or a combination of both hardware and software (e.g., including firmware), including one or more signal processing and/or application specific integrated circuits.

As an example, a system may include a processing apparatus that may be or include a general-purpose processors or application specific chips (e.g., or chipsets), such as ASICs, FPGAs, PLDs, or other appropriate devices.

As an example, a device may be a mobile device that includes one or more network interfaces for communication of information. For example, a mobile device may include a wireless network interface (e.g., operable via IEEE 802.11, ETSI GSM, BLUETOOTH, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

As an example, a system may be a distributed environment, for example, a so-called "cloud" environment where various devices, components, etc. interact for purposes of data storage, communications, computing, etc. As an example, a device or a system may include one or more components for communication of information via one or more of the Internet (e.g., where communication occurs via one or more Internet protocols), a cellular network, a satellite network, etc. As an example, a method may be implemented in a distributed environment (e.g., wholly or in part as a cloud-based service).

As an example, information may be input from a display (e.g., consider a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that may be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A method comprising:

acquiring resistivity measurements using a downhole tool of a drillstring disposed in a borehole in a subsurface environment;

performing a resistivity measurement-based inversion to generate a structural representation of a portion of the subsurface environment that includes an end of the borehole;

generating a control instruction using an artificial intelligence framework and the structural representation, wherein the control instruction is for lengthening the borehole along a current borehole trajectory or a different borehole trajectory; and controlling the drillstring to lengthen the borehole based on the control instruction.

2. The method of claim 1, comprising determining the at least a portion of the resistivity measurements downhole using circuitry of the downhole tool.

3. The method of claim 2, wherein the determining comprises assessing a dimensional characteristic of the subsurface environment in a region about the borehole.

4. The method of claim 3, wherein the dimensional characteristic comprises a one-dimensional characteristic or a non-one-dimensional characteristic.

5. The method of claim 1, wherein the resistivity measurements comprise shallow, medium, and deep classes of resistivity measurements.

6. The method of claim 5, wherein the at least a portion of the resistivity measurements comprise a downhole tool-based automated selection of one or more of the shallow, medium, and deep classes of resistivity measurements.

7. The method of claim 1, wherein the generating is based at least in part on mechanical properties of the borehole and based at least in part on rock properties of the subsurface environment.

8. The method of claim 7, wherein the generating is based at least in part on drilling mechanics that depend on one or more of rate of penetration, rotation per minute of a drill bit, and weight on the drill bit.

9. The method of claim 1, wherein the control instruction is for lengthening the borehole along a different borehole trajectory, execution of the control instruction adjusts an angle of a drill bit of the drillstring.

10. The method of claim 9, wherein the angle comprises a build angle or a drop angle.

11. The method of claim 1, wherein the control instruction is for lengthening the borehole along a current trajectory, execution of the control instruction holds an angle of a drill bit of the drillstring.

12. The method of claim 1, wherein the control instruction is associated with one or more other control instructions for one or more pieces of surface equipment.

13. The method of claim 12, wherein the one or more pieces of surface equipment comprise one or more of a top drive for rotational control, a drawworks for weight on bit control, and a mud pump for drilling fluid flow control.

14. The method of claim 1, wherein the generating comprises interpreting one or more boundaries for formations in the subsurface environment, wherein a pay zone exists between two of the boundaries, and wherein the controlling the drillstring to lengthen the borehole lengthens the borehole in the pay zone.

15. The method of claim 14, wherein the generating comprises predicting formation locations beyond an end of the borehole in the subsurface environment using one or more of the one or more boundaries.

16. The method of claim 15, wherein the generating comprises identifying a target using the predicted formation locations beyond the end of the borehole.

17. The method of claim 16, wherein the generating comprises creating a working plan with a path to the target.

18. The method of claim 17, wherein the controlling the drillstring lengthens the borehole in the pay zone along the path to the target.

19. A system comprising:

a processor;

memory accessible to the processor; and processor-executable instructions stored in the memory and executable by the processor to instruct the system to:

acquire resistivity measurements using a downhole tool of a drillstring disposed in a borehole in a subsurface environment;

perform a resistivity measurement-based inversion to generate a structural representation of a portion of the subsurface environment that includes an end of the borehole;

generate a control instruction using an artificial intelligence framework and the structural representation, wherein the control instruction is for lengthening the borehole along a current borehole trajectory or a different borehole trajectory; and control the drillstring to lengthen the borehole based on the control instruction.

20. One or more non-transitory computer-readable storage media comprising processor-executable instructions executable to instruct a processor to:

acquire resistivity measurements using a downhole tool of a drillstring disposed in a borehole in a subsurface environment;

perform a resistivity measurement-based inversion to generate a structural representation of a portion of the subsurface environment that includes an end of the borehole;

generate a control instruction using an artificial intelligence framework and the structural representation, wherein the control instruction is for lengthening the borehole along a current borehole trajectory or a different borehole trajectory; and control the drillstring to lengthen the borehole based on the control instruction.

* * * * *